United States Patent [19]

Kapp

[11] 4,407,597

[45] Oct. 4, 1983

[54] PAPER FEEDING APPARATUS FOR PRINTING APPARATUS

[75] Inventor: Ludwig J. Kapp, Montville, N.J.

[73] Assignee: Ziyad Incorporated, Denville, N.J.

[21] Appl. No.: 271,937

[22] Filed: Jun. 9, 1981

Related U.S. Application Data

[63] Continuation-in-part of Ser. No. 114,115, Jan. 21, 1980, Pat. No. 4,326,815.

[51] Int. Cl.[3] ..... B41J 11/58

[52] U.S. Cl. ..... 400/625; 400/629; 271/3

[58] Field of Search ..... 400/624, 625, 629; 271/4, 9

[56] References Cited

U.S. PATENT DOCUMENTS

| | | | |
|---|---|---|---|
| 4,067,566 | 1/1978 | Williams | 400/625 X |
| 4,084,805 | 4/1978 | Simpson | 400/625 X |
| 4,268,021 | 5/1981 | Rutishauser et al. | 400/625 X |
| 4,285,607 | 8/1981 | Steinhilber | 400/625 |

OTHER PUBLICATIONS

IBM Technical Disclosure Bulletin, vol. 23, No. 3, Aug. 1980, "Horizontal Sheet Stacker", G. B. Overton, pp. 951-952.

*Primary Examiner*—Paul T. Sewell

*Attorney, Agent, or Firm*—Lerner, David, Littenberg, Krumholz & Mentlik

[57] ABSTRACT

A paper feeding apparatus capable of feeding both individual sheets of paper, such as stationary, and envelopes to a printing device for printing of matter thereon, the printing device including a print head for printing on a sheet of paper and a paper moving platen for providing relative movement between the sheets of paper and the print head to effect printing on the paper. The paper feeding apparatus includes a first paper storage tray for storing a plurality of sheets of paper, and first paper drive rollers for feeding of a sheet of paper from the paper storage tray along a paper feed path to the platen on the printing device. The paper feed path is at least partially defined by a deflector plate which is arranged opposite from the first paper storage tray and is parallel to one side of the paper feed path so that sheets of paper are deflected by one surface of the deflector plate to be directed toward the paper moving platen as they are fed from the paper storage tray. A plurality of envelopes are adapted to be supported by the opposite, second surface of the deflector plate. A passageway is provided between the second surface of the deflector plate and the paper feed path so that envelopes may be fed therethrough into the paper feed path toward the paper moving platen. A second set of drive rollers are provided for feeding the envelopes through the passageway.

47 Claims, 30 Drawing Figures

PAPER FEEDING APPARATUS FOR PRINTING APPARATUS

BACKGROUND OF THE INVENTION

This is a continuation in part of my Application Ser. No. 114,115 entitled "Paper Feeding Apparatus and Method for Printing Apparatus", filed Jan. 21, 1980, now U.S. Pat. No. 4,326,815.

The present invention relates to a printing apparatus and paper feeding apparatus therefor, and more particularly to a paper feeding apparatus which will automatically feed individual paper documents to a printing device, and properly align and position the paper for the start of printing thereon by the printing device. The individual documents may comprise standard stationary, envelopes or other nonstandard sheets of paper or matter to be printed on. As used herein, the phrase "sheets of paper" will generally be used in its broad sense to mean individual documents or pieces of paper. In some instances, however, which will be apparent from the context in which it is used, the phrase will refer more specifically to standard flat articles of paper such as stationary and the like, as compared with nonstandard stationary, such as for example, envelopes.

Tremendous advandes have been made in the last few years in automating office procedures. Conventional typewriters have grown into mini-computers performing word processing, storage and other functions. The speed at which these machines produce words on paper is increasing at a rapid rate.

As added speed and sophistication are developed into such machinery, the actual putting of words onto paper becomes auxilliary to the main function of collecting and organizing the information into a format to be printed. In order to have flexibility and speed, many systems have been developed where an operator manipulates words on a cathode ray tube or other word processing equipment until the final copy is in the format desired. With all of these advances, it has developed that today one of the major bottlenecks in terms of time, and therefore usefulness of this equipment, is the rate at which paper can be brought to and moved past a printing head to produce the final hard copy.

Of course, it is possible to use continuous sheets of perforated paper, as is commonly done in computer applications, having sprocket holes along the side thereof to continuously feed and move the paper through an impact printer. This however requires special paper which is not suited to the many requirements for which normal typewriting is employed.

Many machines exist, both copying machines and printing machines, which automatically feed paper past a printing or reproducing station. These machines are normally run synchronously such that prior to the time that paper is fed, the information to be imparted to the paper is already organized and the paper is moved past the printing head in a continuous fashion. This is not suitable for impact printing devices since impact printing is accomplished with the paper being stationary rather than moving at the instant of printing, and further the adaption of normal typewriting type printing requires the moving of paper not only on an intermittent basis but also in the forward and reverse directions in accordance with the information to be typed. Still further, with such existing equipment, it is generally not possible to manually feed separate sheets of paper, which may be of a different size or thickness (such as for example envelopes), without disconnecting the equipment from the printing apparatus. Furthermore, the present day equipment is not generally capable of feeding both standard conventional sheets of paper, such as stationary, and nonstandard sheets of paper, such as for example, envelopes or other types of paper of a different size or thickness from standard stationary.

It is of course possible to radically change the printing equipment to conform with the needs of high-speed paper feeding. However, it is an object of this invention to provide a paper feeding apparatus to conform with the requirements of existing impact printing equipment rather than requiring the radical modification thereof. In particular, it is an object to provide a paper feeding apparatus which is capable of being retrofitted with respect to existing printing devices (i.e., distributed as an after market product) as well as being capable of being sold and distributed with or as an integral part of the printing apparatus. It is also an object to provide a paper feeding apparatus which is capable of feeding both standard sheets of paper as well as nonstandard sheets of paper, such as envelopes.

SUMMARY OF THE INVENTION

In accordance with one aspect of the present invention, there is provied a paper feeding apparatus for feeding sheets of paper to a printing device which will serve to effect printing on a sheet of paper, the printing device including printing means for printing on the sheet of paper and paper drive means for providing relative movement between the sheet of paper and the printing means to effect printing on the sheet of paper. The paper feeding apparatus includes paper storage means for storing a first plurality of individual sheets of paper and first paper feeding means for feeding a sheet of paper from the first paper storage means in a paper feed direction along the paper feed path to the paper drive means. Guide means are provided having a first surface positioned along the paper feed path on the side opposite from the paper storage means and extending parallel to the paper feed path to define a portion of the paper feed path, the first surface serving to deflect a sheet of paper fed by the first paper feed means from the paper storage means to move the sheet of paper along the paper feed path toward the paper drive means. The guide means also includes a second surface for supporting a second plurality of individual sheets of paper. Means are also provided for defining a paper passageway between the second surface of the guide means and the paper feed path at a location along the paper feed path intermediate the location of the paper storage means and the paper drive means. The apparatus further includes second paper feed means for feeding a sheet of paper from the second plurality of individual sheets of paper through the paper passageway into the paper feed path toward the paper drive means.

In this manner, the guide means not only serves to guide sheets of paper from the first storage means, but additionally serves to support the second plurality of sheets of paper. As can be appreciated, this allows for a more compact arrangement for the paper feeding apparatus. Advantageously, the first plurality of individual sheets of paper may comprise conventional stationary and the second plurality of sheets of paper may comprise envelopes. In the preferred embodiment, the second paper feed means is arranged adjacent the paper passageway, and the second plurality of sheets of paper are arranged on edge in a stack which is inclined downwardly toward the second paper feed means so that the bottom sheet in the stack is in engagement with the second paper feed means. The second paper feed means thus serves to prevent movement of the sheets of paper through the passageway into the paper feed path until the second paper feed means is actuated.

In accordance with another aspect of the present invention, there is provided a paper ejection mechanism for a printing device, the printing device including printing means for printing on a sheet of paper and paper drive means for providing relative movement between the sheet of paper and the printing means to effect printing on the sheet of paper. The paper ejection mechanism comprises ejection means for engaging a sheet of paper as it exits from the printing device and for moving the sheet of paper away from the printing device along an exit path of movement. Pivotable deflector means are provided which includes first and second spaced portions. The first portion is mounted adjacent the exit path to pivot about a pivot axis arranged on one side of the exit path. The pivotable deflector means is pivotable between a first position in which at least an intermediate portion intermediate the first and second portions is arranged to lie in the exit path and a second position in which the intermediate portion is out of the path of movement of the paper along the exit path. Receptacle means for receiving ejected sheets of paper is arranged adjacent the exit path opposite from the deflector means such that the exit path extends between the pivot axis of the deflector means and the receptacle means. The deflector means is pivotable from the first position to the second position when a sheet of paper is being moved along the exit path by the ejection means, and is pivotable from the second position to the first position when a sheet of paper is released by the ejection means to thereby direct the sheet of paper into the receptacle means.

In the preferred embodiment of the aspect of the present invention, the deflector means is pivotable from the second position toward the first position by means of gravity. Accordingly, this aspect of the present invention provides a relatively simple yet efficient means for directing sheets of paper into the receptacle means by serving to positively move the paper toward the receptacle means when a sheet of paper is released by the ejection means.

According to a still further aspect of the present invention, there is provided a paper feeding apparatus for a printing device which includes printing means for printing on a sheet of paper and paper drive means for providing relative movement between the sheet of paper and the printing means to effect printing on the sheet of paper. In accordance with this aspect, paper storage means are provided for storing a plurality of individual sheets of paper, and rotatable paper feed means are provided for feeding a sheet of paper from the paper storage means in a paper feed direction along a paper feed path to the paper drive means. Rotatable ejection means are also provided for ejecting a sheet of paper from the printing device after the sheet of paper has passed through the printing device. The paper feeding apparatus also includes reversible motor means operable to be driven in a first direction and in a second reversible direction, and coupling means for coupling the reversible motor means to the rotatable paper feed means and the rotatable ejection means so that when the reversible motor means is driven in the first direction, the rotatable paper feed means is rotated to feed a sheet of paper from the paper storage means along the paper feed path to the paper drive means, and so that when the reversible motor means is driven in the second reversible direction, the rotatable ejection means is rotated so as to eject the sheet of paper from the paper feed means.

In accordance with the preferred embodiment of this aspect, the coupling means includes a one way clutch intermediate the rotatable paper feed means and ejection means, and the reversible motor means is directly coupled to rotate the rotatable ejection means when the reversible motor means is driven in both the first and second directions. Thus, when the reversible motor means is driven in the first direction, the ejection means is rotated in a reverse direction and the one way clutch means serves to positively couple the rotatable paper feed means to rotate in response to rotation of the ejection means, whereas when the reversible motor means is rotated in the second reversible direction, the ejection means is rotated in a forward direction to eject sheets of paper, the one way clutch means serving to decouple the paper feed means from rotation with the ejection means.

This arrangement is advantageous in that a single motor means is operable to drive both the paper feed means for feeding sheets of paper and the ejection means to eject sheets of paper when desired. In accordance with the preferred embodiment, the paper feed means is only rotated when it is desired to feed a sheet of paper, whereas the ejection means is rotated in a forward direction to eject of a sheet of paper and in a reverse direction for rotating the paper feed means.

These and further features and characteristics of the present invention will be apparent from the following detailed description in which reference is made to the enclosed drawings which illustrate preferred embodiments of the present invention.

DETAILED DESCRIPTION OF THE PREFERRED EMBODIMENT

The Embodiment of FIGS. 1–16

Figure 1:
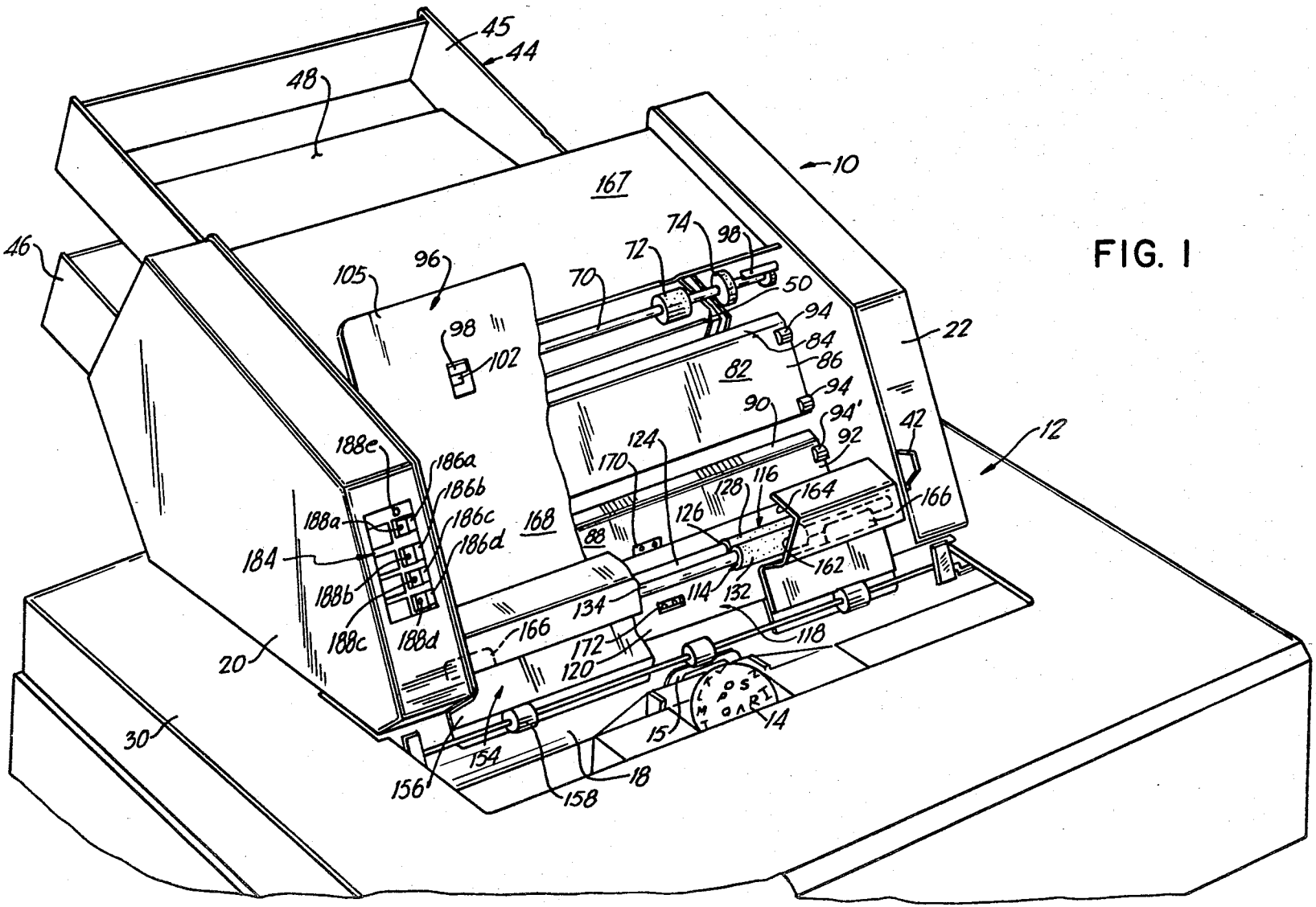
FIG. 1 is a perspective view of one embodiment of the paper feeding apparatus in accordance with the present invention mounted on a printing device, portions of the paper feeding apparatus being broken away to illustrate various components thereof.

Referring now to the drawings wherein like reference characters represent like elements, FIGS. 1–16 illustrate one embodiment of a paper feeding apparatus and the manner of operation thereof in accordance with the present invention. The paper feeding apparatus 10 is mounted onto a printing device 12 for operation in conjunction therewith. The printing device 12 generally includes printing means 14 for printing on a sheet of paper 16 and paper drive means 18 for providing relative movement between a sheet of paper 16 and the printing means 14 to effect printing on the sheet of paper 16. For example, in the embodiment shown in FIG. 1, the paper moving means comprises a rotatable, transversely extending platen 18 which is adapted to rotate about a transversely extending axis, and the printing means comprises a movable print head 14 which is adapted to traverse back and forth across the transverse length of the platen 18. As is conventional, a sheet of paper 16 to be printed on is received between the platen 18 and the paper guide therefor, which may include appropriate pressure rollers 19 in engagement with the platen 18 (see FIG. 8 for example), and advanced by rotation of the platen 18. The print head or wheel 14 is carried by a movable carriage which traverses across the transverse extent of the platen 18 by means of a suitable carriage motor. The print head 14 is arranged to be closely spaced from the platen 18 so that printing in lines is achieved on the paper 16 as the print head 14 traverses between the ends of the platen 18. Alternatively, the platen 18 could be carried by a carriage and moved transversely past the print head or means. During the printing operation, the platen 18 serves to rotate intermittently about the transverse axis to advance the sheet of paper 16 longitudinally relative to the print head 14 for the printing of the next line thereon by virtue of the transverse movement of the print head 14 with respect thereto.

Thus, it is appreciated that in the embodiment shown in FIG. 1, printing is accomplished by transversely moving the print head or wheel 14 relative to the paper 16 and then advancing the paper 16 longitudinally by rotation of the platen 18 to permit the print wheel 14 to traverse thereacross to effect the next line of printing. This printing operation may be as in a conventional typewriter from left to right, or the printing may be from left to right for one line of print with the next line of print being effected by movement of the printing head from right to left. This latter means of printing is commonly used in many present day word processing systems.

The paper feeding apparatus 10 in accordance with the present invention is mainly designed for use with printing devices 12 having automatic printing or typing capabilities, i.e., printing systems or devices in which a complete page of print is effected automatically without or with a minimal amount of instructions from the user. In such systems, the text of the matter to be printed may have been previously stored on a disk or other similar recording device, or may be in the memory of a cathode ray tube on which a user has completed work to arrange the matter or informtion in a desired format. When desired, the system simply prints the stored information onto sheets of paper.

Generally, in the printing operation, the matter or information is printed one line at a time, with the paper 16 then being automatically advanced for effecting printing of the next line, and so on until an entire page is printed. Such printing devices 12 are generally of the impact printing type, i.e., the print head impacts the paper 16 against the platen 18 to effect the printing. However, it should be appreciated that the paper feeding apparatus 10 in accordance with the present invention could also be used with other types of printing devices, such as for example ink jet printers, line printers, and/or non-impact electro-static printers.

As will be appreciated from the description hereinbelow, the paper feeding apparatus 10 in accordance with the present invention is also particularly well adapted to be retrofitted with such automatic printing devices 12, both in terms of the mechanical mounting on the printing device 12 as well as the electrical connections with the microprocessor or other control equipment for controlling the printing device 12 to print matter on sheets of paper. This is a most important capability as, as was noted in the Background of the Invention section above, present day information and paper handling systems have developed to a stage where the limiting factor with respect to the speed of handling and printing is the speed at which paper can be delivered and positioned for printing thereon by the printing device 12. Consequently, it is desirable that the paper feeding apparatus 10 for accomplishing the paper feeding and removal of the paper from the printing device 12 be capable of being universally adapted, with a minimum amount of changes or modifications, for use with such present day printing devices. In this regard, as automatic printing devices 12 have control capabilities for controlling the printing of words in a line and automatically advancing the paper for printing of the next line, the paper feeding apparatus 10 of the present invention preferably is capable of connection to the printing device 12 so as to use the standard commands generated for movement of the printing head 14 and advancement of sheets of paper 16, thus simplifying the retrofitting of the paper feeding apparatus 10 with an automatic printing device 12. In this regard, information respecting the standard commands and codes for movement of the platen 18 and the print head 14, as available from the printer interface and as used herein, are set forth in the Interface Manual as published by the printer manufacturer. Accordingly, the paper feeding apparatus 10 of the present invention is capable of distribution as an after market product, as well as for distribution with the sale of new printing equipment, in which event the paper feeding apparatus 10 may either be sold as a separate unit or as an integral unit with the printing device 12.

One example of such a typical printing device or system having the capability to automatically print matter, and one with which the preferred embodiment of the paper feeding apparatus 10 of the present invention is especially designed for use, is the Lanier Business Products' word processing unit sold under the tradename "No Problem" which includes suitable control commands for effecting an automatic printing of an entire page of type or print on a sheet of paper 16 automatically and which includes paper advance instructions (as by an instruction to rotate the platen 18) and other suitable controls for controlling the margins for the matter to be printed with respect to the paper.

Accordingly, the paper feeding apparatus 10 in accordance with the present invention is operable to feed sheets of paper 16 to the printing device 12, and in particular to the platen 18 thereof, and to control the platen or paper drive means 18 of the printing device 12 to move the paper 16 fed thereto to an appropriate position for printing to begin on the sheet of paper 16. Also, after printing has been completed, the paper feeding apparatus 10 is preferably operable to remove or eject the paper 16 from the printing device 12, to store or stack same in the paper feeding apparatus 10, and to then feed another sheet of paper 16 and move same into position for the beginning of printing thereon.

With the above features and principles in mind, the paper feeding apparatus 10 in accordance with the present invention will now be described.

Figure 3:
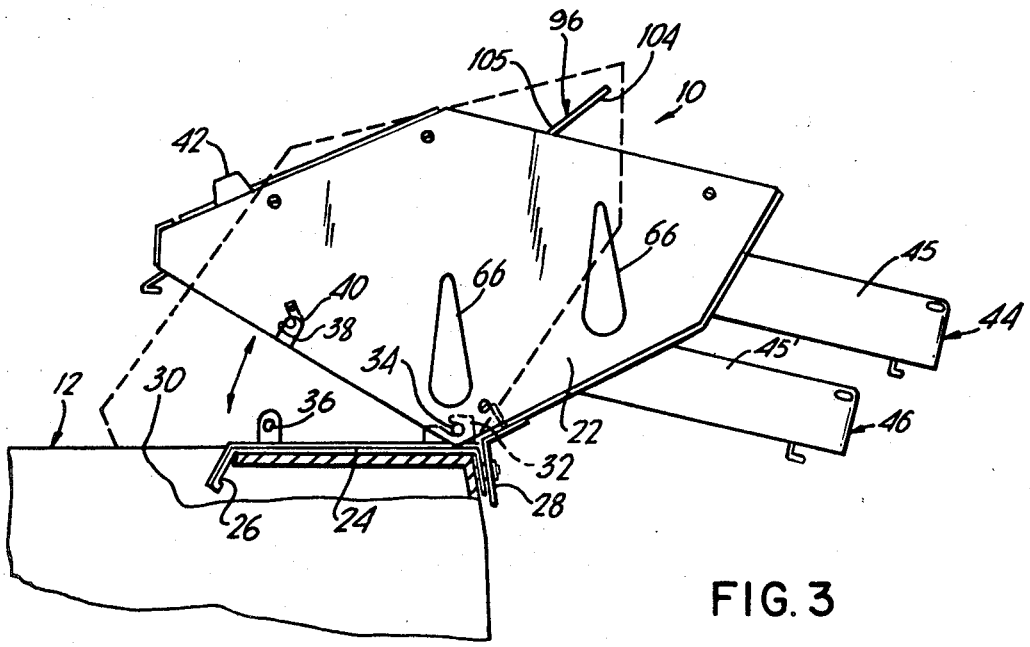
FIG. 3 is a side elevational view of the paper feeding apparatus of FIG. 1 mounted on a printing device, showing in full outline the paper feeding apparatus in a raised position for the manual feeding of sheets into the printing device without utilizing the paper feeding apparatus, and showing in dotted outline the paper feeding apparatus in a lowered position for the automatic feeding of sheets of paper to the printing device.
Figure 4:
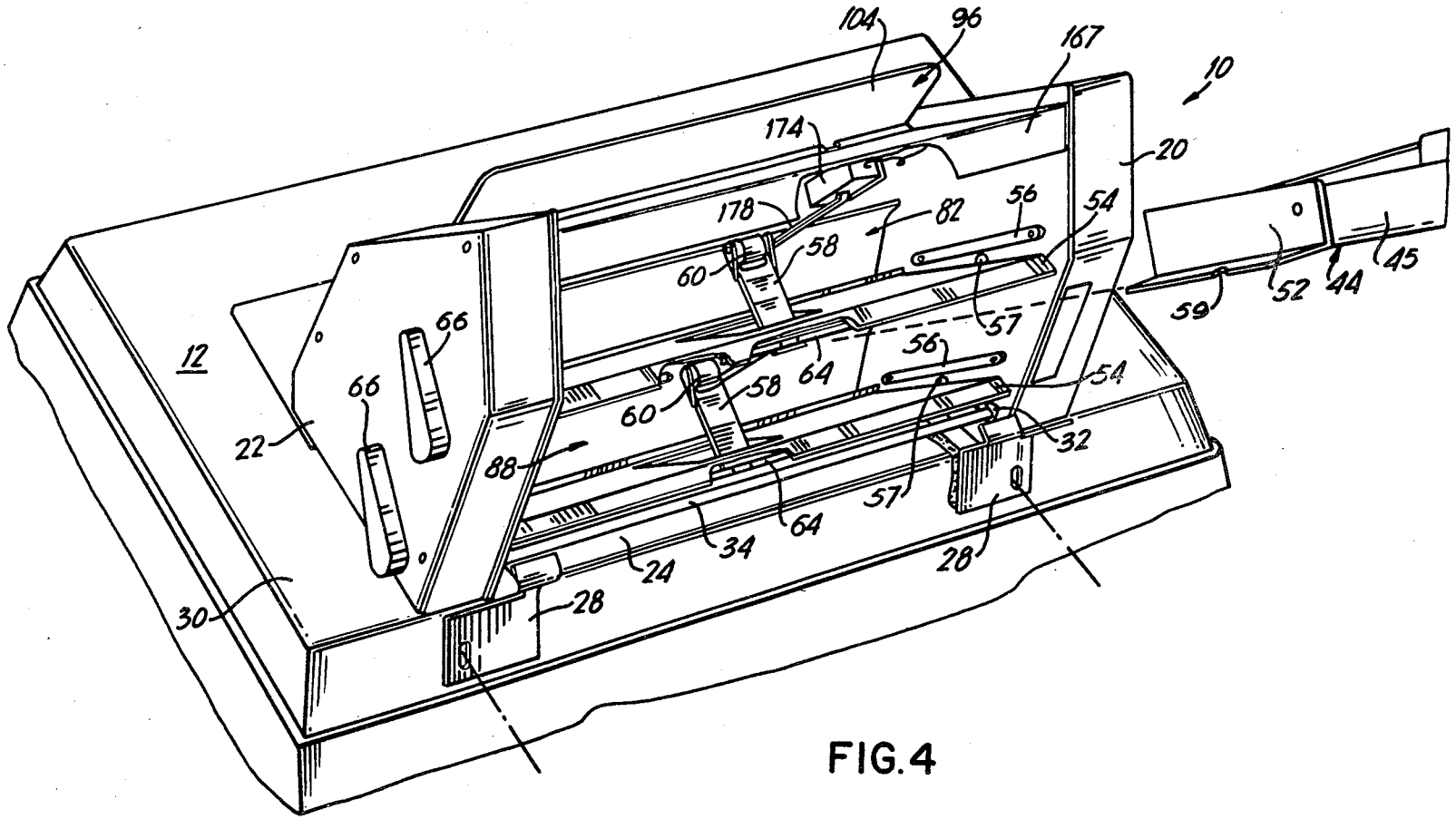
FIG. 4 is a rear perspective view of the paper feeding apparatus of FIG. 1 with the paper trays removed to illustrate various components of the apparatus.

The paper feeding apparatus 10 generally comprises a pair of upstanding generally parallel spaced side housings or covered frames 20, 22 between which sheets of paper 16 will be fed to the printing device 12. The side housings 20, 22 are joined together and supported on a base support member or mounting plate 24 for mounting of the paper feeding apparatus 10 onto the printer 12 so as to be in a proper position for feeding sheets of paper 16 to the platen 18 thereof. In the preferred embodiment, this mounting plate 24 comprises a generally flat plate member having mounting means or brackets 26, 28 at the front and rear transverse ends thereof, and provides a suitable support surface for supporting the paper feeding apparatus 10 on the printing device 12. The mounting plate 24 is designed to be attached to the rear top portion or cover 30 of the printer device 12 behind the paper moving platen 18 and the transversely movable printing head 14. The dimensions and configuration of the mounting plate 24 may be varied depending on the particular printing device with which the paper feeding apparatus 10 is to be used, so that the paper feed path of the paper feeding apparatus 10 will be properly aligned with the paper moving platen 18 of the printing device 12. As best shown in FIGS. 3 and 4, the mounting plate 24 is attached in a suitable fashion with the mounting means 26, 28 to the upper rear cover 30 of the printing device 12.

In the preferred embodiment, the mounting plate 24 includes a pair of transversely spaced rear hook members 32 (see FIGS. 3, 4 and 5) for receiving a transversely extending support or attaching bar 34 which extends between the upright side housings 20, 22 at the rear of the paper feeding apparatus 10. A forward transversely extending support bar 36 (see FIGS. 3 and 5) is provided at the forward end of the mounting plate 24 which is adapted to be received in appropriate recesses 38 in the upright housings 20, 22 of the paper feeding apparatus 10. The paper feeding apparatus 10 is easily attached to this mounting plate 24 by hooking the attaching bar 34 at the rear bottom of the paper feeding apparatus 10 in the hooks 32 provided at the rear of the mounting plate 24 and then lowering, by rotation about the rear attaching bar 34, the paper feeder apparatus 10 into position onto the printer 12 so that the forward support bar 36 is received in the recesses 38 in the interior of the side housings 20, 22. It will be appreciated that the paper feeder apparatus 10 is rotatable about the attaching bar 34 between a lowered position (shown in dottled outline in FIG. 3) and an upper position (shown in full outline in FIG. 3) for a purpose to be described more fully hereinbelow. When in the lowered position, the paper feeding apparatus 10 is held in place relative to the printing device 12 and mounting plate 24 by means of a suitable locking device, which in the preferred embodiment comprises a spring biased pivotal hook member 40. Actuation for effecting locking and unlocking of the spring biased hook member 40 is achieved by depressing the locking button 42 on the front of the paper feeding apparatus 10.

Also, in the preferred embodiment, a pair of paper trays 44, 46 are provided for storing a first and second plurality of sheets of paper 16 for feeding to the printing device 12. The paper trays 44, 46 are supported one above the other at the rearward end of the paper feeding apparatus 10. As each of the paper trays 44, 46 is similarly constructed and supported between the housings 20, 22, only the upper paper tray 44 and the manner of supporting same will be described. The upper paper tray 44 comprises a tray shaped box member 45 having a paper support plate 48 pivotally supported in the bottom thereof. The dimensions of the tray shaped box member 45 substantially corresponds to the dimensions of the paper 16 to be supported therein. The sheets of paper 16 are placed on the paper support plate 48 and the paper support plate 48 is pivotable upwardly to raise the forward edges of the sheets of paper 16 to be at or just above the forward end of the paper tray 44 and in contact with drive rollers 72 for feeding of the paper (to be described more fully hereinbelow) (see FIG. 6). Also, suitable paper retention means may be provided for normally retaining the paper 16 in the paper tray 44, such as for example pivotable tab members 50 arranged at the forward side edges of the paper tray 44. These tab members 50 also serve to separate the sheets of paper 16 so that a single sheet of paper at a time will be fed by the drive rollers 72 from the paper tray 44.

Figure 7:
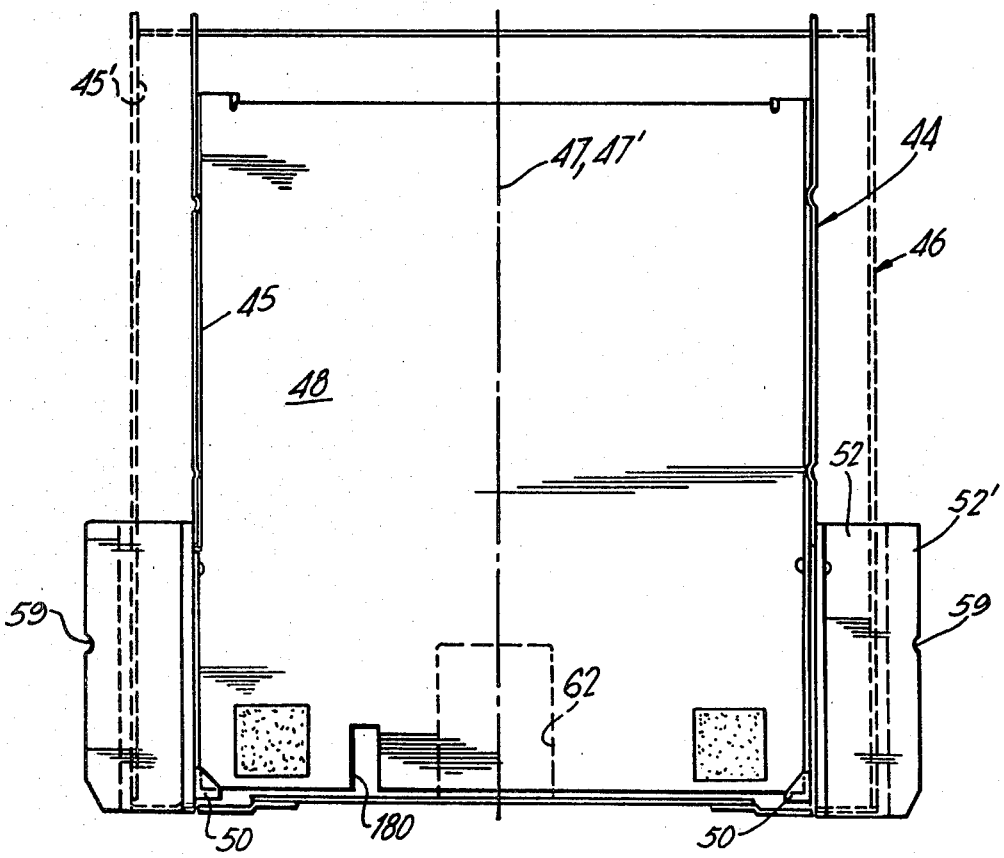
FIG. 7 is a plan view of the upper paper tray shown in full outline and of the lower paper tray shown in dotted outline superimposed therebeneath to illustrate different size paper trays for different sizes of paper.

The paper tray 44 is also provided with a pair of L-shaped brackets 52 each having one leg secured to the sides of the box shaped member 45 and the other leg extending away therefrom. The spacing between the outer ends of the L-shaped brackets 52 substantially corresponds to the spacing between the side housings 20, 22 so that the paper 16 in the paper tray 44 may be centered between the housing sides 20, 22. As can be appreciated, a paper tray for different width sheets of paper may similarly be centered between the side housings 20, 22 so that the paper thereof is also centered by simply constructing the paper tray therefor to have suitable dimensioned L-shaped brackets 52 secured to the sides thereof so that the outer ends of the L-shaped brackets 52 are spaced substantially the same distance as the spacing between the upright side housings 20, 22. This is illustrated in FIG. 7 which shows an upper paper tray 44 for one width of paper 16 in full outline, and a second or lower paper tray 46 superimposed thereunder in dotted outline for a second width of paper. Although the dimensions of the box shaped portions 45, 45' differ from one another, the outer dimensions for the L-shaped brackets 52, 52' are identical, and the center lines 47, 47' for each of the trays 44, 46 coincide with one another.

A tray support plate 54 is provided between the side housings 20, 22 for supporting the paper tray 44 (see FIG. 4). Each of the side housings 20, 22 is also provided with a bar 56 parallel spaced above the tray support plate 54 to define a space for receipt of the transversely or laterally extending legs of the L-shaped brackets 52 between the bar 56 and its respective tray support plate 54. A suitable spring biased detent ball 57 may be provided in this space in the side housings 20, 22 for receipt in a suitable recess 59 (see FIG. 7) in the laterally extending legs of the L-shaped brackets 52 to retain the paper tray 44 in position shown when it is inserted between the side housings 20, 22.

The tray support plate 54 is provided with a centrally located spring biased pivotable plate member 58 having a roller element 60 secured thereto for being received in an appropriate opening or recess 62 in the bottom of the paper tray 44 for resiliently pivoting the paper support plate 48 in the paper tray 44 upwardly to raise the forward edges of sheets of paper 16 supported thereon. More particularly, the plate member 58 is connected to a rotatable rod 64 journalled in the side housings 20, 22 and connected at one end to a paper tray insertion lever 65 located and mounted on the side housing 22. The tray insertion layer 66 is spring biased to bias the roller element 60 and plate member 58 towards the raised position, and is operable to pivot the roller element 60 and plate member 58 downwardly to permit insertion and removal of the paper tray 44. In the downward or lower position, the roller element 60 and plate member 58 lie beneath the surface of the tray support plate 54.

Spaced above the upper tray support plate 54, there is provided a transversely extending drive rod 70 having a first and second pair of spaced rollers 72, 74 secured thereto. The inner pair of rollers 72 are drive rollers which are spaced at equal distances from the transverse center of the drive rod 70 to engage spaced portions of the upper sheet of paper 16 urged into contact therewith by means of the spring biased roller element 60 which forces the paper support plate 48 upwardly. These inner drive rollers 72 each include a roller clutch mechanism so that the drive rollers 72 will be free rolling relative to the drive rod 70 in one direction (i.e., the counterclockwise direction relative to the drive rod 70 as viewed in FIG. 8) and will be locked with the drive rod 70 in the opposite direction (i.e., the clockwise direction relative to the drive rod 70 as viewed in FIG. 8). In this way, when the drive rod 70 is rotated (in a manner to be described hereinbelow) in the counterclockwise direction as viewed in FIG. 8, the drive rollers 72 will be rotated therewith to engage and force a single sheet of paper 16 from the supply tray 44 forwardly thereof. On the other hand, when the drive rod 70 stops rotation and the paper is pulled out of the paper tray (as described below), the drive rollers 72 will be free to rotate in the counterclockwise direction.

The outer pair of rollers 74 comprise freely rotating idler or support rollers 74 which are adapted to assist in feeding a sheet of paper from a paper tray (when inserted between the side housings 20, 22) which is of a greater lateral dimension than the paper 16 in the tray 44 (see FIG. 7). The support rollers 74 are not driven by the drive rod, but rather simply provide an additional means for reliable separation and feeding of relatively wide sheets of paper from a paper supply tray 44.

Figure 2:
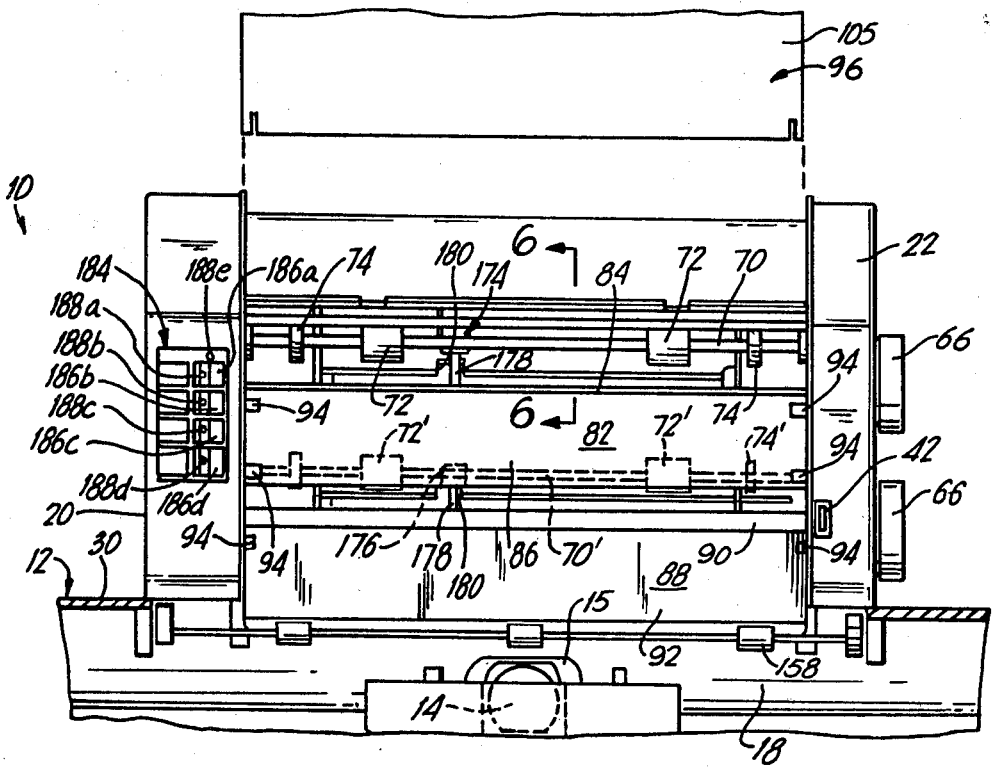
FIG. 2 is a front elevational view of the paper feeding apparatus of FIG. 1 mounted on the printing device, with portions removed to illustrate various components thereof.
Figure 5:
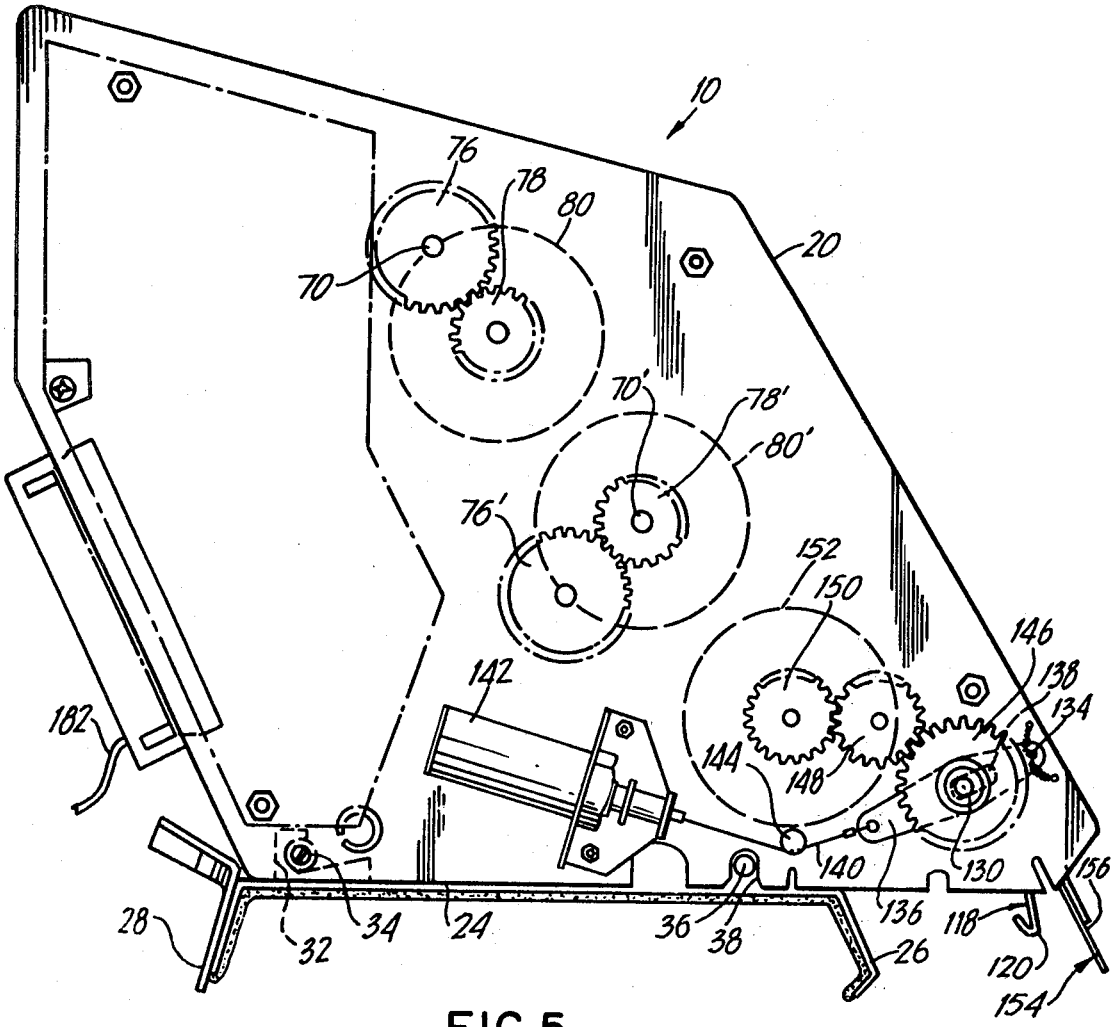
FIG. 5 is a side elevational view of the paper feeding apparatus shown in FIG. 1 with one of the cover plates on the left hand upright housing removed to illustrate the various components therein.
Figure 6:
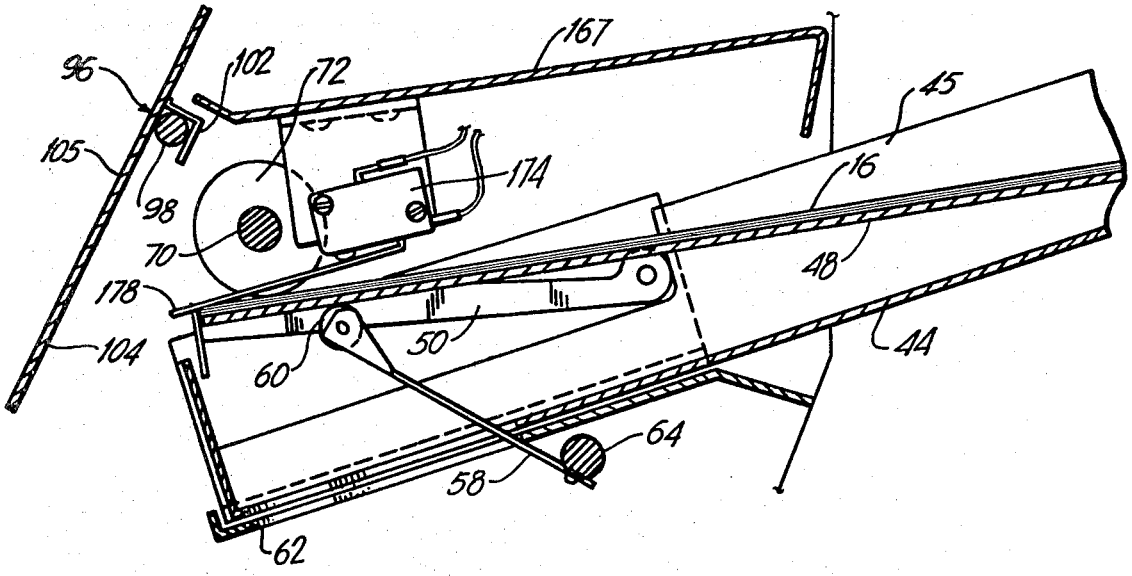
FIG. 6 is a sectional view taken along lines 6—6 of FIG. 2 illustrating how sheets of paper are supported in a paper tray and mounted in the paper feeding apparatus.

As can best be seen in FIGS. 1, 2 and 5, the ends of the drive rod 70 are journalled in the opposite upright side housings 20, 22. In the side housing 20, the drive rod 70 is provided with an integral drive gear 76 thereon which meshes with a suitable gear 78 attached to the drive shaft of a motor 80 also supported in the upright side housing 20. As will be appreciated, actuation of the motor 80 to rotate in the clockwise direction (as viewed in FIG. 5) serves to drive the gear 78 which in turn drives the gear 76 and the drive rod 70 to rotate the drive rollers 72, 74 about the axis of the drive rod 70. In this regard, the motor 80 is rotated clockwise and the drive rod 70 is rotated in a counterclockwise direction as shown in FIG. 5 so that the drive rollers 72 will engage a sheet of paper 16 and advance same out of the paper tray 44 in a direction substantially parallel to or in the same direction as the direction which the sheets of paper 16 extend, i.e., toward the right and slightly downward as viewed in FIG. 5.

A similar set of rollers 72' and 74', drive rod 70', motor 80' and gears 76', 78' are also provided for the lower paper tray 46. Each of these motors 80, 80' are connected with appropriate circuitry so as to be actuated when desired, as more fully described hereinbelow.

Figure 8:
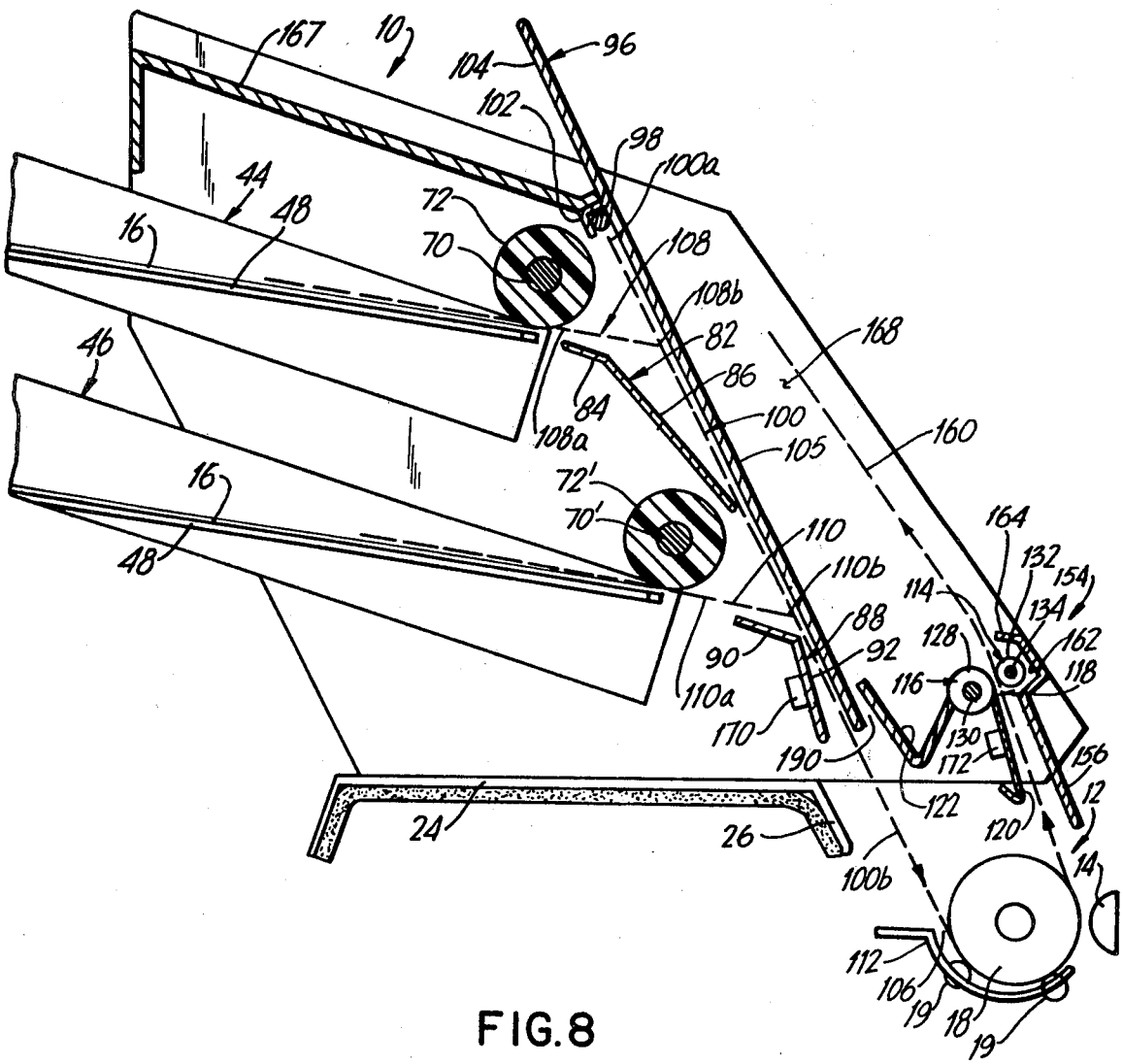
FIG. 8 is a schematic side elevational view of the paper feeding apparatus shown in FIG. 1 and portions of a printing device illustrating the various paper feed and exit paths for sheets of paper.
Figure 9:
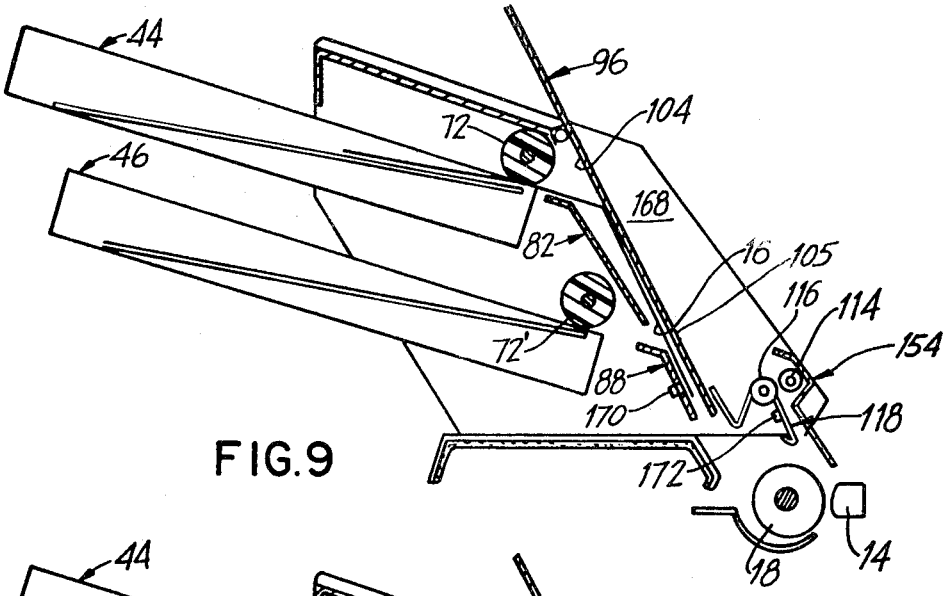
FIG. 9 is a side schematic elevational view, similar to that shown in FIG. 8, but on a smaller scale, illustrating a sheet of paper being fed from the upper paper tray and moving past the paper inlet sensor.

Positioned adjacent the upper paper tray 44 and extending between the upright side housings 20, 22, there is provided an upper paper guide plate member 82 having a first upper plate portion 84 closely spaced with respect to the forward end of the paper tray 44 and extending in substantially the same direction as the sheets of paper 16 therein and having a second downwardly inclined portion 85 obliquely oriented with respect to the first upper plate portion 84 (see FIGS. 1, 2 and 8). A similar somewhat shorter lower guide plate member 88 is provided for the lower paper tray 46, and also includes an upper plate portion 90 positioned so that the end thereof is closely spaced from the lower paper tray 46 and extends in substantially the same direction as the paper sheets 16 therein and a downwardly inclined plate portion 92 obliquely oriented with respect to the upper plate portion 90 and extending downwardly towards the lower end of the paper feeding apparatus 10. Each of these guide plate members 82, 88 are supported by suitable fasteners 94 provided in the opposite lateral ends thereof and which are secured to the inner side walls of the side housings 20, 22. The fasteners 94 protrude slightly beyond the surfaces of the plate portions 86, 92 of the guide plate members 82, 88 at the lateral ends thereof.

These guide plate members 82, 88, together with a removable deflector plate 96 define the paper feed path 100 for the sheets of paper 16 which are fed to the paper moving platen 18 of the printing device 12. This paper feed path 100 is shown in dotted outline in FIG. 8. More particularly, the paper deflector plate 96 is removably supported on a transversely extending rod 98 which extends between the side housings 20, 22 at the upper end thereof by means of appropriate hook members 102 provided on the rear surface 104 of the deflector 96. The lower end of the deflector plate 96 is spaced from the guide plate members 82, 88 by means of the protruding fasteners 94 of the lowermost guide plate member 88.

Thus, it is appreciated, especially from viewing FIGS. 8–15, which illustrate the various steps in feeding of paper from the paper feeding apparatus 10 to, through and from the printing device 12, that the lower downwardly extending portions 86, 92 of the guide plate members 82, 88 and the rear surface 104 of the deflector plate 96 define a main paper feed path 100 along which paper may be fed from either of the paper trays 44, 46 to guide the sheets of paper 16 downwardly towards the lower end of the paper feeding apparatus 10 toward the paper moving platen 18. In this regard, it is to be noted that the paper 16, once it is fed into the paper feed path 100 is guided substantially in a straight line to the paper receiving or inlet entrance 106 of the paper moving platen 18 which corresponds with the conventional inlet for inserting paper into the platen 18 of the printing device 12. In other words, the paper feed path 100 for the apparatus is arranged to directly feed paper 16 into the paper receiving inlet 106 of the printing device 12. It will be appreciated that this paper receiving inlet 106 is conventionally arranged at a transverse angle with respect to the upper surface 30 of the printing device 12 and in fact is capable of handling paper sheets oriented at a wide variety of transverse angles with respect to the upper rear surface 30 of the printing device 12. Thus, the orientation of the paper feed path 100 of the paper feeding apparatus 10 of the present invention will serve to precisely guide the sheets of paper 16 fed therealong into the paper receiving inlet 106 for the printing device 12. In this regard, the positioning of the paper feed path 100 relative to the paper receiving inlet 106 of the printing device 12 is achieved by proper positioning of the mounting plate 24 on the printing device 12.

It will also be noted from reviewing FIGS. 8–15, that the sheets of paper 16 which are fed from the paper trays 44, 46 into the paper feed path 100 are initially guided along the respective inlet feed paths 108, 110 (defined by the upper plate portions 84, 90 of the guide plate members 82, 88) at an oblique angle with respect to the direction of the main paper feed path 100 so that the paper will be deflected by the rear surface 104 of the deflector plate 96 downwardly into and along the paper feed path 100. This is true whether a sheet of paper 16 is fed from the upper paper tray 44 (see FIG. 9) or from the lower paper tray 46 (see FIG. 14). Thus, it will be appreciated that whether the paper is being fed from the upper paper tray 44 or the lower paper tray 46, its respective guide plate member 82 or 88, together with the deflector plate member 96 serves to define two paper paths along which paper sheets 16 may move. One path corresponds to the main paper feed path 100 directing paper 16 to the paper moving platen 18 and defined by the lower portions 86 or 92 of the guide plate members 82 or 88 and the rear surface 104 of the deflector plate 96. This paper feed path has an upper end 100*a* and a lower end 100*b*. The other paper paths correspond with the inlet feed paths 108 or 110 for the respective paper trays 44 or 46 for introducing paper into the main paper feed path 100 and are defined by the upper plate portions 84 or 90 of the associated guide plate members 82 or 88. These inlet feed paths 108, 110 each have a first end 108*a*, 110*a*, arranged adjacent the associated paper trays 44, 46, and drive rollers 72, 72' therefor, and a second end 108*b*, 110*b* arranged adjacent the main paper feed path 100 and intermediate the upper and lower ends 100*a*, 100*b*, thereof.

At the paper receiving inlet 105 of the printing device 12, the paper 16 is guided between the paper moving platen 18 and the paper guide 112 therefor (which generally includes suitable pressure rollers 19) so that upon rotation of the platen 18, the paper 16 will be advanced about the platen 18 and moved past the printing head 14 so as to be in position for effecting printing thereon by movement of the printing head 14 transversely across the platen 18 and by rotation of the platen 18 to advance the paper 16 for different lines of printing. In this regard, it will be noted that the paper 16 is positively fed by the drive rollers 72, 72' from the associated paper tray 44, 46 into the paper receiving inlet 106 to be received and moved by the platen 18. Once the paper 16 is received by the platen 18. The rotation of the drive rod 70 or 70' is stopped, and the roller clutch mechanism in the drive rollers 72 or 72', allows the platen 18 to easily pull the paper from the paper tray 44 or 46 to advance the paper 16 past the print head 14. In this regard, once the paper 16 is in position for printing, the platen 18 may be advanced and moved in accordance with the normal printing instructions or commands for the printing device 12 for effecting printing on the paper 16.

The paper feeding apparatus 10 of the present invention also includes ejection means for ejecting a sheet of paper 16 from the printing device 12 after printing has been effected thereon. In the preferred embodiment, this ejection means comprises a pair of spaced ejection roller means 114, 116 (best seen in FIG. 1 and FIGS. 8–15) which are supported at the forward end of the paper feeding apparatus 10 between the side housings 20, 22 are arranged so as to receive a sheet of paper 16 as it exits from the printing device 12. In this regard, it is to be noted that the sheet of paper 16 is guided between the ejection roller means 114, 116 while printing is being effected thereon, the spacing of the ejection roller means 114, 116 serving to allow the paper 16 to move freely under the control of the platen 18. When it is desired to eject a sheet of paper 16 after the printing has been completed, the forward ejection roller means 114 is moved towards the rear ejection roller means 116 to grippingly engage a sheet of paper 16. The ejection roller means 114, 116 are then rotated to pull the sheet of paper 16 upwardly away from the printing device 12 and to stack same against the front surface 105 of the deflection plate 96.

More particularly, at the forward end of the side housings 20, 22, there is provided an exit guide plate member 118 having a front surface 120 inclined downwardly and adapted to lie just above the rotatable platen 18 of the printing device 12 adjacent the exit end thereof for a sheet of paper 16 and having a rearwardly inclined V-shaped surface 122 which serves to support the lower edges of the ejected sheets of paper 16. The forward upper end of the V-shaped surface 122 is integral with the front surface 120 at 124 to provide a smooth transition therebetween, and the rearward end of the V-shaped surface 122 is arranged in close spaced relationship with the lower end of the deflector plate 96, as can best be seen in FIG. 8. A curved corner or bend 124 between the V-shaped surface 122 and the front surface 120 of the exit guide plate member 118 is provided having transversely extending openings 126 therein for receipt of a pair of spaced roller members 128 which comprise the ejector roller means 116. As can best be seen in FIGS. 1 and 8, these rear ejector rollers 128 are fixedly connected to a transversely extending shaft 130 which is journalled in the upright side housings 20, 22. The other ejector roller means 114 similarly comprise a pair of forward spaced roller members 132 affixed to a transversely extending shaft 134 mounted in the side housings 20, 22, the forward roller members 132 being arranged directly opposite from the rear roller members 128.

The ends of the forward transversely extending shaft 134 in the side housings 20, 22 are journalled in a plate member 136 supported in the side housings 20, 22, for movement to move the forward roller members 132 into engagement with the rear roller members 128. As best seen in FIG. 5, the movable plate members 136 are spring biased to normally maintain the forward roller members 132 in spaced relationship with respect to the rear roller members 128 in order to provide a space for a sheet of paper 16 to freely move therebetween. The movable plate members 136 each include a slot 138 therein through which the transversely extending shaft 130 for the rear roller members 128 pass. The rearward end of the movable plate members 136 are each provided with a cable 140 which is connected to retractable solenoid members 142 fixedly mounted in brackets in each of the upright side housings 20, 22. These cables 140 connected to the solenoid members 142 and the movable plate members 136 each pass about a transversely extending sleeve 144 mounted in the side housings 20, 22. Simultaneous retraction of the solenoid members in the side housings 20, 22 serves to pull the plate members 136 rearwardly to thereby move the forward ejection roller members 132 into engagement with the rear ejection roller members 128. The extent of travel of the plate members 136 and thus the forward roller members 132 may be limited by the length of the longitudinal slot provided in the plate members 136, or alternatively by the engagement of the forward ejection rollers 132 with the rear rejection rollers 128.

The transversely extending rear shaft 130 is provided at one end (the left hand end as viewed in FIG. 1) with a rotatable gear 146 fixedly mounted thereto and in meshing engagement with a second gear 148 rotatably supported on the wall of the upright side housing 20. This second gear member 148 in turn is in meshing engagement with a gear 150 fixed to the drive shaft of an ejection motor 152 mounted in the upright side housing 20. Actuation of the ejection motor 152 thus causes the second gear 150 to rotate to in turn rotate the rear ejection shaft 130 to drive the rear ejection rollers 128 in a counterclockwise direction as viewed in FIG. 5. As can be appreciated, when the forward ejection rollers 132 are moved into engagement with the rear ejection rollers 128 and the rear ejection rollers 128 rotated by the ejection motor 152, the forward and rear ejection rollers 132, 128 will grippingly engage a sheet of paper 16 therebetween and rotate in opposite directions to pull the paper 16 away from the printing device 12 and move same upwardly (see FIG. 12). This upward movement of the sheet of paper 16 will continue until the paper 16 is ejected from the rollers 128, 132, at which time it will fall backwardly and downwardly (as viewed in FIGS. 8–15) to rest in a receptacle 168 therefor defined by the lower end of the V-shaped surface 122 of the exit guide plate member 118 and the forward surface 105 of the deflector plate 96 (see FIG. 13). As the sheets of paper 16 are ejected from the printing device 12, the sheets 16 will thus be stacked against the deflector plate 96 with the lower ends thereof resting in the V-shaped surface 122 of the exit guide plate member 118 (see FIG. 13).

The paper feeding apparatus 10 is also provided with a removable forward cover member 154 which defines with the forward surface 120 of the exit guide plate member 118 an exit path of movement 160 (see FIG. 8) for guiding the sheets of paper 16 so they leave the platen 18 upwardly between the normally spaced ejection rollers 128, 132. For this purpose, the cover member 154 includes a downwardly extending plate portion 156 which is slightly inclined with respect to the forward surface 120 of the exit guide plate member 118 to provide a relatively large entrance which tapers toward the ejection rollers 128, 132. The lower front surface 156 of the cover member 154 also serves as a stop or rest for the paper rollers 158 of the printing device 12 which normally serve to direct the paper 16 away from the print head 14. The cover 154 also includes a recessed portion 162 for the forward ejection rollers 132 and the mounting shaft 134, and an upper deflection surface 164 for directing the sheet of paper 16 rearwardly towards the deflector plate 96. The cover member 154 may also be provided with upwardly extending tab portions 166 extending from the inner surface of the lower forward end portion 156 for ensuring that the paper 16 is guided between the ejector rollers 128, 132 and does not engage the support shaft 134 for the forward ejection rollers 132 (see FIG. 1).

The paper feeding apparatus 10 of the present invention also includes a pair of paper movement sensors 170, 172 for sensing when a sheet of paper 16 is being moved therepast. Each of these sensors 170, 172 is of the photoelectrical reflective type which transmits a beam of light and which includes means for receiving the reflected light to close the sensor 170, 172. Thus, when a sheet of paper 16 is moved in front of each of the sensors 170, 172, the paper 16 will serve to reflect and direct the projected light back to the sensor 170, 172 which detects same and closes the sensors 170, 172.

The first paper movement sensor 170 is mounted in the lower paper guide plate member 88 adjacent the lower end of the paper feed path 100. This sensor 170 serves to detect if and when a sheet of paper 16 is moved therepast in order to signal the controller to actuate the platen 18 for rotation to receive a sheet of paper 16 fed from one of the paper trays 44 or 46. The second paper movement sensor 172 is located in the outlet or exit path 160 of movement of a sheet of paper 16 in the front surface 120 of the exit guide plate member 118 for detecting when a sheet of paper 16 has been picked up by the platen 18 and is being moved thereby in the path 160. This sensor 172 also serves to provide a reference point used in the positioning of the sheet of paper 16 in a proper print position relative to the printing head 14. Each of the sensors 170, 172 are centrally located with respect to the longitudinal center line of the paper feeding apparatus 10 so that they will be operable with respect to all widths of paper which may be utilized in the paper feeding apparatus 10.

The paper feeding apparatus 10 further includes paper tray sensors 174, 176 for sensing when the paper trays 44, 46 are out of paper. These sensors, 174, 176, one for the upper tray 44 and one for the lower tray 46, are mounted on the underside of either the top support plate 167 or the upper paper tray plate member 54. Each of these tray sensors 174, 176 includes a cantilevered movable switch actuator 178 which is directed towards its respective paper tray 44, 46 and engages a sheet of paper 16 when paper is in the tray 44, 46. The paper support plates 48 in the paper trays 44, 46 are each provided with a slot 180 therein in alignment with the switch actuators 178 of the respective sensors 174, 176. Each of the tray sensors 174, 176 are open when the switch actuators 178 are raised and are closed when the switch actuators 178 are lowered, the actuators 178 being biased toward the lowered position. As long as a sheet of paper 16 is in the paper tray 44 or 46 on top of the paper support plate 48 (which is biased upwardly by the roller elements 60) the actuators 178 will be in the raised position. However, when the last sheet of paper 16 is removed from the paper tray, 44 or 46, or when the paper tray release lever 66 is depressed or the paper tray 44, 46 has been removed, there will be no sheet of paper or other means for maintaining the switch actuators 178 in the raised position and the actuators 178 will thus move into its lower position, thereby providing an indication that no paper is available for feeding to the printing device 12.

The operation of the paper feeding apparatus 10 will now be described.

Initially, the paper feeding apparatus 10 is mounted to the upper rear surface 30 of a printing device 12 with the paper feed path 100 being aligned with the inlet 106 to the paper platen 18 and with the paper exit path 160 being aligned with the exit end of the platen 18. If a conventionally used cylindrical platen 18 is provided in the printing device 12, the spacing between the paper feed path 100 and the paper exit path 100 in the paper feeding apparatus 10 will substantially correspond to the diameter of the platen 18. This mounting of the paper feeding apparatus 10 is accomplished by inserting the rear transversely extending bar 34 into the hook members 32 of the mounting plate 24, previously mounted to the printer device 12, and then tilting the paper feeding apparatus 10 downwardly while depressing the locking button 42 to receive the forward transverse bar 36 on the mounting plate 24. The locking button 42 is then released to secure and lock the paper feeding apparatus 10 in place on the mounting plate 24. The paper feeding apparatus 10 is then connected electronically to the printer device 12 via a suitable electrical connection device and cable 182. The electrical section of the paper feeding apparatus 10 includes a microprocessor, an interface and a cable 182. The microprocessor essentially serves to control the operation of the paper feeding apparatus 10 during feeding as well as to cooperatively control movement of the platen 18 and printing head 14 to the extent necessary for proper feeding of sheets of paper 16 and moving the same into proper positioning for printing. In this regard, to the extent that the paper feeding apparatus 10 controls operation of the platen 18 and print head 14 of the printer device 12, the paper feeding apparatus 10 uses the conventional codes or commands used by a printing device 12 via the control circuitry therefor. The information respecting these codes or commands, as available from the printer interface and as used herein, are set forth in the Interface Manual which, in the instance of the exemplary embodiment which is used in conjunction with a Lanier "No Problem" word processing unit, is published by Lanier Business Products.

The paper feeding apparatus 10 permits the automatic loading of sheets of paper 16 into the printing device 12 for printing thereon either from commands located in the text being processed by the printing device 12 or by operator selection through a control panel 184 located in the front of the paper feeding apparatus 10. Thus, in this latter regard, the paper feeding apparatus 10 may be used to feed sheets 16 automatically to the printing device 12 and print any previously created text that is stored on a disk or in the word processing unit without any additional commands for controlling operation of the paper feeding apparatus 10 being made to the text.

The control panel 184 in the preferred embodiment consists of four switches 186*a–d* and five lights 188*a–e*. Four of the lights 188*a–d* are mounted on the switches 186*a–d* and the remaining light 188*e* is located on the top of the panel 184 to provide an indication that the power is on for the printing device 12. In this regard, this power on light 188*e* indicates that the paper feeding apparatus 10 is connected to the printer device 12 and has power. Under normal operation, only the power light 188*e* will be on and the other four lights 188*a–d* will be off. One of the switches and lights, for example, the upper switch 186*a* and light 188*a*, are for resetting the operation of the paper feeding apparatus 10 and to indicate that there is a fault. The second switch 186*b* may for example control feeding of paper 16 from the upper paper tray 44 and, when the light 188*b* is lit, to indicate that the tray 44 is empty. Similarly, the third switch 186*c* is for controlling feeding from the lower paper tray 46 and the light 188*c* serves to indicate when the lower tray 44 is empty. The fourth switch 186*d* may provide control of the mode of operation of the paper feeding apparatus 10, to be described more fully hereinbelow, with the light 188*d* indicating that the feeding apparatus 10 is in the manual mode of operation.

Figure 16A:
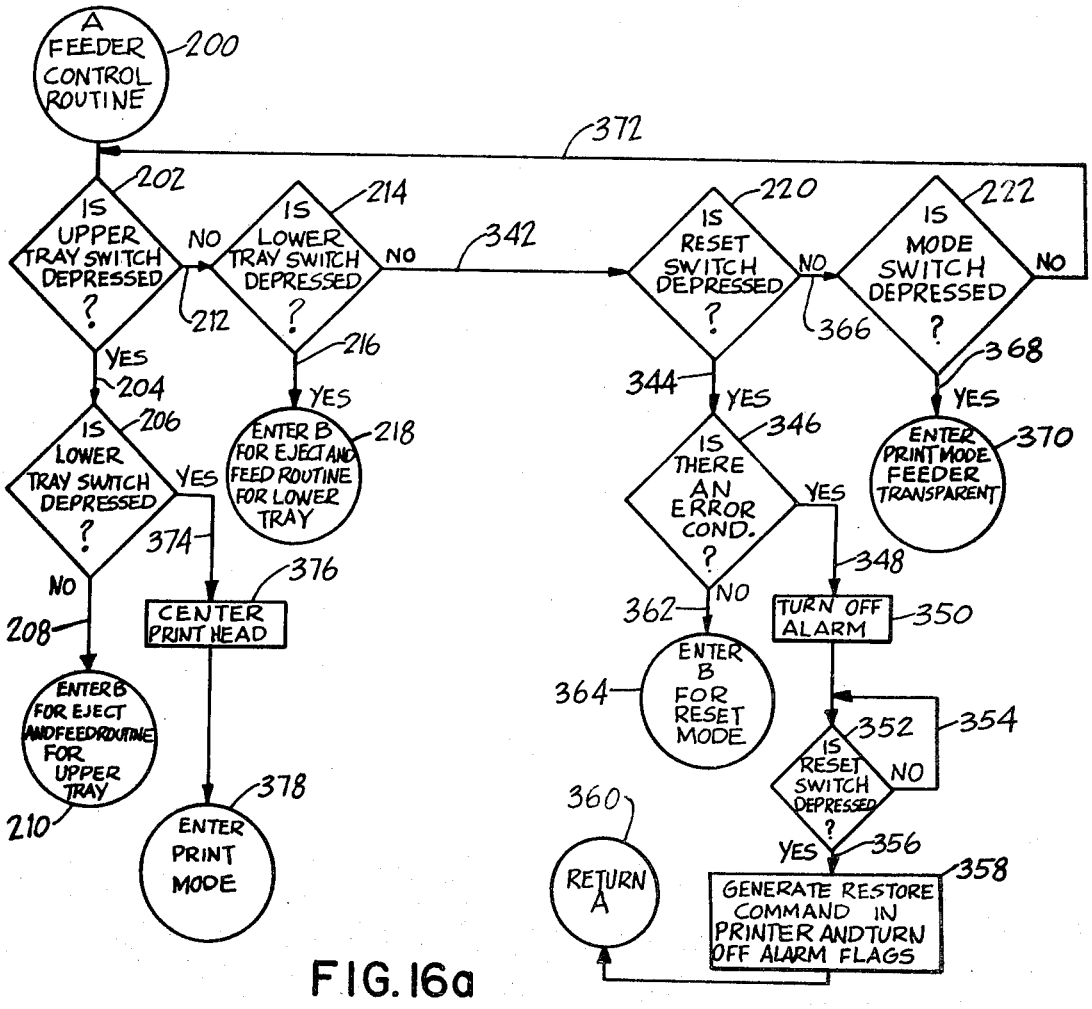
FIGS. 16*a* and 16*b* are schematic flow charts illustrating the algorithm for controlling operation of the paper feeding apparatus shown in FIG. 1.
Figure 16B:
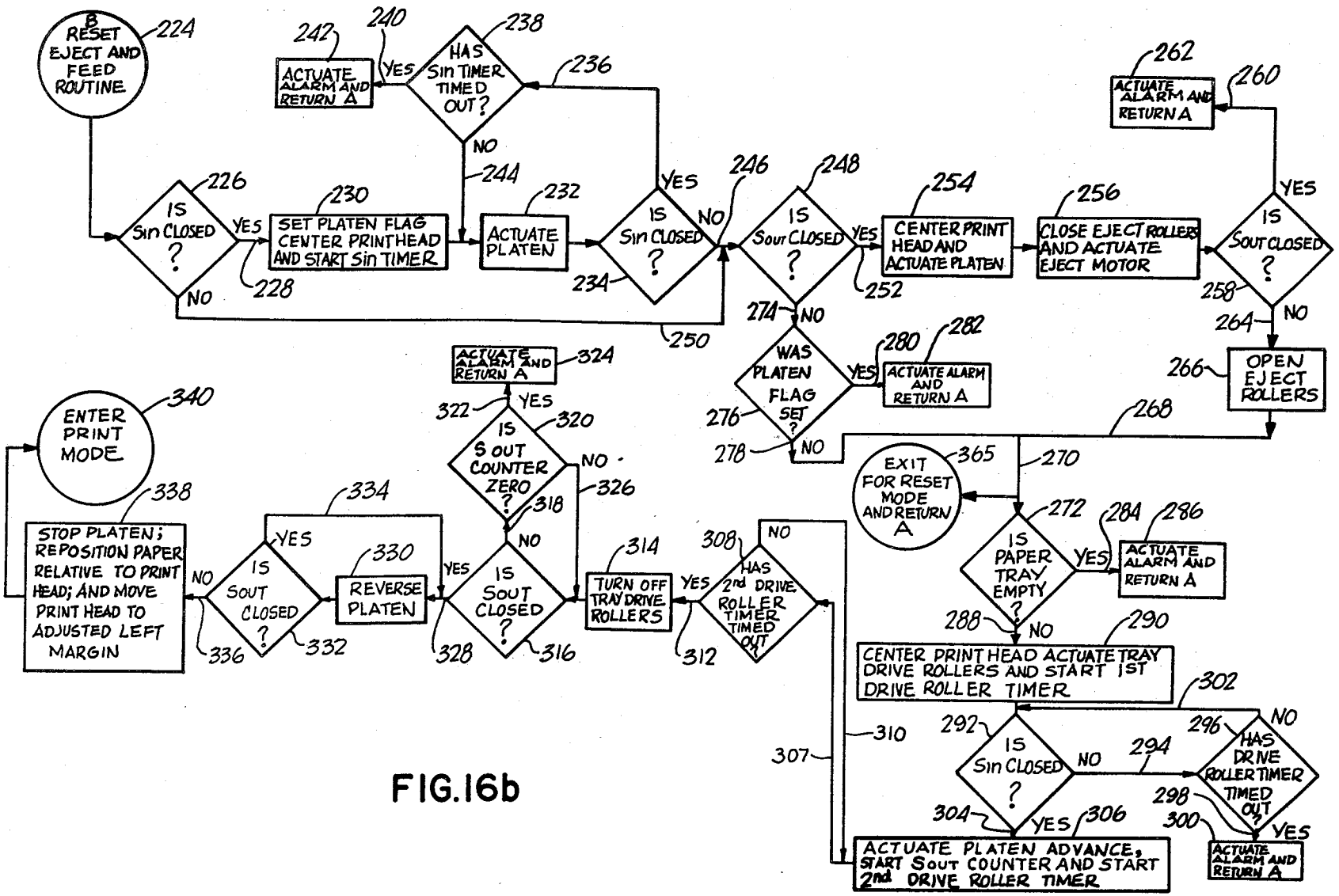

The actual processing which takes place during operation of the paper feeding apparatus 10 according to the present invention may best be appreciated upon a detailed review of the annotated program listing which may be found in the file wrapper of the application as Appendix A; however, in order to provide the reader with an overall view of the processing which takes place under program control, the flow charts set forth in FIGS. 16*a* and 16*b* are provided and will be hereinafter discussed so that the manner in which the paper feeding apparatus 10 operates and implements basic functions may be readily understood. It should be noted however, that the flow charts which are hereinafter discussed are simplified to a great degree, consistent with the usage of flow charts as relied upon by those of ordinary skill in the art, and hence, reference to Appendix A should be made for precise details of the particular program described or otherwise employed. In essence, the flow charts of FIGS. 16*a* and 16*b* illustrate the implementation of the basic algorithm for the microprocessor in the control vicinity of the paper feeding apparatus 10. The operation of the paper feeding apparatus 10, by means of operator selection through the control panel 184, will now be described with reference to FIGS. 16*a* and 16*b*.

When it is desired to print stored text onto a sheet of paper 16, the paper feeding apparatus 10 is activated to enter the Feeder Control Routine A (as indicated by the circular flag 200 and labeled "Feeder Control Routine" in FIG. 16*a*) by depressing the appropriate paper tray switch 186*b* and 186*c* for either the upper or lower paper trays 44, 46 to select the appropriate size of the paper 16 upon which printing will occur. The paper feeding apparatus 10 initially tests to ascertain which switch 186*b* or 186*c* is depressed. Assuming that only one of the tray switches 186*a* or 186*b* is depressed (the other operations depicted in FIG. 16*a* will be described later), the paper feeding apparatus 10 enters the Reset, Eject and Feed Routine B (illustrated in FIG. 16*b*, labeled as circular flag 224) for the selected tray 44, 46.

More specifically, the paper feeding apparatus 10 initially tests to determine if the upper tray switch 186*b* is depressed as indicated by the diamond 202. This is done by testing the open or closed condition of switch 186*b*. If the tray switch 186*b* is depressed, the state of the lower tray switch 186*c* is tested to determine if the lower tray switch 186*c* is also depressed, as indicated by the arrow 204 and diamond 206. (The operation of the system when both tray switches 186*b* and 186*c* are depressed together will be described hereinbelow; at the present time, it is assumed that only the upper tray switch 186*b* is depressed.) If the test of the lower tray switch 186*c* (as indicated by the diamond 206) is negative, the Reset, Eject, and Feed Routine B is entered for the upper tray 44, as indicated by the arrow 208 and the circular flag 210. If the upper tray switch 186*b* is not depressed, the lower tray switch 186*c* is then checked, as indicated by the arrow 212 and diamond 214. If the lower tray switch 186*c* is depressed, the Reset, Eject and Feed Routine B is entered for the lower paper tray 46 (as indicated by the arrow 216 and circular flag 218). If the lower tray switch 186*c* is not depressed, the paper feeding apparatus 10 then tests whether the reset switch 186*a* has been depressed, or whether the mode switch 186*d* has been depressed, as indicated by the diamonds 220 and 222. These tests and the operation effected as a result thereof will be described more fully hereinbelow. Although not shown, the depressing of the upper or lower paper tray switches 186*b* or 186*c* also sets a tray flag, which may typically comprise a flip-flop, to indicate which tray has been selected so that during the Reset, Eject and Feed Routine, paper will be fed from the appropriate paper storage tray 44, 46. Thus, it will be appreciated that the paper feeding apparatus 10 may be activated by depressing either of the switches 186*b* or 186*c* to set the appropriate flag and enter the Reset, Eject and Feed Routine for either the upper paper tray 44 or the lower paper tray 46.

As the Reset, Eject and Feed Routine is essentially the same whether the upper tray switch 186*b* is depressed or the lower tray switch 186*c* is depressed, the flow diagram of FIG. 16*b* will be described with reference to the upper tray switch 186*b* having been depressed.

When the Reset, Eject and Feed Routine B (indicated by the circular flag 224, in FIG. 16*b*) is initially entered for the paper tray 44; the paper feeding apparatus 10 automatically checks to determine if any paper 16 is left in the printing device 12. This is accomplished as indicated by the diamond 226 and is implemented by checking whether or not the paper inlet sensor $S_{in}$ is in an open or closed condition. The inlet sensor $S_{in}$ corresponds to paper movement sensor 170, and thus the determination of whether the inlet sensor $S_{in}$ is closed or open corresponds to a detection of an output from the receptor portion of the sensor 170 corresponding to the receipt of light as reflected by a sheet of paper 16 on the back of the paper movement sensor 170 (in which case the inlet sensor $S_{in}$ is closed) or whether no light is received (in which case the inlet sensor $S_{in}$ is open). If paper inlet sensor $S_{in}$ is closed, as indicated by the rectangle 230, the print head 14 and its associated guide member 15 are centered transversely with respect to the platen 18, a platen flag is set, and then a $S_{in}$ timer is started. The print head 14 and guide member 15 are centered to ensure that the sheet of paper 16 in the printer device 12 will be guided along the exit path of movement 160, as more fully described hereinbelow. The setting of the platen flag and the start of the $S_{in}$ timer are for the purpose, respectively, of indicating that the inlet sensor $S_{in}$ was initially closed (i.e., paper was initially in front of the inlet sensor $S_{in}$ (170) when a new sheet of paper was called for), and to start a timer which will serve to actuate an alarm within a predetermined time if the inlet sensor $S_{in}$ is not cleared. The platen flag may typically comprise a flip-flop and the $S_{in}$ timer may typically comprise a counter driven from the system clock or divisions thereof. After centering of the print head 14 has been initiated together with a setting of the platen flag and a starting of the $S_{in}$ timer, the platen 18 is actuated (as indicated by the rectangle 232) to drive paper 16 in the forward paper feed direction for a predetermined number of increments, corresponding for example to a distance of ½ inch per step.

The centering of the print head 14 and its associated guide member 15, as well as the advance of the platen 18 is accomplished in the preferred embodiment by utilizing the conventional printing device 12 commands as normally provided by the system to the printer. For example, this can be accomplished by generation of an appropriate signal which corresponds to the signal used by the printing device 12 for actuating the platen advance motor and the print head carriage motor. In this regard, it is to be noted that these conventional commands can be utilized since the paper feeding apparatus 10 is electrically connected and coupled with the control unit for the printing device 12.

After the platen 18 has advanced the predetermined number of increments, the paper feeding apparatus 10 again tests to determine whether the inlet sensor $S_{in}$ (170) is still closed, as indicated by the diamond 234. If the inlet sensor $S_{in}$ is still closed, the $S_{in}$ timer is then checked to determine if it has timed out, as indicated by the arrow 236 and the diamond 238. If the $S_{in}$ timer has timed out, an appropriate alarm is actuated and returns to the Feeder Control Routine A so the alarm may be deactivated (as described hereinbelow), as indicated by the arrow 240 and the rectangle 242. The alarm for example may comprise a switchable buzzer or bell and/or a light. In the preferred embodiment, this alarm comprises both a bell (not shown) and a light 188*a*. The timing period for the $S_{in}$ timer should be chosen to be sufficiently long to permit a sheet of paper 16 blocking the sensor $S_{in}$ to be cleared from the sensor $S_{in}$ by movement of the paper 16 by the platen 18. If the $S_{in}$ timer has not timed out, the platen 18 is again advanced, as indicated by the arrow 244 and rectangle 232. This operation of advancing the platen 18, checking the inlet sensor $S_{in}$ and the timer $S_{in}$ is continually repeated until the inlet sensor $S_{in}$ opens to indicate that paper 16 has been cleared from in front of the inlet sensor $S_{in}$, or the $S_{in}$ timer times out. Assuming that the inlet sensor $S_{in}$ opens before the $S_{in}$ timers times out, (as indicated by the arrow 246), the paper feeding apparatus 10 then proceeds to determine whether the outlet sensor $S_{out}$, corresponding to the paper movement sensor 172, is closed or open as indicated by the diamond 248. Similarly, if the inlet sensor $S_{in}$ is initially opened (corresponding to no paper being in front of the input sensor $S_{in}$ (170)), the outlet sensor $S_{out}$ will then be tested, as indicated by the arrows 250, 246 and diamond 248.

If the outlet sensor $S_{out}$ is closed (corresponding to the paper 16 being in front of the paper movement sensor 172) as indicated by the arrow 252, the paper feeding apparatus 10 is operated to eject paper 16 from the printing device 12. More specifically, after the outlet $S_{out}$ is sensed as being closed, the print head 14 is centered and the platen 18 is actuated a predetermined number increments to ensure that the paper 16 in the printing device 12 is free from the platen 18, as indicated by the rectangle 254. In this regard, if the print head 14 has already been centered (in the operation serving to clear the inlet sensor $S_{in}$, indicated by the rectangle 230), the signal for centering the print head 14 would not cause any additional motion. The operation of advancing the platen 18, indicated by the rectangle 254, is again accomplished by generating a signal utilizing the conventional commands for the printing device 12 to rotate the platen 18 a sufficient number of increments to move the trailing edge of the paper 16 to the exit end of the platen 18. The number of increments for example would correspond to the distance from the inlet sensor $S_{in}$ (170) to the exit from the platen 18 (since it is known that prior to this advance of the platen 18 the trailing edge of the paper 16 is clear of the inlet sensor $S_{in}$).

Next, as indicated by the rectangle 256, the ejection solenoids 142 are actuated to move the ejection rollers 128, 132 into engagement with one another, and then the ejection motor 152 actuated to drive the ejection rollers 128, 132 to pull the sheet of paper 16 out of the printing device 12 and to stack the same in the paper outlet hopper or receptacle 168. The ejection motor 152 typically may comprise a stepping motor which is actuated for a specified number of steps and is then turned off. The number of steps should be sufficient to move the trailing edge of the sheet of paper 16 through the ejection rollers 128, 132. This would correspond to moving the paper 16 a distance at least as great as the distance from the exit of the platen 18 to the ejection rollers 128, 132, as the platen 18 was previously advanced (as indicated by the rectangle 254) to move the trailing edge of the paper 16 to the exit for the platen 18. After the ejection motor 152 is actuated, the outlet sensor $S_{out}$ (172) is again tested as indicated by the diamond 258. If the outlet sensor $S_{out}$ is closed, an alarm is sounded and the light 188*a* is lit, as indicated by the arrow 260 and rectangle 262, and then returns to the Feeder Control Routine A (200). This condition would correspond to a paper jam since actuation of the ejection motor 152 for the predetermined number of steps should have cleared the outlet sensor $S_{out}$.

If the output sensor $S_{out}$ is open, the ejection solenoids 142 are deactivated to open the space between the ejection rollers 128, 132, as indicated by the arrow 264 and rectangle 266. After this operation, the paper feeding apparatus 10 proceeds to the line 268 to eventually check whether the upper paper tray 44 is empty (since the upper paper tray 44 was initially selected from which to feed paper 16), as indicated by the arrow 270 and diamond 272.

Alternatively, if the outlet sensor $S_{out}$ was opened when it was initially tested, as indicated by the diamond 248 (i.e., no paper 16 was in front of the sensor 172), the paper feeding apparatus 10 will test whether the platen flag was set, as indicated by the arrow 274 and diamond 276. This test serves to determine whether the inlet sensor $S_{in}$ was initially closed or opened when the Reset, Eject and Feed Routine B was entered. If the platen flag was not set (corresponding to the condition of the inlet sensor $S_{in}$ having been initially open) the paper feeding apparatus 10 proceeds, as indicated by the arrow 278, to the line 268 to subsequently test whether the upper paper tray 44 is empty, as indicated by the arrow 270 and diamond 272. On the other hand, if the platen flag was set (indicating that paper 16 was in front of the inlet sensor $S_{in}$ initially), an alarm is sounded and the light 186*a* lit, as indicated by the arrow 280 and rectangle 282, and returns to the Feeder Control Routine A (200). Here it should be noted that the test of whether the platen flag was set (at the diamond 276) would only be made if the outlet sensor $S_{out}$ were initially open when tested at the diamond 248. Thus, it will be appreciated that an alarm would be actuated only if the inlet sensor $S_{in}$ were initially closed and, after $S_{in}$ is opened, the outlet sensor $S_{out}$ is initially open. This would indicate that the paper initially blocking the inlet sensor $S_{in}$ jammed in the printer 12 before reaching the outlet sensor $S_{out}$. Conversely, if the inlet sensor $S_{in}$ was initially open (i.e., no paper 16 in the paper feed path 100) the paper feeding apparatus 10 would proceed along arrow 250 to test the condition of the outlet sensor $S_{out}$ and the platen flag would not be set. If the outlet sensor $S_{out}$ is also open initially (indicating that no paper is in the exit path 160), the test for the platen flag, at the diamond 276 would be negative, as indicated by the arrow 278, and the paper feeding apparatus 10 would proceed to test the upper paper tray 44 for paper, as indicated by the line 268, the arrow 270 and the diamond 272.

If the paper feeding apparatus 10 has not jammed and the printer 12 is clear of paper, the paper feeding apparatus 10 proceeds to test whether the selected paper tray (i.e., the upper tray 44 in this example) is empty, as indicated by the diamond 272. In this determination, if the selected paper tray 44 is empty, an appropriate alarm is actuated, as indicated by the arrow 284 and the rectangle 286, and the paper feeding apparatus 10 returns to the Routine A (200). In the preferred embodiment this alarm comprises lighting the paper tray empty light 188*b* and sounding a bell or buzzer to alert the operator. If the paper tray 44 is not empty, as indicated by the arrow 288, the paper feeding apparatus 10 then generates a signal to center the print head 14 transversely with respect to the platen 18, again by utilizing the conventional commands for the printing device 12 for movement of the print head carriage, as indicated by the rectangle 290. If the print head 14 has already been centered (as in the ejecting part of the routine B as indicated by the rectangle 230 or the rectangle 254), this signal will simply be ignored. Also, at this time, as indicated by the rectangle 290, the appropriate tray drive rollers 72 are activated by actuation of the associated drive motor 80 to feed a single sheet of paper 16 from the paper tray 44 forward along the paper inlet path 108 into the main paper feed path 100. When the associated drive motor 80 is actuated, a first drive roller interval timer is also started, as indicated by the rectangle 290. This timer may be similar to the $S_{in}$ timer and performs a similar function with respect to the time of operation of the tray drive rollers 72. As the sheet of paper 16 is fed from the paper tray 44 along the paper inlet path 108 into the main paper feed path 100, the leading edge of the paper 16 strikes the deflector plate 96 and is directed downwardly along the main paper feed path 100. The paper travels in a relatively straight line path towards the platen 18 and past the paper input sensor 170 (see also FIG. 9).

The next operation is to test the inlet sensor $S_{in}$ (170) to determine if it is closed. If the paper inlet sensor $S_{in}$ (170) does not close within a predetermined time after actuation of the tray drive motor 80, a fault alarm is sounded and the fault light 188*a* is lit on the paper feeding apparatus 10, to indicate that the paper 16 has not been fed from the paper tray 44, or that the paper 16 has jammed in the inlet feed path 108 or in the main paper feed path 100. This is accomplished by testing the inlet sensor $S_{in}$ to determine whether or not it is closed, as indicated by the diamond 292. If the inlet sensor $S_{in}$ is not closed, a test is made as to whether the first drive roller timer has timed out, as indicated by the arrow 294 and diamond 296. If the first drive roller timer has timed out, the alarms are actuated, as indicated by the arrow 298 and rectangle 300, and the paper feeding apparatus 10 returns to the Routine A (200). If the first drive roller timer has not timed out, the paper feeding apparatus 10 again tests the inlet sensor $S_{in}$ to determine whether it is closed, as indicated by the arrow 302 and the diamond 292. This loop is continued until either the inlet sensor $S_{in}$ is closed or the first drive roller timer has timed out. The interval or timing period for the first drive roller timer is chosen to allow a sufficient time for paper 16 to be fed from the tray 44 past the inlet sensor $S_{in}$ (170) if the paper has not jammed.

If the inlet sensor $S_{in}$ (170) closes within the predetermined period of time alotted by the first drive roller timer, the the platen drive motor is actuated to begin driving the platen 18 for receipt of the sheet of paper 16 being fed along the main paper feed path 100, as indicated by the arrow 304 and the rectangle 306. This actuation of the platen 18 takes place a predetermined time after the leading edge of the sheet of paper 16 being fed passes the paper inlet sensor 170. In this regard, it should be noted that the platen 18 is driven at a slower rate of speed than the speed at which the paper 16 is fed by the tray drive motor 80 to ensure a positive feeding of the sheet of paper 16 into the platen 18. Also, when the platen 18 is actuated, an outlet sensor counter ($S_{out}$ counter) and a second drive roller time are started, as indicated by the rectangle 306. The $S_{out}$ counter is decremented each time the platen 18 is advanced and should be set at an initial state corresponding to the number of discrete steps of the platen 18 with which the outlet sensor $S_{out}$ should close if the paper 16 is being properly moved by the platen 18. The second drive roller timer is similar to the $S_{in}$, and first drive roller timers, and serves to define a predetermined period of time after which the drive rollers 72 should be turned off. This timing interval should provide a sufficient time or number of steps to permit the leading edges of the paper 16 to advance from the inlet sensor $S_{in}$ into the inlet 106 for the platen 18.

Next, the paper feeding apparatus 10 determines whether the second drive roller timer has timed out, as indicated by the diamond 308. This test is continually repeated, as indicated by the arrow 310, until the second drive roller timer has timed out. When the second drive roller timer has timed out, as indicated by the arrow 312, the tray drive rollers 72 are turned off, as indicated by the rectangle 314. When the tray drive rollers 72 have been turned off, the paper 16 will be advanced solely by means of the platen 18. In this regard, it will be noted that the drive rollers 72 are provided with a roller clutch so that the drive rollers 72 may freely rotate in the counterclockwise direction relative to the drive shaft 70, as viewed in FIGS. 8–15.

Once the paper 16 is fed into the platen 18, it will be advanced around the platen 18 to move past the print head 14 and associated guide member 15 of the printing device 12 and be directed along the paper exit path 160. In this regard, it will be recalled that the print head 14 and associated guide member 15 thereon were previously centered with respect to the transverse center of the platen 18 (see rectangles 230, 254, 290), and thus with respect to the longitudinal center line of the paper 16 being advanced. The paper guide member 15 serves to deflect a sheet of paper 16 being advanced therepast directly into alignment with the paper exit path 160 between the lower plate portion 156 of the cover 154 and the lower front surface 120 as the exit guide plate member 118. The paper guide member 15 is a conventional element of typewriters and printers, and has a transverse width which normally serves to deflect the paper being fed therepast in the rearward direction on the platen 18 so that the paper will not fall back over the print head 14. The alignment of the print head 14 and guide member 15 in the center of the platen 18 is preferably accomplished before the tray drive rollers 72 are actuated (see rectangle 290), although it may be accomplished any time prior to a sheet of paper 16 being received by the platen 18.

Thus, it will be appreciated that in this manner, the guide member 15 and the printing head 14 are employed as a deflection member to ensure proper feeding of the paper 16 along the desired exit path 160. More specifically, the centering of the guide member 15 with respect to the platen 18 serves to properly direct and guide the paper 16 along the exit paper path 160, which might not otherwise be the case if the print head 14 and paper guide member 15 were located at one of the margins of the paper 16 or if no guide member 15 were provided.

Figure 10:
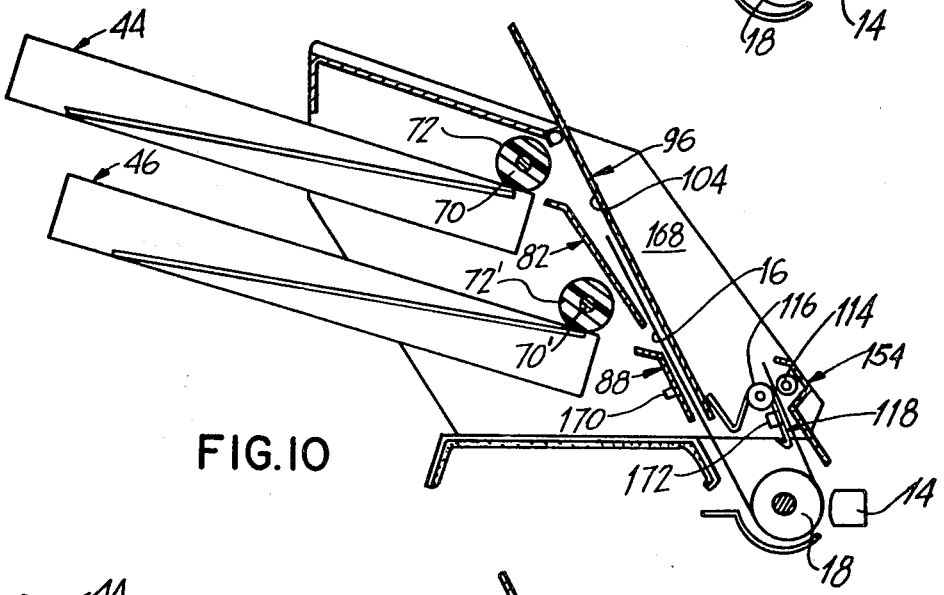
FIG. 10 is a schematic side elevational view, similar to that shown in FIG. 9, illustrating a sheet of paper being moved by the platen of the printing device with the leading edge thereof being positioned in front of the outlet sensor in the exit path of movement for the paper.
Figure 11:
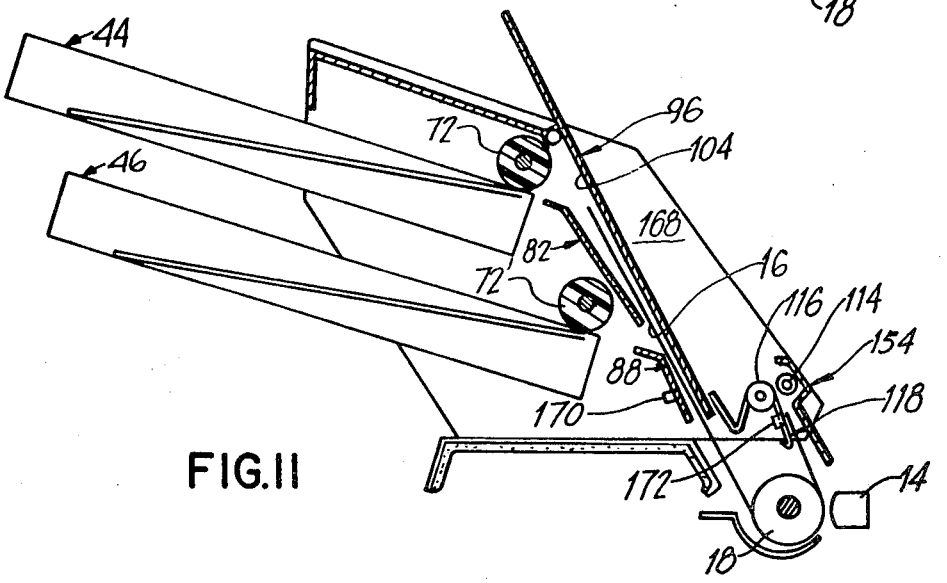
FIG. 11 is a schematic side elevational view, similar to that shown in FIG. 9, illustrating a sheet of paper positioned relative to the paper platen with the leading edge aligned with the outlet sensor in the paper exit path of movement.
Figure 12:
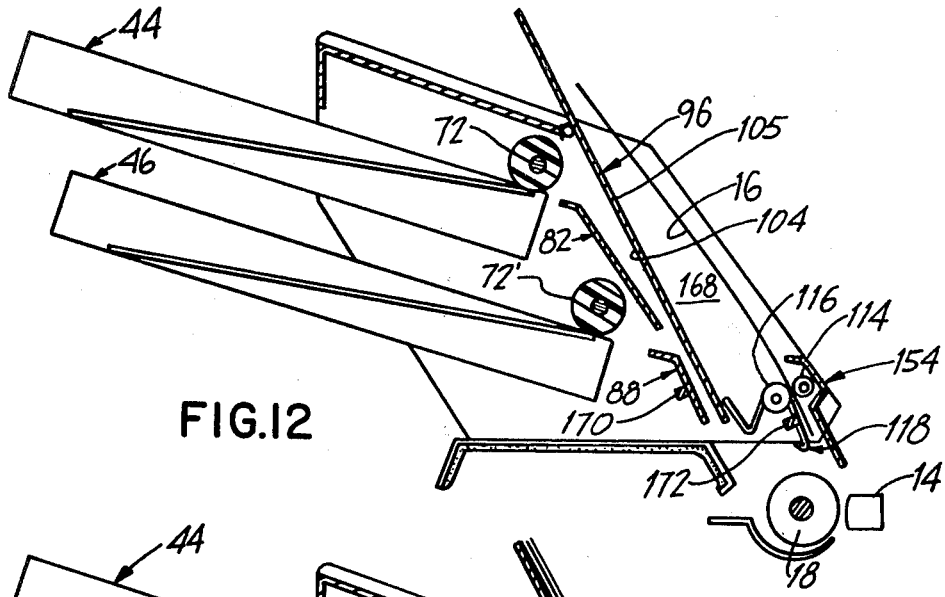
FIG. 12 is a schematic side elevational view, similar to that shown in FIG. 9, illustrating a sheet of paper being ejected from the printing device by the paper feeding apparatus shown in FIG. 1.
Figure 13:
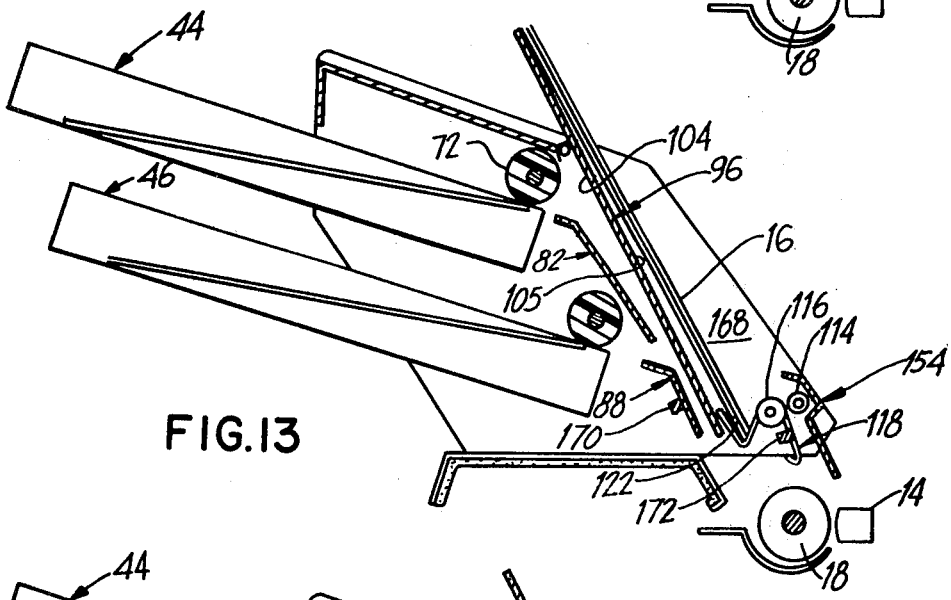
FIG. 13 is a schematic side elevational view, similar to that shown in FIG. 9, illustrating sheets of paper stacked on the stacker/deflector plate of the paper feeding apparatus shown in FIG. 1.
Figure 14:
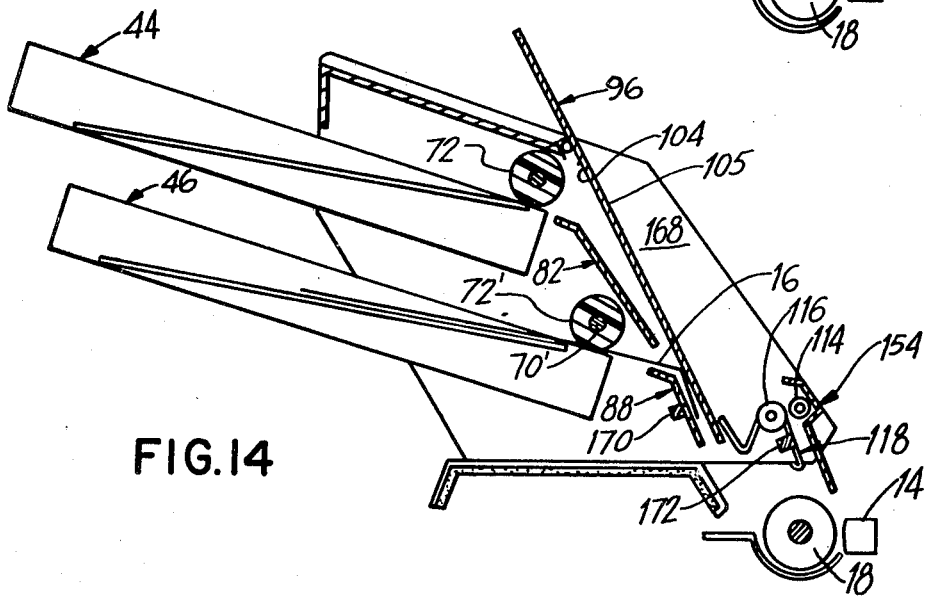
FIG. 14 is a schematic side elevational view, similar to that shown in FIG. 9, illustrating a sheet of paper being fed from the lower paper tray.
Figure 15:
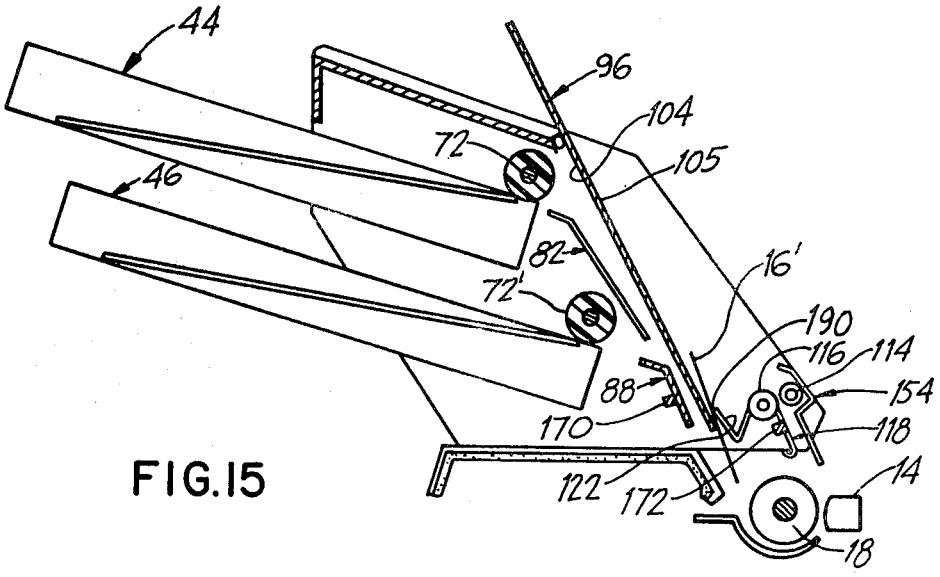
FIG. 15 is a schematic side elevational view, similar to that shown in FIG. 9, illustrating an envelope being manually fed through a manual input slot of the paper feeding apparatus shown in FIG. 1.

The platen 18 is continued to be driven to advance the leading edge of the paper 16 in the exit path 160 and past the paper outlet sensor 172 (see FIG. 10). In this regard, it is to be noted that the platen 18 is driven by using conventional commands of the printing device 12 for advancing the platen 18. Thus, in terms of an impact printing device 12 which incrementally advances paper, a sheet of paper 16 is advanced incrementally during this feeding operation by simply directing the printing device 12 to advance the platen 18 a specified number of increments. In the preferred embodiment, the platen 18 is advanced to move the paper 16 in ½ inch steps. For example, if each platen increment corresponds to 1/48 inch of movement of the paper 16, the platen 18 would be advanced 24 increments at a time in this operation.

After a predetermined number of increments of platen rotation (corresponding to the distance from the inlet 106 to the platen 18 to the outlet sensor 172), the paper 16 should be moved past the paper outlet sensor 172. If the outlet sensor 172 does not close within a predetermined number of increments of the platen rotation (corresponding to the initial state of the $S_{out}$ counter), an alarm and fault signal 188*a* are generated to alert the operator to a possible paper jam. This is accomplished by testing of the outlet sensor $S_{out}$, as indicated by the diamond 316, after the tray drive rollers 72 have been turned off. If the outlet sensor $S_{out}$ has not closed, a test is made as to whether the $S_{out}$ counter is zero, as indicated by the arrow 318 and the diamond 320. If the $S_{out}$ counter is zero, an alarm is actuated as indicated by the arrow 322 and the rectangle 324, and the paper feeding apparatus 10 returns to the Routine A (200). In the preferred embodiment, the actuation of this alarm comprises sounding an alarm and lighting the light 188*a*. If the $S_{out}$ counter is not zero, the outlet sensor $S_{out}$ is again tested to determine whether it has closed, as indicated by the arrow 326 and diamond 316. This loop is continued until either the $S_{out}$ counter is zero, in which event an alarm is actuated, or until $S_{out}$ has closed.

Once the paper outlet sensor $S_{out}$ (172) detects or senses the leading edge of the paper 16, the platen 18 is controlled to move in the reverse direction to move the leading edge of the sheet 16 slowly back until the paper outlet sensor 172 opens. At this moment, the movement of the platen 18 is stopped (see FIG. 11), with the leading edge of the paper 16 being aligned with the paper outlet sensor $S_{out}$ (172). This provides a fixed or known reference point for the purposes of aligning the sheet of paper 16 relative to the print head 14 for the beginning of printing. Specifically, by knowing the distance of the paper sensor 172 from the print head 14, and the distance the paper moves for each increment of the platen 18 advance or reverse, conventional printing commands can cause the paper 16 to be moved to the proper print position for the first line of print by advancing or reversing the platen 18 the required number of increments. For example, if the paper movement sensor 172 is located three inches from the print head 14 and a one inch margin is desired at the top edge of the paper, the platen 18 can be reversed to move the paper 16 two inches in the reverse direction. This operation of moving the platen 18 forward to move the leading edge of a sheet of paper 16 past the sensor 172, and then reversing the platen 18 movement is made in order to be able to move the platen 18 forward in relatively large increments (for example ½ inch steps) to achieve a relative fast speed of operation to align the paper 16.

More particularly, this operation for aligning the paper 16 for the start of printing is accomplished by reversing the platen 18 once the outlet sensor $S_{out}$ (172) closes, as indicated by the arrow 238 and rectangle 320. The platen 18 is then reversed slowly, for example in one step increments, and the outlet sensor $S_{out}$ is again sensed to determine whether it is still closed, as indicated by the diamond 322. If the outlet sensor $S_{out}$ remains closed, the platen 18 is again reversed one step, as indicated by the arrow 334 and rectangle 330. This operation is continued until the outlet sensor $S_{out}$ opens. At that moment, the platen 18 is stopped and the paper is then repositioned relative to the print head 14 by movement of the platen 18, as indicated by the arrow 336 and rectangle 338. Finally, the print head 14 is moved to the adjusted left margin of the paper 16, as indicated by the rectangle 338.

In this regard, since the paper 16 is not aligned with the left hand end or zero position of the printing device 12 when it is fed thereinto, but rather is inserted so that the center of the paper 16 is aligned with the center of the printing device 12 (i.e., since the paper 16 was fed with the longitudinal central portion being aligned with the longitudinal centerline of the paper feed path 100 and the center of the platen 18), margin adjust information is received or programmed in the paper feeding apparatus 10 to adjust the margin control information in the printing device 12 to provide the desired margins for printing. More specifically, before any printing operation is undertaken, the printing device 12 generally will generate a restore command which moves the print head 14 to the left hand end or zero position of the platen 18. The host program or processor for the prestored text contains appropriate margin information or commands for adjusting the print head 14 to provide a desired margin for the matter to be printed. This generally involves a command to move the print head 14 a specified distance from the left end or zero position of the platen 18 which would provide the desired margins on the printed sheet of paper if the paper 16 were aligned with the left hand end of the platen 18. Since the sheet of paper 16 is centrally fed by the paper feeding apparatus 10 in the present invention, by which it is known that the left hand edge of the sheet of paper is displaced a specified distance in from the left hand end of the platen 18, the margin adjust information simply adds a constant distance (corresponding to this known displacement of the left hand edge of the paper 16 from the left hand end of the platen 18) to the margin information in the host program or processor for the prestored text of material to be printed. For example, if the material to be printed is to have a one inch margin along the left hand edge of the paper 16, and if the left hand edge of the paper is displaced three inches from the left hand end or zero position of the platen 18, the margin information in the printing device 12 (which would normally generate command to displace the print head 14 one inch in from the left or zero position of the platen 18) would be adjusted to displace the print head four inches (one inch margin and three inches because the paper 16 is centered on the platen 18) in from the left or zero position of the platen 18. This margin adjust information can be preprogrammed into microprocessor for the paper feeding apparatus 10 for each of the different paper trays 44, 46 if standard paper trays are used.

After the paper 16 has been moved to the proper print position for the beginning of printing and the print head 14 has been moved to the adjusted left margin of the paper, as indicated by the rectangle 338, the print mode is then entered, as indicated by the circular flag 340, and the printing device 12 proceeds in accordance with its program to print the material on the sheet of paper 16.

When the printing has been completed on the sheet of paper 16, the printing device 12 is stopped, such as for example by appropriate stop codes in the printing device 12. The paper feeding apparatus 10 will then automatically eject the paper 16 when the next sheet of paper is called for by the operator depressing one of the paper tray control switches 186*b* or 186*c* in which event the Reset, Eject and Feed Routine B will again be entered, as indicated by either of the circular flags 210, 218 in the flow chart of FIG. 16*a*. At this time, the sheet of paper 16 will be ejected from the printing device 12 (see FIG. 12) and stored in the output hopper or receptacle 168 (see FIG. 13).

It will be appreciated that during the printing operations, the trailing edge of the paper 16, which in some instances may be in the proper feed path 100, is free to move back and forth along this path 100 without interference from the paper storing trays 44, 46 or drive rollers 72, 72′ which are located transversely in the paper inlet feed paths 108, 110. This is a most important feature, since in impact type printing operations, the paper 16 must be capable of being moved back and forth by the platen 18 for the printing of subscripts, superscripts, charts or other special operations. Also, with the paper feeding apparatus 10, the paper is moved backwards to align the leading edge with the paper outlet sensor 172 and then further to set the desired top margin. More particularly, as can be seen from FIGS. 8–11, the paper 16, once it is released from the paper trays 44, 46, and drive rollers 72, 72′ may be freely moved along the paper feed path 100 past the ends 108*b*, 110*b*, of the inlet feed paths 108, 110 for the upper and lower paper trays 44, 46.

The paper feeding apparatus 10 is also capable of being used in conjunction with a stored text or material which includes appropriate codes for automatically feeding the paper 16 from the upper or lower trays 44, 46 and which are coded to indicate the end of a page of text or material to be printed. In this instance, the text or material is stored on the disk or other recording device may be modified to include automatic feed and eject operation codes which would thus serve to allow the printing of a plurality of pages of text automatically with the user only having to initially turn on the device. In this operation, the paper feeding apparatus 10 would automatically eject the paper 16 into the output receptacle 168 and feed a new sheet 16 into the printer 12 without any additional operation to be performed by the user. For example, such codes may include a code or command for indicating the proper paper tray 44, 46 to be used, such as an upper tray code or command, and a lower tray code or command, as well as an eject paper code command for ejecting paper when the print head 14 has completed printing on the sheet of paper 16. The eject code, depending on the type of word processing unit and printer 12 with which it is used, may include an eject code for the right hand margin of the printed matter when printing is always from the left to the right, or may include both left margin and right margin eject codes for use with a bi-directional printing technique where the print head 14 moves from the left to the right for one line of print, and, for the next or subsequent line, moves from the right to the left relative to the platen 18. In this type of automatic operation, when the print command is given, the paper feeder apparatus 10 will feed a paper from one of the two trays 44, 46, which command is programmed as the first text line of the page, with all subsequent paper feedings being from the selected tray or, if the opposite tray is selected, from the opposite tray, in which case all subsequent paper feedings will be from that tray. At the completion of each page of print, by properly programming appropriate eject codes into the text of the material, the system will automatically eject the paper 16 and feed a new sheet of paper 16 into proper printing position in the manner as described above.

In this regard, the codes appearing in the text of the material in essence serve to generate signals which are similar to the signals generated by either the upper or lower tray switches 186*b* or 186*c* being depressed (i.e., signals corresponding to the arrows 208 or 216) and the eject codes or commands are equivalent to generating a signal similar to the reset switch being depressed (to be described hereinbelow), so that the paper feeding apparatus will enter the Reset, Eject and Feed Routines and operate in the same manner as described above, as if the operator had selected one of the tray switches.

Of course, it should be appreciated that this is only one way of automatically feeding, printing and ejecting paper, and that there are numerous other ways that such operations could be performed, as will be appreciated by those skilled in the art.

During operation of the paper feeding apparatus 10, the upper and lower tray switches **186*b* and 186*c* (if they have been depressed), are cleared (such as for example by providing spring biased switches normally biasing the switches 186*b* and 186*c* to an undepressed state). Thus, upon return to the Feeder Control Routine A (200), the paper feeding apparatus 10 may again sense whether any switches have been depressed. This is a continuous routine, as indicated by the return arrow 372**, until and if further switches are depressed.

If an alarm has been actuated during the Reset, Eject and Feed Routine B, the alarm may be turned off by depressing the Reset Switch **186*a*. This is accomplished by returning to the Feeder Control Routine 200 and testing the condition of the Reset Switch 186*a*. More specifically, as noted above in the description of the Reset, Eject and Feed Routine B, after any alarm is actuated, the paper feeding apparatus 10 returns to A, the Feeder Control Routine 200. Since the upper and lower tray switches 186*b*, 186*c* have previously been cleared (and thus the tests of these switches, indicated by the diamonds 202, 214, are negative, as indicated by the arrows 212, 342), the paper feeding apparatus 10 will proceed to test whether the reset switch 186*a* is depressed, as indicated by the diamond 220. If the reset switch 186*a* is depressed, the paper feeding apparatus 10 will proceed to test whether an error condition exists, as indicated by the arrow 344 and diamond 346. This error condition would correspond to one of the alarms being actuated, and could typically be indicated by setting of an alarm flag whenever an alarm is actuated and testing whether an alarm flag has been set. If an error condition does exist, the alarm is turned off (in particular the sound alarm), as indicated by the arrow 348 and the rectangle 350. Then, the reset switch 186*a* is again tested, as indicated by the diamond 352. If the reset switch 186*a* has been depressed again, a restore command is generated for the printing device 12, as indicated by the arrow 356 and rectangle 358. It should be noted here that the reset switch 186*a*, when an alarm is actuated, is simply pressed once and released to turn off the alarm. It is thereafter pushed a second time to generate the reset command and clear any alarm flags. The paper feeding apparatus 10 then returns to the Feeder Control Routine A, as indicated by the circular flag 360. If the reset switch 186*a* has not been depressed, the paper feeder simply returns to check the reset switch 186*a* until it is depressed again, as indicated by the arrow 354 and the diamond 352. Once an error condition has been detected, the reset switch 186*a*** must be depressed a second time before any printing or further feeding operations are continued.

The reset switch **186*a* may also be utilized to eject paper 16 from the printing device 12. More specifically, if the test of the reset switch 186*a*, as indicated by the diamond 220, is positive, and there is no error condition, the paper feeding apparatus 10 will enter the Reset, Eject and Feed Routine B for the reset mode, as indicated by the arrow 362 and the circular flag 364. Also, similar to the situation where the upper or lower tray switches 186*b*, 186*c*** are depressed, a reset flag will be set before the Reset, Eject and Feed Routine B is entered so that the Reset, Eject and Feed Routine B may be exited at the appropriate time.

When the Reset, Eject and Feed Routine B 224 is entered for the reset mode, the same set of operations as were initially performed upon depressing of the upper or lower tray switches **186*b* or 186*c* are performed to clear the printing device 12 of any paper 16 which may be therein. The only difference is that once the inlet and outlet sensors $S_{in}$ and $S_{out}$ are both cleared or opened, as indicated by the arrow 274 or 264 (assuming no jam which would cause actuation of an alarm indicated by the rectangle 282), the paper feeding apparatus 10 exits from the reset mode and returns to the paper feeding routine A, as indicated by the line 268, the arrow 270 and the circular flag 365, prior to determining whether paper is in any tray 44, 46**.

A further feature of the paper feeding apparatus 10 of the present invention is the provision that individual sheets of paper 16 may be inserted into the printer platen 18 without removal of the paper feeding apparatus 10 from the printer 12. This is accomplished by moving or depressing the mode switch **186*d* to manual operation which will leave the paper feeding apparatus 10 electrically connected to the printing device 12 but transparent to the system (i.e., the paper feeding apparatus 10 appears not to be connected to the system). The paper feeding apparatus 10 may then be tilted upwardly to its raised position (see FIG. 3) by depressing of the locking switch 42 to thereby provide access to the printer platen 18 without interference from the paper feeding apparatus 10. The paper feeding apparatus 10 may either be supported on the printer 12 in the raised position or can be removed from the printer 12. In this manual mode of operation, the printer device 12 would operate as if the paper feeding apparatus 10 did not exist so that the user may simply insert the sheet of paper 16 into the platen 18** and manually align same.

In terms of the flow diagram of FIG. **16*a*, the mode switch 186*d* is tested during the Feeder Control Routine (200) as indicated by the diamond 222. If the mode switch 186*d* is depressed, the print mode of the printing device 12 is entered as indicated by the arrow 368 and the circular flag 370. if the mode switch 186*d* is not depressed, as indicated by the arrow 372, the Feeder Control Routine 200 proceeds with testing of the other switches 186*b*, 186*c*, 186*a* on the control panel 184, as indicated by the diamonds 202, 214, 220**.

A still further feature of the paper feeder apparatus 10 of the present invention is the provision for envelope or single sheet feeding without having to remove the paper feeding apparatus 10 from the printer 12. In this mode of operation, envelopes or other non-standard sheets of paper 16' can be fed manually through the paper feeding apparatus 10 to the printer platen 18. In this instance, a special input slot 190 in the output hopper or receptacle 168 of the paper feeding apparatus 10 is provided. More particularly, as best seen in FIGS. 8–15, the V-shaped surface 122 of the exit guide plate member 118 is spaced from the deflector plate 96, thus defining the input slot 190 which communicates with the paper feed path 100 to the platen 18 at a position in the paper inlet feed path 100 below the lower paper tray 46. The envelope or other non-standard size of paper 16' can thus be fed directly into the paper receiving inlet 106 for the paper platen 18.

To utilize this feature, all the paper 16 in the output hopper 168 must be removed and the reset switch 186*a* pushed to eject any paper 16 which may be in the printer 12 and paper feed and exit paths 100, 160, and to move the print wheel 14 to the left most printing position. Then, the upper and lower paper tray switches 186*b*, 186*c* are depressed simultaneously which will position the print wheel or print head 14 in the center of the printer 12 and place the paper feeding apparatus 10 in the envelope/single sheet mode. The envelope or sheet of paper 16' is then placed in the input slot 190 therefor and the paper 16' is positioned or aligned with the printer device 12 by manual operation of the platen knob. The paper 16' is now in position for printing the page directly with the use of the word processing printing commands.

In terms of the Feeder Control Routine shown in FIG. 16*a*, the paper feeder apparatus 10 tests whether both of the upper and lower tray switches 186*b*, 186*c* have been depressed together. This is accomplished with the test of whether the upper tray switch 186*b* is depressed as indicated by the diamond 202, previously described.

As noted above, if the upper paper switch 186*b* is depressed, the state of the lower tray switch 186*c* is then tested, as indicated by the arrow 204 and the diamond 206. (As noted above, if the test is negative, as indicated by the arrow 208, the paper feeding apparatus 10 enters the Reset, Eject and Feed Routine B for the upper paper tray 44.) If the lower tray switch 186*c* is also depressed, the print head 14 is centered, as indicated by the arrow 374 and the rectangle 376, and the print mode is entered, as indicated by the circular flag 378, and printing may be commenced. In the preferred embodiment, when the system has been placed in the envelope mode, depression of either of the upper or lower switches 186*b*, 186*c* will feed a sheet of paper 16 from the selected paper tray 44, 46 with the system still remaining in the envelope mode.

The electrical connections of the paper feeding apparatus 10 are made with the control circuitry or unit for the printing device 12 which for example may include a microprocessor for processing the data stream from the word processing system, or the host processor of the data processing system controlling the printing device 12. In this regard, the electrical circuitry or connection 182 of the paper feeder apparatus 10 serves to interrupt receipt of information respecting the text when a new sheet of paper 16 is to be fed into the printing device 12 to allow the paper feeder apparatus 10 to feed and align a sheet of paper 16 in the printing device 12. In this instance, the paper feeding apparatus 10 generates a command to the host processor to delay feeding of the information respecting the text to be printed as well as other commands to permit the paper 16 to be fed into the device 12 and aligned. Once the feeding of the paper 16 into the device 12 has been accomplished and is aligned for the beginning of printing, the conventional control unit of the printing device 12 takes over and the page is printed on. It will be appreciated that one of the features of simplicity of the present invention, and which is particularly adapted for retrofitting of the paper feeding apparatus 10 on existing printing devices 12, is the fact that the paper feeding apparatus 10 uses the conventional codes or commands for positioning of the printing head 14 and advancing and reversing of the platen 18.

The Embodiment of FIGS. 17–29

FIGS. 17–29 illustrate another embodiment of the paper feeding apparatus and manner of operation thereof in accordance with the present invention. As much of the structure and operation of the paper feeding apparatus 400 is the same as the structure and operation of the paper feeding apparatus 10 of FIGS. 1–16, the same reference characters will be used hereinbelow to designate the same or similar components to the extent possible, in some instances with the addition of a prime (') to indicate that the component has been modified slightly.

As with the first embodiment, the paper feeding apparatus 400 is adapted to be mounted on a printing device 12 for operation in conjunction therewith. The printing device 12 is similar to that disclosed hereinabove with reference to the embodiment of the paper feeding apparatus 10 of FIGS. 1–16, and generally includes printing means 14, e.g., a movable print head for printing on a sheet of paper 16 and paper drive means 18, e.g., the rotatable transversely extending platen for providing relative movement between a sheet of paper, generally designated 16, and the print head 14 to effect printing on the sheet of paper 16. The printing device 12 preferably has automatic printing or typing capabilities, and the paper feeding apparatus 400 is adapted for connection to the printing device 12 so as to use the standard commands generated therein for movement of the print head 14 and advancement of the sheets of paper 16 so that the paper feeding apparatus 400 may advantageously be adapted to be retrofitted with the automatic printing device 12. As with the first embodiment, the paper feeding apparatus 400 may be utilized for example with the Lanier Business Products Word Processing unit sold under the tradename "No Problems" which includes suitable control means for effecting an automatic printing of an entire page of type or print on a sheet of paper 16 automatically and which includes paper advance instructions (i.e., an instruction to rotate the platen 18) and other suitable controls for controlling the margins of the matter to be printed with respect to the paper 16.

The paper feeding apparatus 400 in conjunction with the printing device 12 is generally operable to feed sheets of paper 16 to the printing device 12, and in particular the platen 18 thereof, and to control the platen or paper drive means 18 to move the paper fed thereto to an appropriate position for printing to begin on the sheet of paper 16. Also, after printing has been completed, the paper feeding apparatus 400 is preferably operable to remove or eject the sheet of paper 16 from the printing device 12 to store or stack same in the paper feeding apparatus 400, and to then feed another sheet of paper 16 and move same into position for the beginning of printing thereon.

Figure 17:
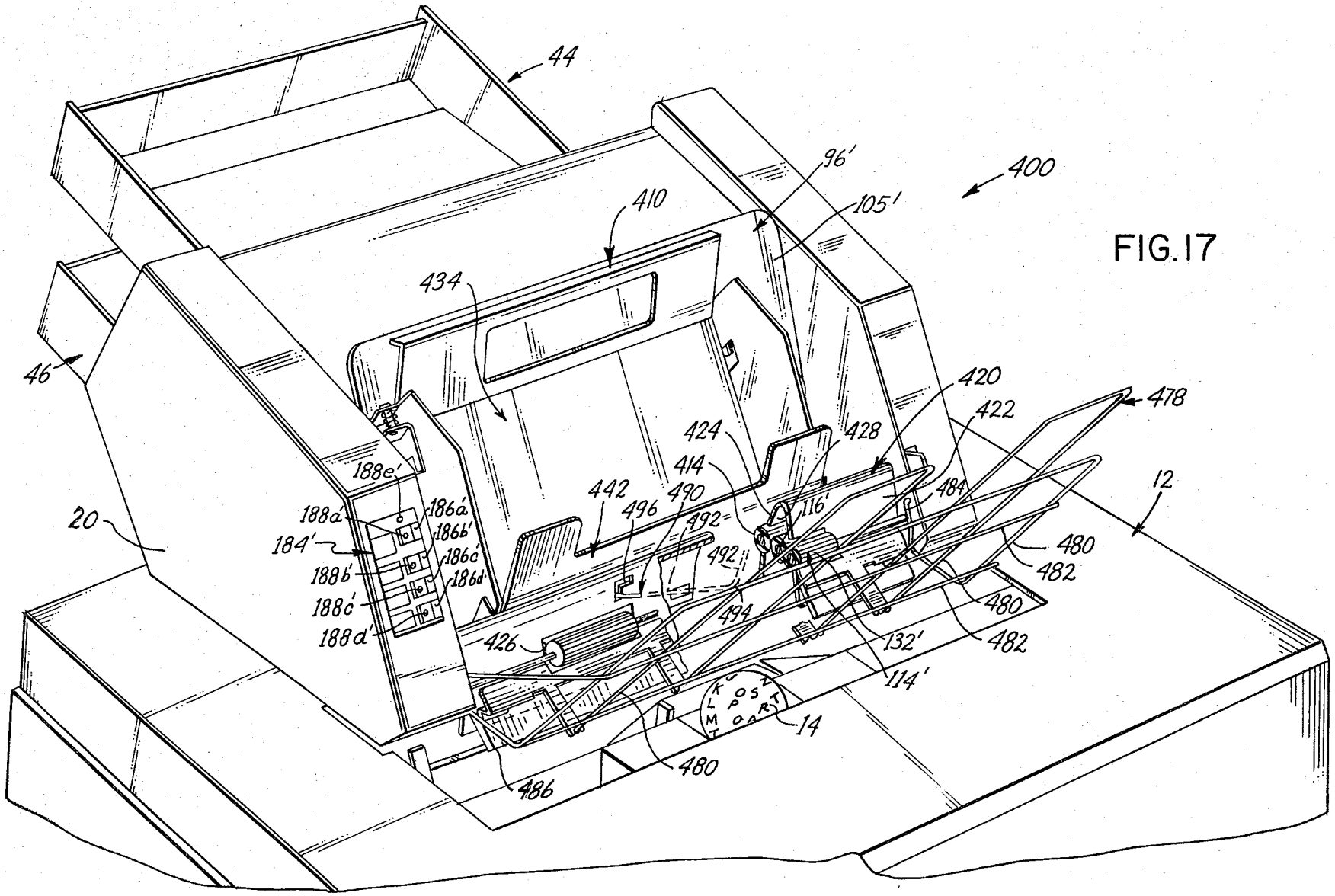
FIG. 17 is a perspective view of another embodiment of the paper feeding apparatus in accordance with the present invention mounted on a printing device, portions of the paper feeding apparatus being broken away to illustrate various components thereof.

The paper feeding apparatus 400 of the second embodiment is basically similar to that shown and described hereinabove with reference to FIGS. 1–16, with the exception that the paper feeding apparatus 400 is operable to not only feed sheets of paper 16, from the first and second paper trays 44, 46, but in addition is operable to feed individual sheets of paper 416 from a third paper tray 410 which is supported by the deflector plate 96' which defines a portion of the main paper feed path 100', i.e., supported generally at the location that sheets of paper 16 after printing were stacked in the first embodiment of the paper feeding apparatus 10 shown in FIG. 1. More particularly, the paper feeding apparatus 400 shown in FIG. 17 is operable to also feed individual sheets of paper 416 from a third paper tray 410 supported on the forward side or surface 105' of the deflector plate 96', the sheets of paper 416 being fed into the paper feed path 100' through a paper passageway 412 provided through or below the deflector plate 96' at an elevation below the elevation that sheets of paper 16 are fed from the first and second paper trays 44, 46. Advantageously, the sheets of paper 416 in the third paper tray 410 may comprise envelopes, and thus the paper feeding apparatus 400 will be described with reference to feeding of such types of paper. However, it will be appreciated that the third paper tray of the paper feeding apparatus 400 could be used for feeding of standard flat stationary or nonstandard size sheets of paper as well.

The basic components, arrangements, and operation of the paper feeding apparatus 10 shown and described hereinabove with reference to FIGS. 1–16 have been incorporated in the paper feeding apparatus 400 of FIGS. 17–29. The modifications for the paper feeding apparatus 400 include the provision of an additional support tray 410 for storing the third plurality of sheets of paper 416, i.e., for storing envelopes, the provision of additional feed rollers 414 for feeding of the envelopes 416 into the paper feed path 100' to the platen 18 for moving the envelopes 416 into a printing position, and the provision of an additional sensor 418 for detecting the presence or absence of envelopes 416 being in a position for being fed automatically to the printing device 12. Further, various of the components shown and described hereinabove with reference to FIGS. 1–16 have been slightly modified. Still further, there is provided a modified ejection mechanism and arrangement for receiving and ejecting sheets of paper 16, 416 from the printing device 12 after printing has been effected thereon, and for thereafter stacking of printed sheets of paper 16, 416. Also, a modified coupling and drive arrangement is provided so that a separate additional motor for driving the additional feed rollers 414 is not necessary. As the majority of the components, and the arrangement and manner of operation is basically the same for the modified paper feeding apparatus 400 in FIG. 17, only the additional components or equipment, as well as the nature of the modifications to the remaining components and the differences in the manner of operation as a result thereof, will be described in detail hereinbelow. Thus, reference should be made generally to the embodiment shown and described hereinabove with reference to FIGS. 1–16 for the description of the basic components and the manner of operation of the paper feeding apparatus 400.

The paper feeding apparatus 400, as with the first embodiment, includes a pair of upstanding, generally parallel spaced side housings or frames 20, 22 which are joined together and supported on a base support or mounting plate 24 (see FIG. 20) for mounting of the paper feeding apparatus 400 onto the printer 12 so as to be in position for feeding sheets of paper 16 to the paper platen 18 thereof. The particular means for mounting the paper feeding apparatus 400 on the printer 12 is similar to the means for mounting of the paper feeding apparatus 10 of the first embodiment, and thus will not be described more fully herein. The paper feeding apparatus 400 also includes upper and lower paper trays 44, 46 which are supported one above the other at the rearward end of the paper feeding apparatus 400 between the side housings or frames 20, 22. Suitable feed rollers 72, 72' are provided for each of the paper trays 44 and 46 which are operable to engage and feed individual sheets of paper 1 therefrom into a paper feed path 100' which is generally inclined downwardly from the paper trays 44, 46 toward the paper platen 18 of the printing device 12. In this regard, guide plate members 82, 88' are provided for each of the paper trays 44, 46 and includes an upper plate portion 84, 90' which is closely spaced with respect to the forward end of its respective paper tray 44, 46 and extends in substantially the same direction as the sheets of paper 16 therein, and a second downwardly inclined portion 86, 92' obliquely oriented with respect to the upper plate portions 84, 90' thereof. A removeable deflector plate 96' is also provided which, with the guide plate members 82, 88', defines the paper feed path 100' for the sheets of paper 16 which are to be fed to the paper moving platen 18 of the printing device 12 from the paper trays 44, 46. The rearward surface 104' of the deflector plate 96' serves to deflect or guide the sheets of paper 16 downwardly along the paper feed path 100' toward the lower end of the paper feeding apparatus 400 and toward the paper moving platen 18. Once a sheet of paper 16 is fed from the upper or lower paper trays 44, 46 into the paper feed path 100', it is guided in substantially a straight line to the paper receiving inlet entrance 106 of the paper moving platen 18 which corresponds with the conventional inlet for inserting paper into the platen 18 of a printing device 12. This arrangement and the general manner of operation thereof is basically the same as that described hereinabove with reference to the first embodiment of the paper feeding apparatus 10.

Figure 20:
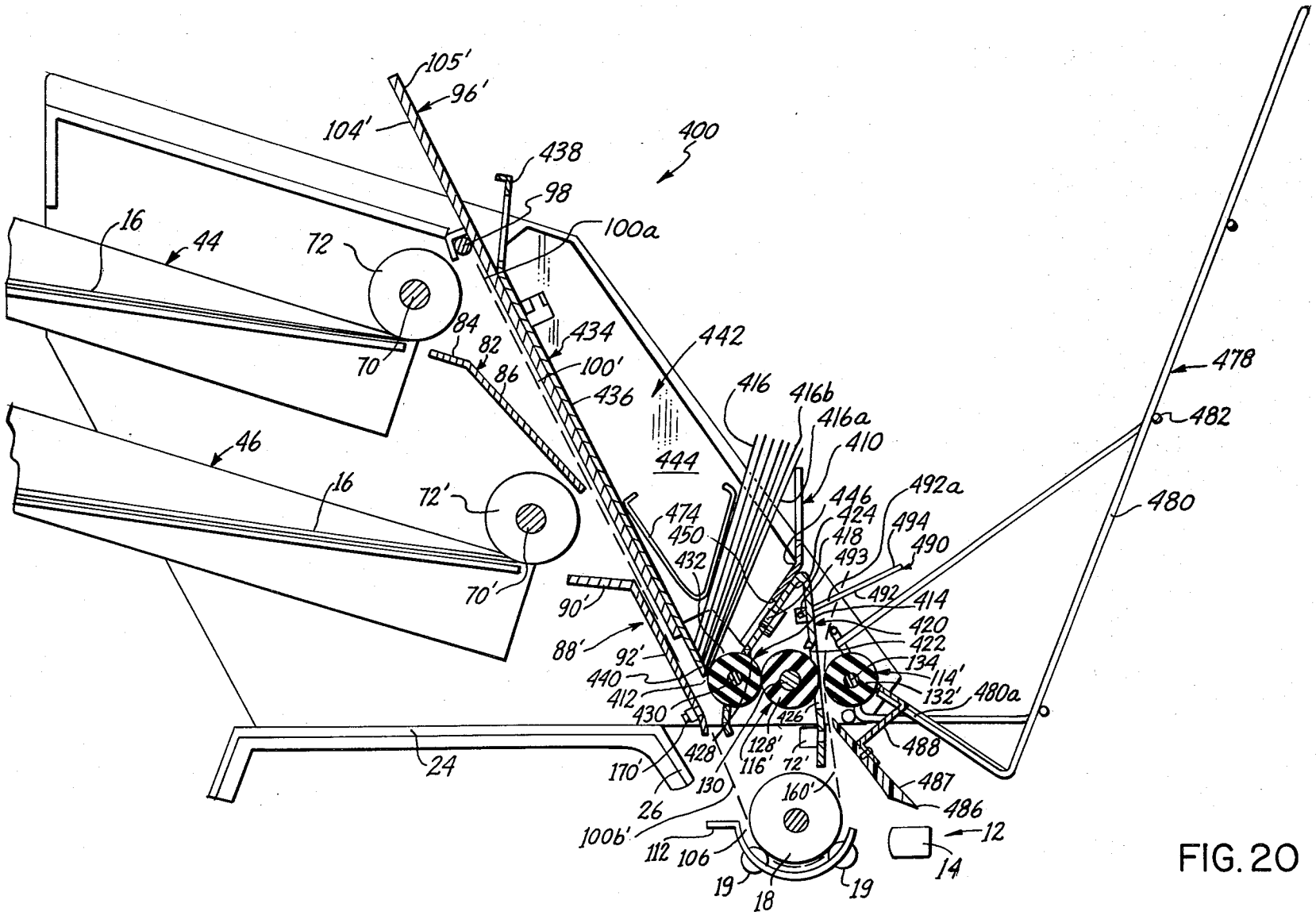
FIG. 20 is a schematic side elevational view of the paper feeding apparatus of FIG. 17 and a portion of the printing device therefor illustrating the various paper feed and exit paths for sheets of paper and envelopes.

In the paper feeding apparatus 400 of the second embodiment, the upper paper guide plate member 82 is substantially identical to the upper guide plate member 82 of the paper feeding apparatus 10 shown in FIG. 1, whereas the lower guide plate member 88' for the lower paper tray 46 has its downwardly inclined plate portion 92' extending downwardly slightly below the lower end of the paper feeding apparatus 400 toward the paper receiving inlet 106 of the printing device 12, as best seen in FIG. 20. The downwardly inclined plate portion 92' thus extends downwardly to a slightly greater extent than the downwardly inclined plate portion 92 of the first embodiment of the paper feeding apparatus 10. The deflector plate 96', as in the first embodiment of the paper feeding apparatus 10, is removably supported by a transversely extending rod 98 which extends between the side housings 20, 22 at the upper end thereof, and extends downwardly to define a portion of the paper feed path 100'. As with the first embodiment, the lower end of the deflector plate 96' is spaced from the downwardly inclined plate portions 88, 92' by means of protruding fasteners (not shown) on the downwardly inclined plate portions 88, 92'. Additionally, the deflector plate 96' of the paper feeding apparatus 400 is of a slightly shorter length so that it does not extend downwardly the same extent as the deflector plate 96 of the first embodiment.

Figure 27:
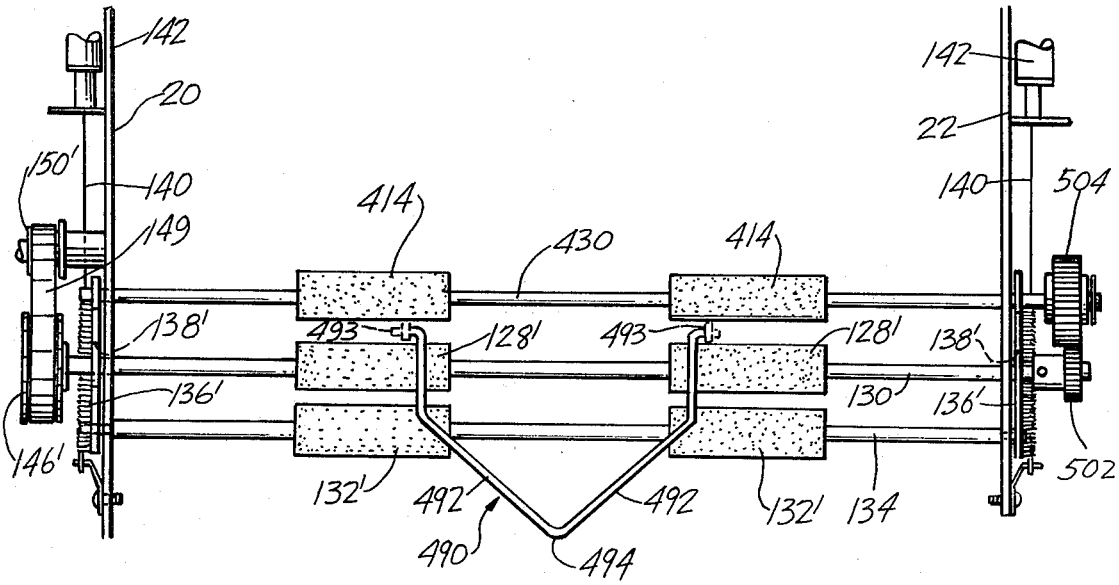
FIG. 27 is a sectional view, taken along lines 27—27 of FIG. 20, with portions thereof removed to illustrate the envelope feed rollers and ejection rollers, and further illustrating the coupling means and drive means for driving the envelope feed rollers and ejection rollers.

The exit guide plate member 420 of the apparatus 400, and the general ejection mechanism for ejecting sheets of paper 16, 416 from the printing device 12 after they have been printed on, have also been modified in comparison to the exit guide plate member 118 and ejection mechanism of the paper feeding apparatus 10 of the first embodiment. More particularly, the exit guide plate member 420 of the paper feeding apparatus 400 comprises a generally V-shaped member including a front surface 422 inclined downwardly and adapted to lie just above the rotatable platen 18 of the printing device 12 adjacent the exit end thereof, and a rearwardly inclined surface 424 which, with the deflector plate 96', serves to support an envelope storage tray 410. Unlike the exit guide plate member 118 shown in the embodiment of FIG. 1, the rearwardly inclined surface 424 of the exit plate guide member 420 is not V-shaped, but rather simply includes a downwardly directed inclined surface. The lower end of the rearwardly inclined surface 424 of the exit guide plate member 420 is spaced from the lower end of the deflector plate to define the paper passageway 412 which communicates with the lower end 100b' of the paper inlet feed path 100' for the feeding of envelopes 416 from the envelope storage tray 410 to the paper platen 18 (see FIG. 20). The forward surface 422 of the exit guide plate member 420 has suitable slots or openings 426 therein for receipt of a pair of spaced rollers 128' which comprise ejection roller means 116', as best seen in FIGS. 17, 20 and 27. As with the first embodiment of the paper feeding apparatus 10, the ejection rollers 128' are fixedly secured to a transversely extending shaft 130 which is journalled in the upright side housings 20, 22. Second ejector roller means 114' is also provided in the apparatus 400 and comprises a pair of forward spaced roller members 132' fixed to a transversely extending shaft 134 mounted in the side housings 20, 22. The forward rollers 132' are arranged directly opposite from the rear roller members 128' in a generally horizontal plane, as opposed to lying along an inclined plane as in the first embodiment. As with the first embodiment, and as more fully described hereinbelow, the ends of the forward transversely extending shaft 134 are journalled in respective plate members 136' supported in the respective side housings 20, 22 for movement toward and away from the shaft 130 so that the forward rollers 132' may move into engagement with the rear rollers 128' when it is desired to eject a sheet of paper 16, 416 from the printing device 12.

The rearwardly inclined surfaces 424 of the exit guide plate member 420 also includes spaced openings 428 therein for receipt of a pair of envelope feed rollers 414 which comprise the envelope feed means for automatically feeding of envelopes 416 from the envelope storage tray 410 into the paper feed path 100'. The envelope feed rollers 414 have a generally smooth surface, and are fixedly secured to a support shaft 430 journalled in the upright side housings 20, 22.

Figure 18:
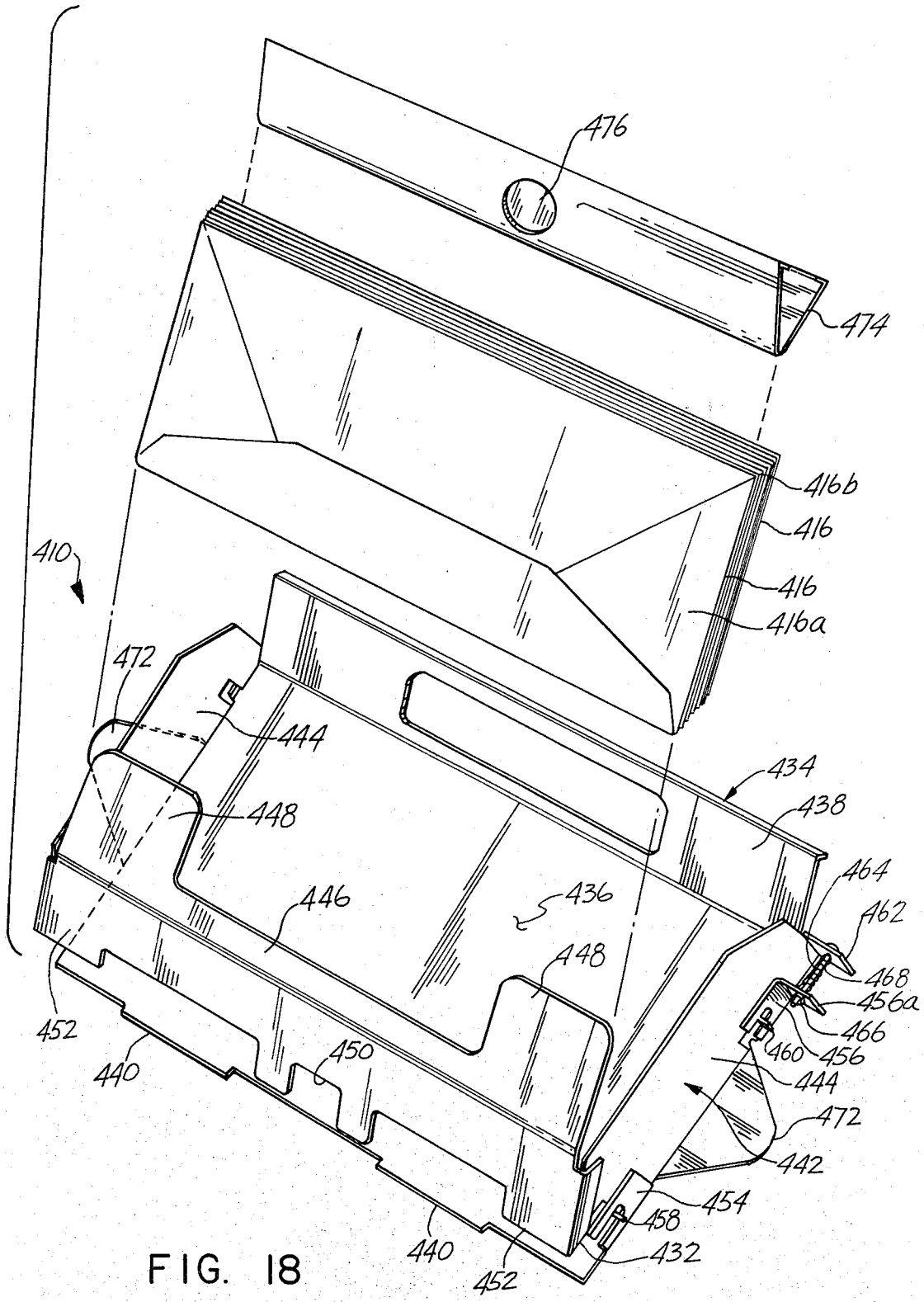
FIG. 18 is a perspective view of an envelope support tray for supporting envelopes in the paper feeding apparatus of FIG. 17 for automatic feeding of individual envelopes to the printing device, and illustrating how envelopes are to be supported therein.
Figure 19:
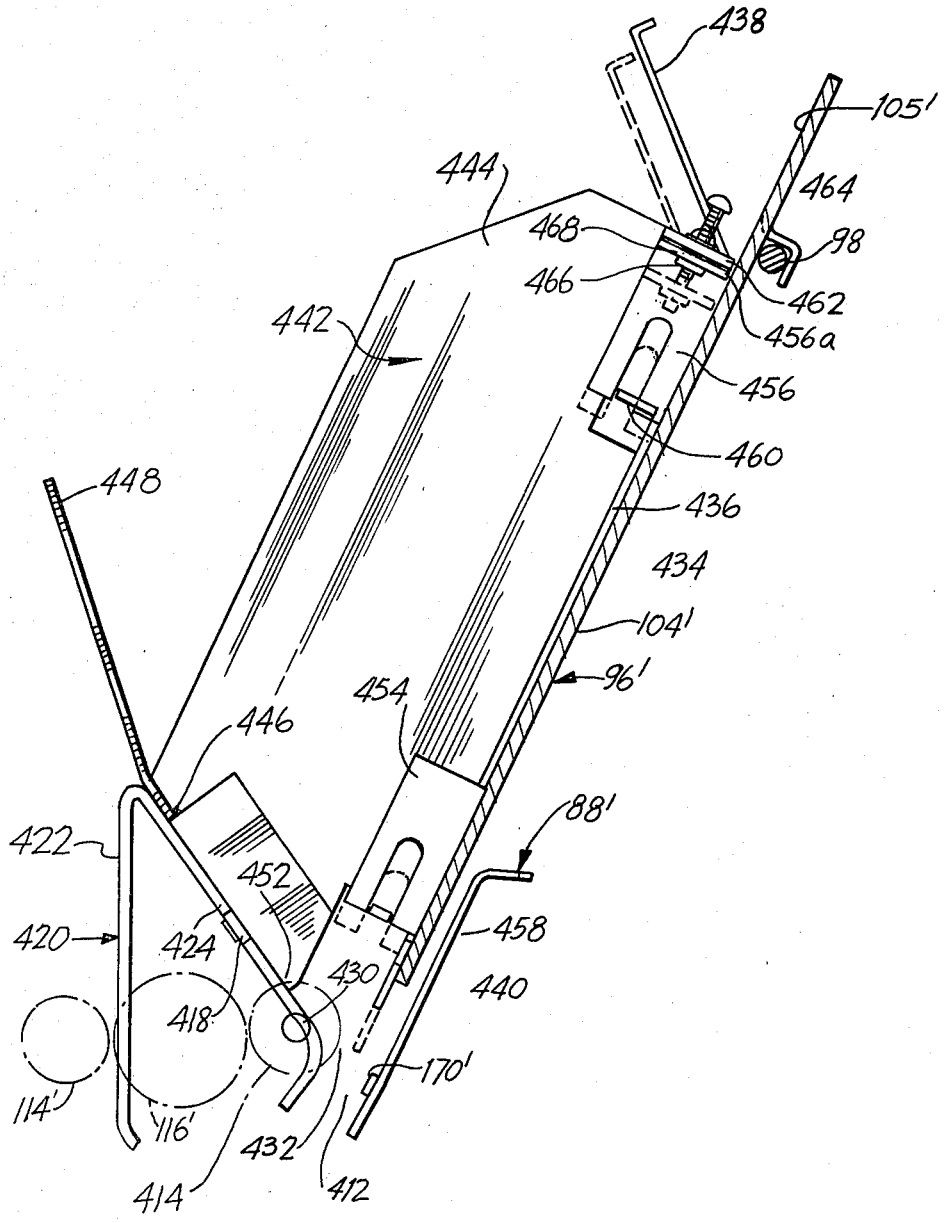
FIG. 19 is a side elevational view of the envelope support tray, illustrating the envelope support tray supported in the paper feeding apparatus and showing how the envelope support tray is adjustable to accommodate different thickness of envelopes to be fed to the printing device. The full outline representation in FIG. 19 illustrates the arrangement of the envelope support tray for feeding of relatively thick envelopes, whereas the dotted outline representation illustrates the arrangement for feeding of relatively thin envelopes.

The envelope storage tray 410 is adapted to be supported between the deflector plate 96' and the rearwardly inclined surface 424 of the exit guide plate member 420 so that the lower end thereof is in line with the paper passageway 412 defined thereby. The envelope storage tray 410 similarly includes a feed slot 432 therein at the lower end for guiding of envelopes 416 from the tray 410 into and through the paper passageway 412 into the main paper feed path 100'. In the preferred embodiment, the envelope storage tray 410 comprises a two part tray which is adjustable for varying the size of the feed slot 432 therein to accommodate different size or thickness envelopes 416. More particularly, as best seen in FIGS. 18 and 19, the envelope tray 410 includes a first component 434 which has a substantially flat lower plate portion 436 and which is adapted to be placed against the forward surface 105' of the deflector plate 96' to be inclined downwardly at the same angle, and an upper plate portion 438 which is inclined slightly relative to the lower plate portion 436. The lower edge of the lower plate portion 436 includes a pair of spaced tab portions 440 which extend slightly beyond the lower edge of the lower plate portion 436. The second component 442 of the tray 410 is mounted for relative movement with respect to the first component 434, and includes upstanding side portions 444 interconnected by a forward transversely extending plate portion 446 which includes spaced rearwardly inclined tab portions 448 at the opposite side edges. The tab portions 448 are generally parallel to the upper plate portion 438 of the first component 434. The lower edge of the transversely extending plate portion 446 is recessed slightly in a central portion thereof, as indicated at 450. The transversely extending plate portion 446 is fixed to the side portions 444 so that the lower side portions 452 thereof (on opposite sides of the central recess 450) are spaced from the surface of the lower plate portion 436 of the first component 434, as best seen in FIG. 19.

Each of the opposite side edges of the lower plate portion 436 of the first component 434 includes a pair of upstanding slotted bracket members 454, 456, one (454) at the lower end and the other (456) at the upper end, and within which laterally projecting tab members 458, 460 on the side portions 444 of the second component 442 are adapted to be received. The side portions 444 of the second component 442 are also each provided with a laterally extending flange 462 adjacent its upper end which is generally parallel and spaced from a similar flange portion 456a on the upper bracket 456 on the side edges of the lower plate portion 436 of the first component 434. A screw or bolt member 464 extends through and is secured to each of the respective pairs of laterally extending flanges 462, 456a with a nut 466, and a spring 468 is provided between the flanges 462, 456a of each respective pair for normally biasing the two respective flanges 462, 456a apart so that the second tray component 442 is in turn normally biased in a direction towards the upper end of the first tray component 434. The position of the second tray component 442 relative to the first component 434 may be adjusted by adjustment of the nut 466 onto the lower end of the bolt 464 to either increase or reduce the spacing between the respective flanges 462, 456a on each side of the tray 410. The upper or raised position of the second component 442 relative to the first component 434 is shown in solid or full outline in FIG. 19, whereas the lower position thereof is shown in dotted outline.

The second component 442 may thus be slid or moved relative to the first component 434 to adjust the size of the feed slot 432 defined between the forward transversely extending portion 446 of the second component 442 and the tabs 440 on the lower edge of the first component 434 when the tray is supported between the deflector plate 96' and the exit guide member 420, as best seen schematically in FIG. 19. During relative movement, the laterally protruding tabs 458, 460 on the second component 442 are guided and retained in the slots in the side brackets 454, 456. This adjustability of the two components 434, 442 of the tray member 410 is advantageous for varying the width of the feed slot or spacing of the feed slot 432 through which envelopes 416 are fed during an envelope feeding operation, as described in more detail hereinbelow. More particularly, the full outline representation in FIG. 19, which shows a relatively large or wide horizontal spacing between the feed rollers 414, and the tabs 440 on the lower plate portion 436, represents the arrangement or spacing for relatively thick envelopes 416, whereas the dotted outline representation in FIG. 19, which shows a smaller spacing between the feed rollers 414 and the tabs 440, represents the arrangement for relatively thin envelopes 416.

The envelope storage tray 410 is supported between the deflector plate 96' and the exit guide plate member 420 with the lower surface of the lower plate portion 436 resting on the forward surface 105' of the deflector plate 96' and the transversely extending portion 446 in engagement with the rearwardly inclined surface 424 of the exit guide plate member 420. Laterally extending portions 472 on the lower plate portion 436 (best seen in FIG. 18) serve to space the envelope tray 410 between the upright side housings 20, 22.

The envelopes 416 are arranged in the envelope storage tray 410 to rest on edge against the lower plate portion 436 of the first component 434, and are urged downwardly toward the forward transversely extending portion 446 by virtue of the inclined arrangement of the tray 410. In order to ensure that the envelopes 416 are smoothly fed and urged toward the lower end of the tray 410, a V-shaped bar 474 is provided which is adapted to be arranged behind the last envelope 416 in the stack, as can best be seen in FIG. 18. The V-shaped bar 474 is slidable downwardly along the surface of the inclined lower plate portion 436 as envelopes 416 are fed from the tray 410. When the envelope tray is supported on the deflector plate 96', the envelope feed slot 432 is defined between the feed rollers 414 (supported in the rearward surface 424 of the exit guide plate member 420) and the tab portions 440 on the lower edge of the lower plate portion 436 of the first component 434 of the tray, as best seen in FIG. 20. The spacing between the tab portions 440 and the feed rollers 414 (i.e., the width of the feed slot 432) may be adjusted by adjustment of the spacing between the flanges 462, 456*a* on the first and second components 434, 442 of the tray 410 to adjust the position of the tab portions 440 with respect to the feed rollers 414. More particularly, when the size of the spacing is large (as shown in full outline in FIG. 19), the tab portions 440 are located at a higher elevation along the deflector plate 96' and thus are spaced a greater distance from the surface of the feed rollers 414 so as to provide a relatively large size feed slot 432. When the size of the spacing is smaller, the tab portions 440 are arranged at a lower elevation along the deflector plate 96' to be slightly below the surface of the feed rollers 414, as shown in dotted outline in FIG. 19, to thereby provide a small size feed slot 432 for thinner envelopes. It will thus be appreciated that the size of the feed slot 432 can be adjusted by adjusting the spacing between the flanges 462, 456*a*, i.e., by moving the flanges 462, 456*a* apart to decrease the size of the feed slot 432 or by moving the flanges 462, 456*a* toward one another to increase the size of the feed slot 432.

As best seen in FIG. 20, when the envelopes 416 are arranged in the tray 410 and the tray 410 is supported on the deflector plate 96', the lowermost envelope 416*a* in the stack is in engagement with the feed rollers 414 and lies above the feed slot 432. When it is desired to feed an envelope 416, the feed rollers 414 are rotated, in a counterclockwise direction as viewed in FIG. 20, to engage the lowermost envelope 416*a* in the stack and advance it through the feed slot 432 and passageway 412 to direct the envelope 416*a* into the lower end 100*b*' of the paper feed path 100' to be guided toward the paper moving platen 18 of the printing device 12. In this regard, by proper adjustment of the two components 434, 442 of the tray 410, the protruding tab portions 440 on the lower edge of the lower plate portion 436 will serve to block the passage of the immediately behind envelope 416*b* of the stack so that only the first envelope 416*a* in the stack will be advanced through the envelope feed slot 432 when the feed rollers 414 are rotated.

As envelopes 416 are fed one at a time from the envelope tray 410, the remaining envelopes 416 in the tray are advanced downwardly along the inclined surface of the lower plate portion 436 toward the feed rollers 414. This sliding advancement of the envelopes 416 toward the forward portion of the tray 410 is aided by the V-shaped bar 474 provided at the rearward end of the stack, which also serves to maintain a tight or compact stack of envelopes 416 in the tray 410.

The V-shaped bar 474 includes a centrally located beam absorber 476 (see FIG. 18) to absorb a light beam from a sensor 418 centrally provided on the rearward surface 424 of the exit guide plate member 420 when no envelopes are in the tray 410 or when the supply of envelopes 416 has been depleted. This sensor 418 is similar to the other sensors 170, 172 utilized in the paper feeding apparatus 10, 400 and described hereinabove with reference to the first embodiment. For example, the sensor 418 may comprise a photoelectric reflector type sensor which transmits a beam of light and which includes means for receiving light reflected by an envelope 416 arranged in front of the sensor 418 to close the sensor 418. The sensor 418 is arranged on the surface 424 so that its beam is directed toward the recess 450 provided in the transversely extending plate portion 446 and strikes the first envelope 416*a* in the stack when envelopes are present in the tray 410. When the supply of envelopes has been depleted, the beam of light will thus strike the absorbing surface 476 on the V-shaped bar 474 and thus remain open to indicate that no envelopes are in the tray 410.

Figure 21:
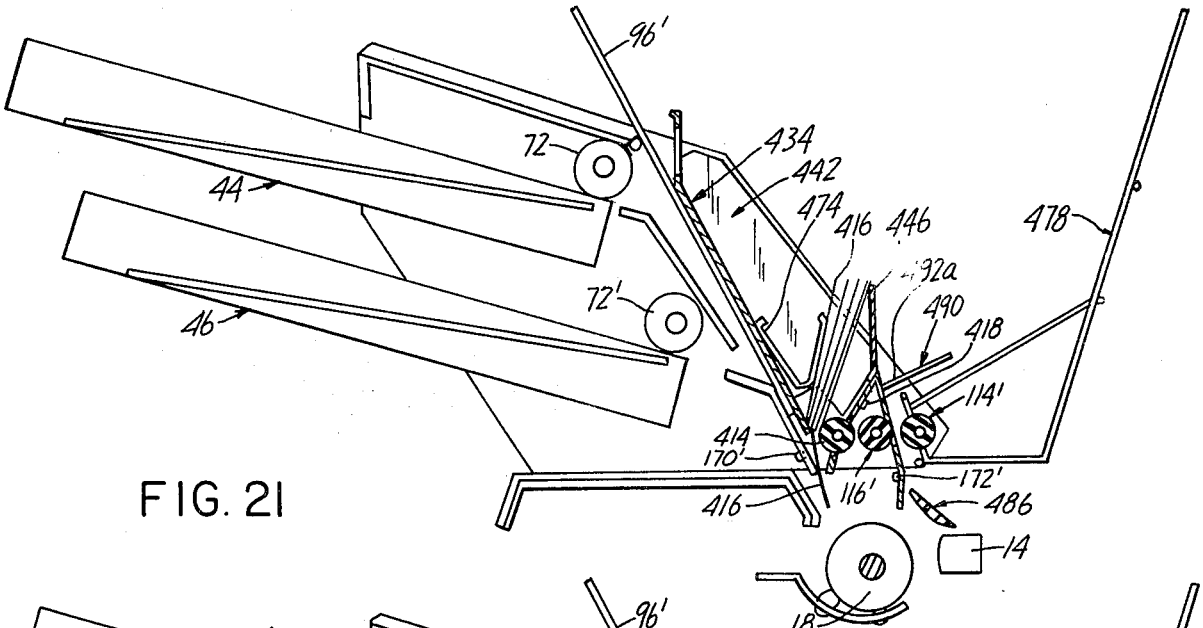
FIG. 21 is a side schematic elevational view, similar to that shown in FIG. 20, but on a smaller scale, illustrating an envelope being fed from the envelope support tray and moving past the paper inlet sensor.

In the second embodiment of the paper feeding apparatus 400, the first paper movement sensor 170', as with the sensor 170 of the first embodiment is provided along the inlet paper feed path 100' for detecting when and if a sheet of paper 16 from one of the paper storage trays 44, 46 is being fed along the paper feed path 100 (see FIG. 21). This sensor 170' also serves to detect when an envelope 416 is being fed from the envelope storage tray 410 (for example, see FIG. 25). The first paper movement sensor 170' is located at a slightly lower elevation in the paper feeding apparatus 400 than the sensor 170 in the first embodiment, and in particular is mounted on the downwardly inclined plate portion 92' of the guide plate member 88' adjacent the lower end thereof so as to be located along the paper feed path 100' at an elevation below that at which an envelope 416 is fed through the feed slot 432 by the envelope feed rollers 414. Thus, the sensor 170' is able to detect not only the movement of sheets of paper 16 from the upper and lower trays 44, 46, but also movement of an envelope 416 along the lower portion 100*b*' of the paper feed path 100'.

It will be recalled that in accordance with the first embodiment of the paper feeding apparatus 10 shown in FIGS. 1–16, the sensor 170 closes when the leading edge of the paper 16 being fed from the paper feed trays 44, 46 into and along the paper feed path 100 passes the sensor 170. The closing the sensor 170 in turn serves to activate the paper platen 18 to receive the sheet of paper 16 and then move the sheet of paper 16 through the printing device 12. A second paper movement sensor 172, located along the outlet or exit path of movement 160 for the sheet of paper 16, is provided in the forward surface 120 of the exit guide plate member 118 for detecting when the sheet of paper 16 has been picked up by the platen 18 and is being moved thereby to the printing device 12. Additionally, the second paper movement 172 sensor serves to provide a reference point which is used for positioning of the sheet of paper 16 in a proper print position relative to the printing head 14 by initially detecting when the leading edge of a sheet of paper 16 moves therepast, and then reversing movement of the platen 18 to align the leading edge with the second paper movement sensor 172.

This general technique is also utilized in the embodiment shown in FIGS. 17–29 for the feeding of sheets of paper 16 from the upper and lower paper trays 44, 46. As can be appreciated, however, use of this technique for feeding of sheets of paper 16, activating the platen 18 and aligning the paper 16 in the printing device 12 requires that the sheet of paper 16 be sufficiently long so as to permit the leading edge to move past the second sensor 172′ while a major portion thereof remains in engagement with the platen 18. As it may be difficult to locate or position the sensor 172′ so as to accommodate envelopes 416 which have a relatively short length in the feed direction when an envelope 416 is being fed, in the paper feeding apparatus 400 the first paper movement sensor 170′ is utilized to provide the reference point for positioning of the envelope 416 in a proper print position relative to the print head 14.

Figure 22:
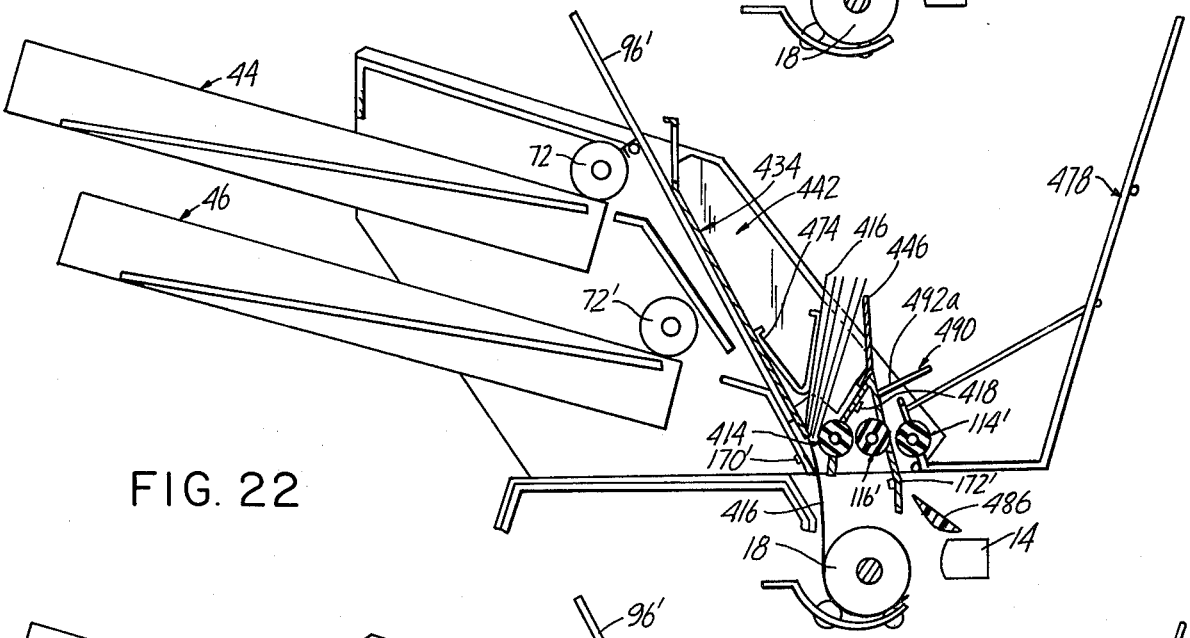
FIG. 22 is a schematic side elevational view, similar to that shown in FIG. 21, illustrating an envelope being moved by the platen of the printing device with the trailing edge thereof being positioned in front of the paper inlet sensor.

In particular, the first paper movement sensor 170′ is utilized to sense the trailing edge of the envelope 416 and to align the trailing edge of the envelope therewith, much in the same manner that the second sensor 172, 172′ is utilized for aligning sheets of paper 16 with the print head 14 which are fed from the upper and lower paper trays 44, 46 (see FIG. 22). Specifically, in an envelope 416 feeding operation, the paper feeding apparatus 400 detects when the first paper movement sensor 170′ opens (i.e., when the trailing edge of the envelope 416 passes the sensor 170′) and then slowly reverses movement of the platen 18 until the sensor 170′ is closed by the trailing edge of the envelope 416. By knowing the distance of the first paper movement sensor 170′ from the print head 14, and the distance the paper moves for each increment of motion of the platen 18 in the advance directions, conventional printing commands can cause the envelope 416 to be moved to a proper print position for the first line of print on the envelope 416 by advancing the platen 18 the required number of increments. Thus, this technique for providing a reference point for alignment of the envelope 416 with the print head 14 is generally the same technique as that utilized for aligning the sheet of paper 16 fed from the paper storage trays 44, 46, with the exception that the trailing edge of the envelope 416 is sensed by the first paper movement sensor 170′ as opposed to the leading edge of a sheet of paper 16 being sensed by the output or second paper movement sensor 172′.

Additionally, in the preferred embodiment of the paper feeding apparatus 400, the platen 18 is only activated after the envelope 416 has been forced into engagement with the platen 18 (i.e., between the roller 19 and the platen 18). This technique ensures that the envelope 416 is properly positioned for movement by the platen 18, as more fully described hereinbelow.

The paper feeding apparatus 400 also includes a modified arrangement for ejecting and storing sheets of paper 16 which have been printed on. Specifically, new receptacle 478 for receiving printed sheets 16 and envelopes 416 is provided which is adapted to be supported by the upright side housings 20, 22 and extend forwardly of the paper feeding apparatus 400. In the preferred embodiment, as best seen in FIG. 17, the receptacle means 478 comprises a wire basket that includes a plurality of generally V-shaped wires 480, each having a relatively short rearwardly extending portion 480*a* and a relatively long forwardly extending portion 480*b* and a plurality of cross wires 482 which interconnect the V-shaped wires 480 to provide a unitary structure. On the lateral sides of the basket 478, there are provided support bars 484 which are received in suitable openings in the upright housings 20, 22 for supporting the wire basket 478 relative to the housings 20, 22 of the paper feeding apparatus 400. In this regard, it should be appreciated that although in the preferred embodiment the paper receiving means comprises a wire basket 478, any suitable receiving tray could be utilized which is arranged forwardly of the housings 20, 22 of the paper feeding apparatus 400 and which includes a suitable surface for receiving and supporting sheets of paper 16 or envelopes 416 as they are ejected from the printing device 12.

The wire basket 478 also includes a downwardly directed plate member 486 which, for example, may be made of plexiglass or other transparent material, and which serves the same basic function as the cover member 154 of the first embodiment. The plate member 486 is connected to the rearwardly inclined portions 480*a* of the basket 478 by means of brackets 488. In particular, the plate member 486, with the forward surface 422 of the exit guide plate member 420, defines an exit path of movement 160′ for guiding sheets of paper 16 (or envelopes 416) as they leave the platen 18 upwardly between the normally spaced ejection rollers 128′, 132′. As with the cover member 154 of the first embodiment, the plate 486 is slightly inclined with respect to the forward surface 422 of the exit guide plate member 420 to provide a relatively large entrance which tapers toward the ejection rollers 128′, 132′. The lower front surface 487 of the plate member 486 may also serve as a stop or rest for the paper rollers 158 of the printing device 12 which normally serves to direct paper away from the print head 14.

In order to direct sheets of paper 16 or envelopes 416 from the exit path of movement 160 into the wire basket 478, there is provided on the forward surface 422 of the exit guide plate member 420 a pivotable deflector bar 490 which in the preferred embodiment comprises a wire deflector bar. The wire deflector bar 490 includes a pair of angularly inclined bar portions 492 which meet at a forward curved tip 494. The other ends of the inclined bar portions 492 are mounted in suitable brackets 493 provided behind the forward surface 422 of the exit guide plate member 420. The forward surface 422 of the exit guide plate member 420 also includes a pair of slotted portions 496 adjacent the locations of these brackets 493 to facilitate assembly of the deflector bar 490 therein and to permit free pivotal movement of the bar 490 relative to the exit guide plate member 420 between end positions defined by the upper and lower edges of the slots 496. In this regard, the deflector bar 490 is located downstream of the ejection rollers 128′, 132′ in the direction of paper movement along the exit path of movement 160. When the deflector bar 490 is in its lowered position, as shown in FIG. 20, the bar 490 extends transversely from the forward surface 422 of the exit guide plate member 420 so that an intermediate portion 492*a* of the bar portions 492 overlie the exit path of movement 160. The deflector bar 490 is pivotable upwardly when engaged by a sheet of paper 16 or envelope 416 so that only the curved tip portion 494 is in contact with the sheet of paper 16 (or envelope 416), and the intermediate portion 492*a* are generally out of the path of movement 160 of the paper (see FIG. 23).

Figure 23:
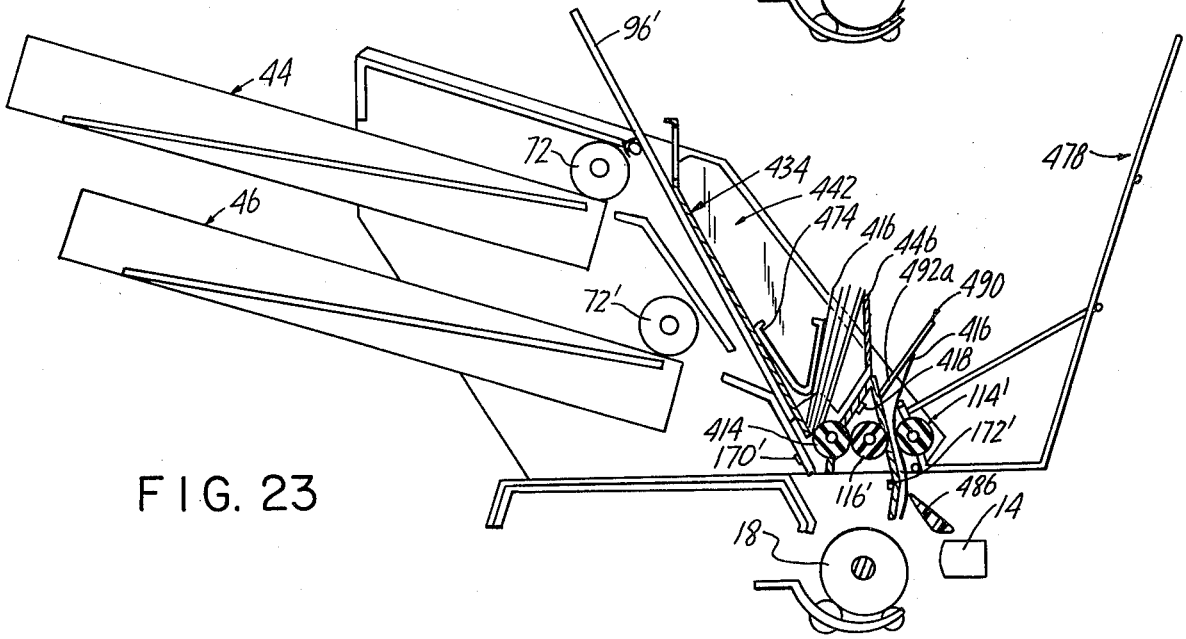
FIG. 23 is a schematic side elevational view, similar to that shown in FIG. 21, illustrating an envelope being ejected from the printing device by the paper feeding apparatus shown in FIG. 17.
Figure 24:
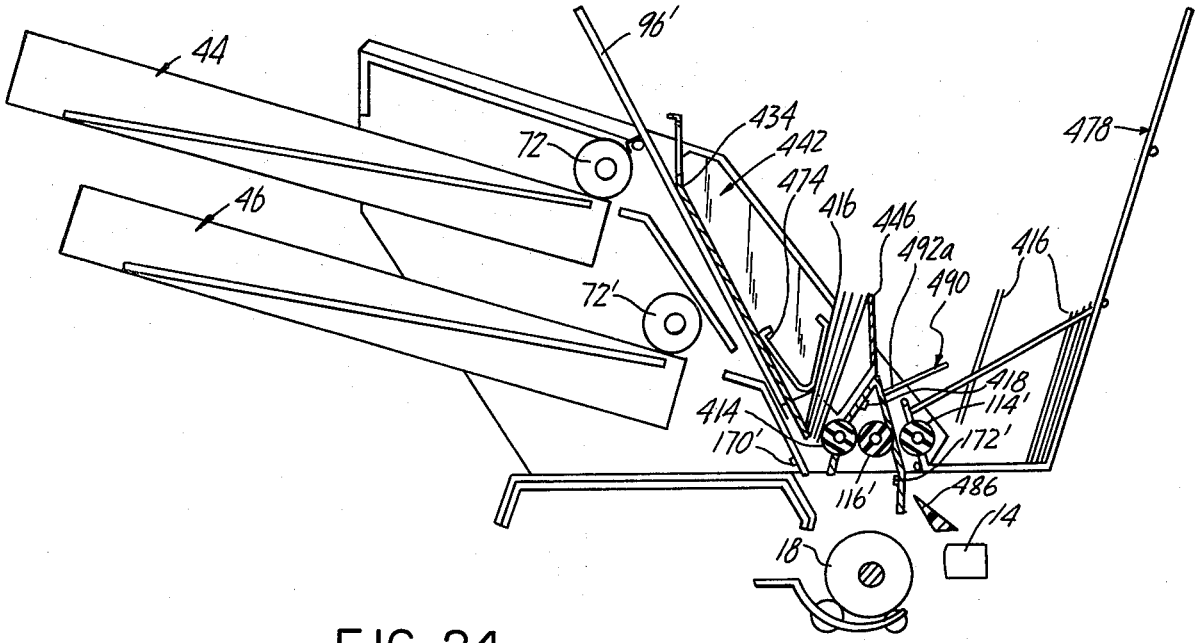
FIG. 24 is a schematic side elevational view similar to that shown in FIG. 21 illustrating an envelope being directed into a receptacle mounted on the front of the paper feeding apparatus shown in FIG. 17.
Figure 25:
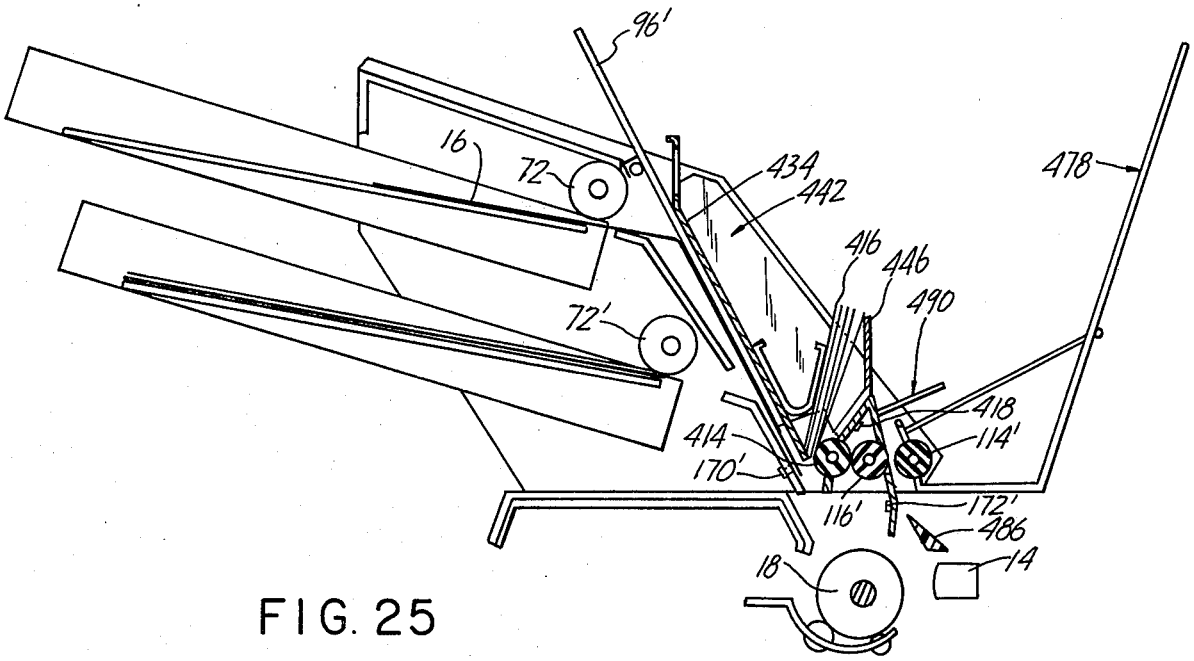
FIG. 25 is a schematic side elevational view, similar to that shown in FIG. 21, illustrating a sheet of paper being fed from the upper paper tray and moving past the paper inlet sensor.
Figure 26:
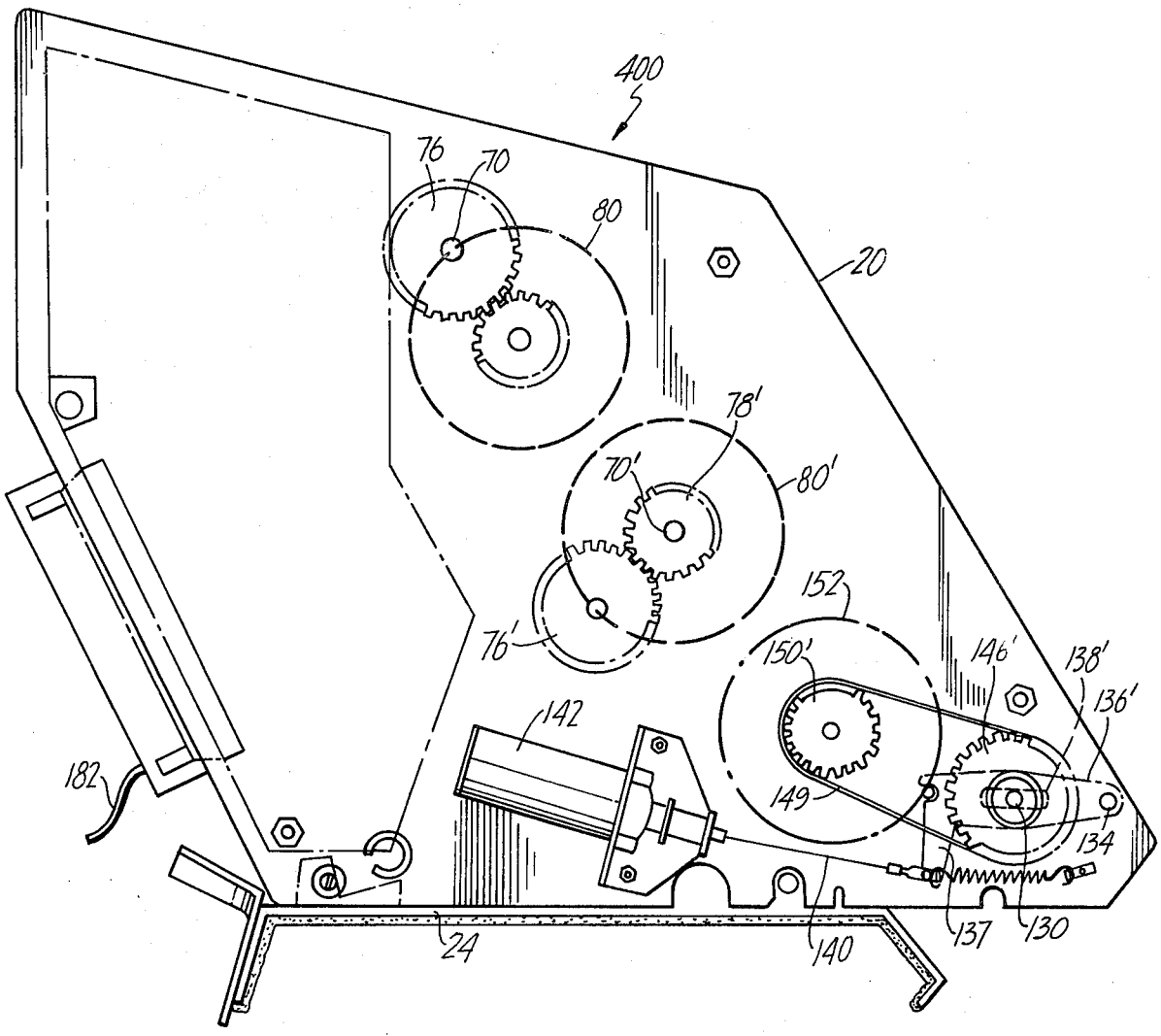
FIG. 26 is a side elevational view of the paper feeding apparatus shown in FIG. 17 with the cover plate on the left hand upright housing removed to illustrate the various components thereof.

Thus, as the paper 16 moves upwardly along the paper exit path 160' either as a result of being moved by the platen 18 or the ejection rollers 128', 132', the deflector bar 490 serves to direct the paper forwardly, i.e., in the right-hand direction as viewed in FIG. 20, toward the wire basket 478 (see FIG. 23). As soon as the sheet of paper 16 leaves the exit rollers 128', 132', the deflector bar 490 pivots downwardly by gravity to in essence "kick" the sheet of paper 16 into the wire basket 478 (see FIG. 24). In this regard, the weight of the deflector bar 490 should be chosen to be sufficiently light so as to not adversely affect movement of the paper 16 along the exit path 160', but at the same time should be sufficiently heavy that it may pivot downwardly to its lower position to direct the paper 16 into the wire basket 478 as soon as the paper 16 is released by the ejection rollers 128', 132'.

It should also be noted in this regard that the deflector bar 490 is operable to not only direct sheets of paper 16 from the exit path 160' into the wire basket 478, but envelopes 416 as well which are moving along the exit path 160'. Further, it will be noted that the printed sheets of paper 16 and envelopes 416 are stacked in the wire basket 478 in the order that they were printed, and arranged with the printed face facing forwardly. In other words, as each successive sheet of paper 16 or envelope 416 is delivered and ejected into the wire basket 478, it will be stacked behind the immediately preceding sheet of paper 16 (or envelope 416) with the text printed thereon being on the forward facing surface thereof. As can be appreciated, this is advantageous since reordering of the sheets of paper 16 stored in the wire basket 478 is not necessary when the sheets of paper 16 are removed therefrom.

Another advantageous feature of the second embodiment of the paper feeding apparatus 400 is the fact that the stepping motor 152 for driving the ejection rollers 128' is coupled to also drive the envelope feed rollers 414 when desired by simply reversing the direction of rotation of the stepping motor 152. More particularly, with reference to FIGS. 26–28, as with the first embodiment of the paper feeding apparatus 10, the ends of the forward transversely extending shaft 130 are journalled in the side housings 20, 22. The end of the shaft within the left-hand housing 20, as shown in FIG. 17, is provided with a rotatable gear 146' fixedly mounted thereto having a plurality of teeth on its outer surface. The stepping motor 152 is also provided in the left-hand housing 20 so as to have its axis spaced from the axis of the shaft 130. A toothed pulley or gear 150' is fixed to the drive shaft of the stepping motor 152 for rotation therewith, and a belt 149 is trained about the gears 146', 150' so that the ejection roller shaft 130 rotates with rotation of the stepping motor 152 in the same direction as the motor 152 rotates. This arrangement is similar to the arrangement provided in the first embodiment of the paper feeding apparatus 10 with the exception that the ejection shaft 130 is belt driven by means of belt 149 as opposed to being gear driven by a gear 148. During a paper ejection operation, the stepping motor 152 is rotated in a counterclockwise direction as viewed in FIG. 26 to in turn rotate the ejection shaft 130 in a counterclockwise direction.

Also, as with the first embodiment of the paper feeding apparatus 10, the ends of the forward transversely extending shaft 134 are journalled in plate members 136' supported in the side housings 20, 22 for movement to move the forward roller members 132' into engagement with the driven rear ejection roller members 128'. In particular, the movable plate members 136', one of which is provided in each of the side housings 20, 22, includes a slot 138' therein through which the transversely extending shaft 130 for the rear ejection roller members 128' pass. The rearward end of the movable plate members 136' are each provided with a leg 137 to which a cable 140 of a retractable solenoid member 142 is fixedly connected. The solenoid members 142 are in turn mounted in brackets in each of the upright side housings 20, 22. The plate members 136' are normally spring biased toward their forward positions so that the forward ejection roller members 132' are in spaced relationship with respect to the rear ejection roller members 128' in order to provide a space for a sheet of paper 16 to freely move therebetween. As with the first embodiment, simultaneous retraction of the solenoid members 142 in the side housings 20, 22 serves to pull the plate members 136' rearwardly to thereby move the forward ejection roller members 132' into engagement with the rear ejection roller members 128'. The extent of travel of the plate members 136', and thus the forward ejection roller members 132', may be limited by the length of the longitudinal slots 138' provided in the plate members 136', or alternatively by engagement of the forward ejection roller members 132' with the rear ejection roller members 128'.

Figure 28:
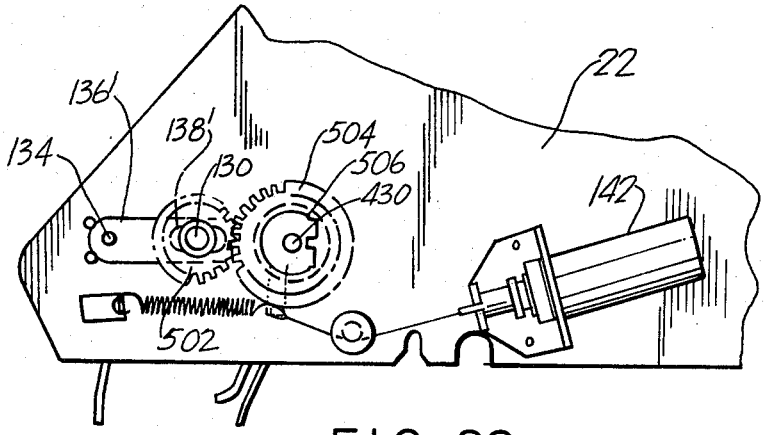
FIG. 28 is a side elevational view of the paper feeding apparatus shown in FIG. 17 with the cover plate on the right-hand housing removed to illustrate the coupling means between the ejection rollers and the envelope feed rollers.

In the opposite side housing 22, i.e., the right hand side housing shown in FIG. 17, the end of the transversely extending shaft 130 for the rear ejection roller members 128' has a gear 502 fixedly mounted thereto (see FIG. 28). This gear 502 in turn is in meshing engagement with a gear 504 provided on the transversely extending shaft 430 for the envelope feed rollers 414. A one way roller clutch 506 of a conventional design is interposed between the shaft 430 for the envelope feed rollers 414 and the gear 504 so that rotation of the gear 504 in one direction will serve to rotate the envelope feed roller shaft 430 in the same direction, but rotation of the gear 504 in the opposite direction will not impart rotation to the envelope feed roller shaft 430; rather, the gear 504 will simply freely rotate relative to the shaft 430. Specifically, when the gear 504 is rotated in a clockwise direction as shown in FIG. 28, (by rotation of the ejection roller shaft 130 in the counterclockwise direction as viewed in FIG. 28), the envelope feed roller shaft 430 will be positively coupled to rotate with the gear 504 thereon by means of the one way roller clutch mechanism 506. However, when the gear 504 is rotated in the opposite counterclockwise direction (by rotation of the ejection roller shaft 130 in the clockwise direction as viewed in FIG. 28), the gear 504 will simply freely spin relative to the envelope feed shaft 430 as the roller clutch mechanism 506 will uncouple the envelope feed roller shaft 430 from the gear 504.

Accordingly, it will be appreciated that the motor 152 provided in the left-hand upright side housing 20 may function to not only drive the ejection roller shaft 130, but may also drive the envelope feed roller shaft 430 to feed envelopes 416 when driven in the opposite direction. It should be noted that the ejection roller shaft 130 is rotated in both situations. However, as no paper 16 or envelope 416 will be provided in the exit feed path 160' during an envelope feed operation, rotation of the ejection rollers 128' in the opposite direction will not adversely affect the operation of the paper feeding apparatus 400. On the other hand, when the ejection rollers 128' are rotated in a direction to eject a sheet of paper 16 or envelope 416, the feed rollers 414 for the envelopes 416 will not rotate, and thus envelopes 416 will remain in the envelope tray 410. Further, it should be noted that operation of the stepping motor 152 in the forward and reverse directions can be simply accomplished by actuating the coils therefor in a first order (for forward rotation) or in the reverse order (for reverse rotation), as is conventional with stepping motors.

The operation of the second embodiment of the paper feeding apparatus will now be described briefly with respect to the conventional operations which are similar to those described hereinabove with reference to the first embodiment, and in more detail with respect to an envelope feed operation.

Initially, the paper feeding apparatus 400 is mounted to the printing device 12 so that the paper feed path 100' is aligned with the inlet 106 of the paper platen 18 and with the paper exit path 160' aligned with the exit end of the platen 18, as with the first embodiment of the paper feeding apparatus 10 shown with reference to FIGS. 1-16. After mounting, the paper feed apparatus 400 is connected electronically to the printing device 12 by a suitable electrical connection device and cable 182 (see FIG. 26) similar to that with the first embodiment. The electrical section of the paper feeding apparatus 400 is basically of a similar nature as that in the first embodiment, and includes a microprocessor, an interface, and a cable 182, the microprocessor serving to control operation of the paper feeding apparatus 400 during a feeding operation, as well as to cooperatively control movement of the platen 18 and printing head 14 to the extent necessary for proper feeding of sheets of paper 16, 416 and moving of same in the proper positioning for printing. As noted above, the paper feeding apparatus 400 controls the operation of the platen 18 and print head 14 of the printing device 12 utilizing conventional codes and commands used by the printing device 12 via the circuitry therefor. The information respecting these codes and commands, and as available from the printer interface as used herein, are set forth in the Interface Manual as provided by the manufacturer of the printing device 12. In the instance of the exemplary embodiment which is used in connection with a Lanier "No Problem" word processing unit, such Interface Manual is available through Lanier Business Products.

The paper feeding apparatus 400 permits the automatic loading of sheets of paper 16 or envelopes 416 into the printing device 12 for printing thereon either from commands located in the text being processed by the printing device 12 or by operator selection through a control panel 184' located in the front of the paper feeding apparatus 400. In this latter regard, the paper feeding apparatus 400 may be used to feed sheets of paper 16 or envelopes 416 automatically to the printing device 12 and print any previously created text that is stored on a disk or in the word processing unit without any additional commands for controlling operation of the paper feeding apparatus 400 being made to the text.

As with the first embodiment, the control panel 184' consists of four switches 186*a*–*d*' and five lights 188*a*–*e*'. Four of the lights 188*a*–*d*' are mounted on the switches 186*a*–*d*' and the remaining light 188*e*' is located on top of the panel 184' to provide an indication that the power to the feeding apparatus 400 is on. One of the switches and lights, for example, the upper switch 186*a*' and light 188*a*', are for resetting the operation of the paper feeding apparatus 400 and to indicate that there is a fault. The second switch 186*b*' may for example control feeding of paper 16 from the upper paper tray 44, and when the light 188*b*' is lit, to indicate that the paper tray 44 is empty. Similarly, the third switch 186*c*' is for controlling feeding from the lower paper tray 46 and the light 188*c*' serves to indicate when the lower paper tray 46 is empty. In a like manner, the fourth switch 186*d*' is for controlling feeding from the envelope tray 40, and the light 188*d*' serves to indicate when the envelope tray 40 is empty. The fourth switch 186*d*' and light 188*d*' thus replace the mode switch 186*d* and light 188*d* in the first embodiment of the paper feeding apparatus 10. In the second embodiment of the paper feeding apparatus 400, the function of the mode switch 186*d* in the first embodiment is controlled by holding the reset switch 186*a*' in a depressed state for a longer period of time, as described more fully hereinbelow.

The actual processing which takes place during operation of the paper feeding apparatus 400 of this embodiment is substantially similar to that which takes place during operation of the first embodiment of the paper feeding apparatus 10 described hereinabove and with respect to which an annotated program listing is attached hereto as Appendix A. Minor changes are necessary thereto in order to accommodate control of the operation of the paper feeding apparatus 400 for feeding of envelopes 416 from the envelope paper tray 410. In this regard, the nature of these changes will be self-evident from the following description of the operation of the paper feeding apparatus 400 for feeding of envelopes, and from the flow chart set forth in FIG. 29, which illustrates the implementation of the algorithm for the microprocessor for feeding of envelopes 416. In this regard, reference will also be made to the flow charts of FIGS. 16*a* and 16*b* for a basic understanding of the modification for feeding of envelopes 416.

Referring initially to FIG. 16*a*, when it is desired to print a stored text onto a sheet of paper 16 or envelope 416, the paper feeding apparatus 400 is activated to enter the feed control routine A (as indicated by the circular flag 200 and labeled "Feeder Control Routine" in FIG. 16*a*), by depressing the appropriate tray switch for either the upper or lower paper trays 44, 46 or for the envelope paper tray 410. The paper feeding apparatus 400 is initially tested to ascertain which switch 186*b*', 186*c*' or 186*d*' is depressed. In this regard, the tests for the upper and lower paper tray switches 186*b*' and 186*c*' are the same as depicted in FIG. 16*a*, i.e., the upper tray switch 186*b*' is initially tested (as indicated by the diamond 202 in FIG. 16*a*), and then the lower tray switch 186*c*' is tested (as indicated by either the diamond 214 or the diamond 206 in FIG. 16*a*). If the tests for the upper and lower tray switches 186*b*' and 186*d*' are both negative, an appropriate test for the envelope tray switch 186*d*' is made prior to testing of the reset switch 186*a*'. In other words, the test for the envelope tray switch 186*d*' being depressed is provided between the diamonds 214 and 220 in FIG. 16*a*. and only occurs if the tests for the upper and lower tray switches 186b' and 186c' being depressed are both negative. If the test of the envelope tray switch 186d' being depressed is positive, i.e., the envelope tray switch 186d' has been depressed and the upper and lower tray switches 186b' and 186c' have not been depressed, the reset, eject, and feed routine B is entered for the envelope tray 410. If the test of the envelope tray switch 186d' being depressed is negative, the paper feeding apparatus 400 then proceeds to test whether the reset switch 186a' is depressed, as indicated by the diamond 220 in FIG. 16a and as described hereinabove.

Assuming that the envelope tray switch 186d' has been depressed and that the upper and lower paper tray switches 186b' and 186c' have not been depressed, and the reset, eject, and feed routine B has been entered for the envelope tray 410, the paper feeding apparatus 400 then automatically checks to determine if any paper 16, 416 is left in the printing device 12, and if so, serves to eject the paper 16, 416 therefrom before feeding of envelopes 416 thereto. This is accomplished in the same manner as described hereinabove with respect to the first embodiment of the paper feeding apparatus 10. This routine of clearing of the printing device 12 is the same irrespective of whether the reset, eject and feed routine is entered for the upper paper tray 44, the lower paper tray 46 or the envelope paper tray 410, and consequently, it will not be described again. It should be noted in this regard that depressing of one of the paper tray switches 186b' 186c' or the envelope tray switch 186d' also sets a tray flag, which may typically comprise a flip-flop, and which serves to indicate which tray has been selected so that during the reset, eject and feed routine, paper will be fed from the appropriate paper storage tray 44, 46 or from the envelope storage tray 410. After the paper feeding apparatus 400 has been cleared of paper 16, 416, and if the apparatus 400 is not jammed, the paper feeding apparatus 400 proceeds to test whether the selected tray 44, 46, 410 is empty and then to take appropriate action.

In this regard, the particular tests and operation for feeding of envelopes 416 is slightly different from that for feeding of paper 16 from the upper and lower paper trays 44, 46. The nature of these differences will now be described with reference to FIG. 29. The routine illustrated by the flow diagram of FIG. 29 will be entered if the envelope tray switch 186d' has been depressed, as detected for example by detecting of the state of the flip-flop for the envelope tray 410. With reference to FIG. 16b, the test for whether the envelope tray 410 has been selected or whether one of the other paper trays 44, 46 has been selected will take place, assuming that the paper feeding apparatus 400 has not jammed, immediately following the clearing of the printing device 12 of paper 16, 416, i.e., at approximately the location of the exit for the reset mode indicated by the circular flag 365 which is intermediate the line 368 and the testing of whether the upper or lower paper tray 44, 46 is empty, indicated by the diamond 272.

Figure 29:
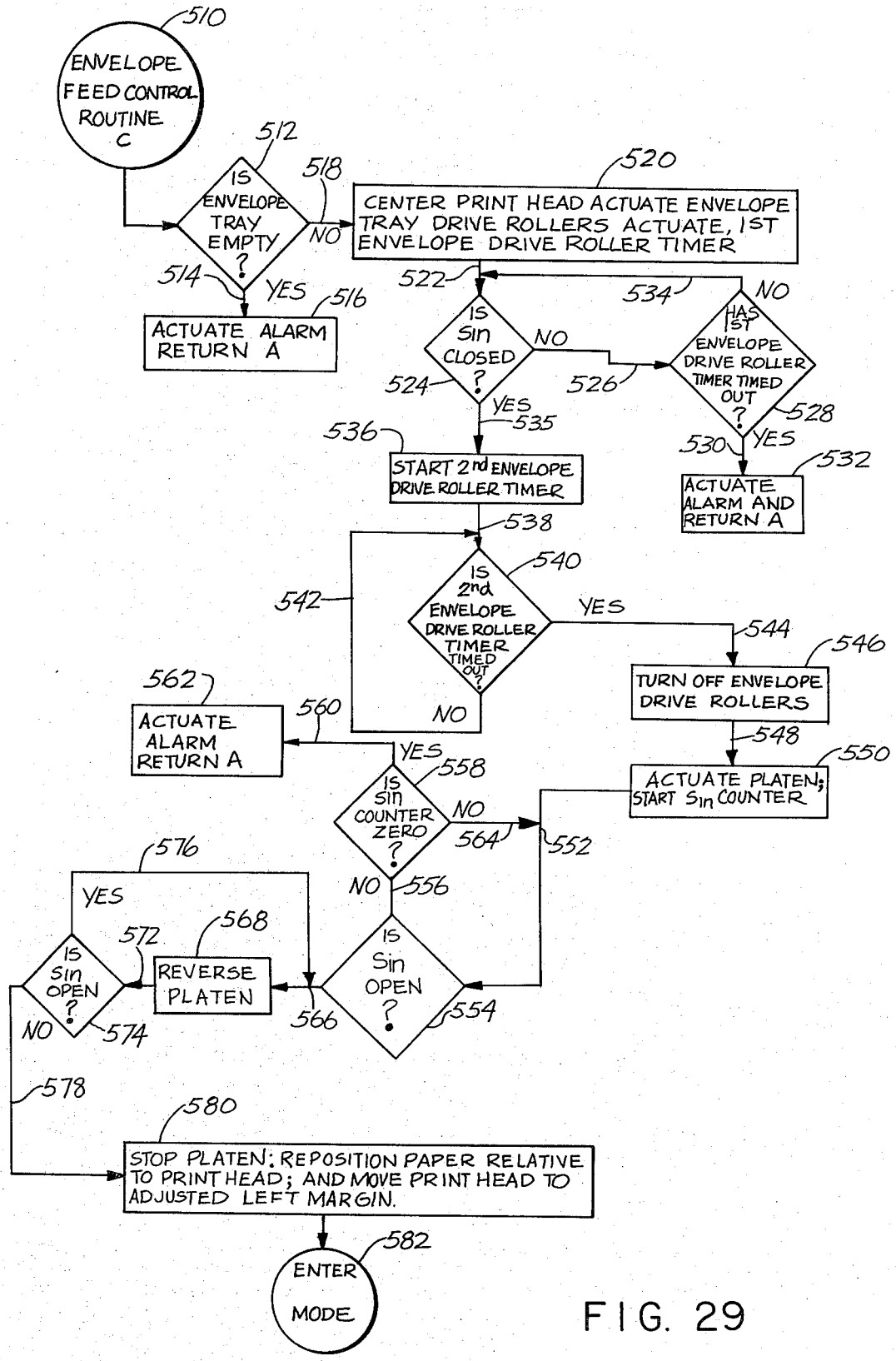
FIG. 29 is a schematic flow chart illustrating the modified algorithm for controlling operation of the paper feeding apparatus shown in FIG. 17 for feeding of envelopes.

Assuming that the envelope tray mode has been selected, the paper feeding apparatus 400 enters the envelope feed routine C (as indicated by the circular flag 510 and labeled "Envelope Feed Control Routine" in FIG. 29). When the envelope feed routine is entered, the paper feeding apparatus 400 initially tests whether the envelope tray 410 is empty, as indicated by the diamond 512. In this determination, if the envelope tray 410 is empty, an appropriate alarm is actuated as indicated by the arrow 514 and the rectangle 516, and the paper feeding apparatus returns to the routine A (200). As with the other alarms described hereinabove, the alarm may comprise lighting the envelope tray empty light 188d' and sounding a bell or buzzer to alert the operator.

If the envelope tray 410 is not empty, the paper feeding apparatus then generates a signal to center the print head 14 transversely with respect to the platen 18, again by utilizing the conventional commands of the printing device 12 for movement of the print head carriage, as indicated by the arrow 518 and the rectangle 520. If the print head 14 has already been centered (i.e., in the ejecting part of routine B, as indicated by the rectangle 230 or the rectangle 254 in FIG. 16b), this signal will simply be ignored.

Also, at this time, as indicated by the rectangle 520, the envelope tray drive rollers 414 are activated by actuation of the stepping motor 152 to rotate in the reverse direction. As noted above, this involves actuating the coils for the stepping motor 152 so as to drive the gear 149 in the reverse direction to thereby rotate the shaft 130 in a direction opposite to the direction of rotation for ejecting paper 16 from the printing device 12 (i.e., in a clockwise direction as viewed in FIG. 26 or in a counterclockwise direction as viewed in FIG. 28). Rotation of the shaft 130 in turn causes rotation of the gear 504 mounted on the shaft 430 for the envelope feed rollers 414 in a clockwise direction as viewed in FIG. 28. This rotation serves to positively couple the gear 504 to the envelope feed roller shaft 430 to rotate the feed rollers 414 in a envelope feed direction, i.e., in a clockwise direction as viewed in FIG. 28. Rotation of the feed rollers 414 serves to move the lowest envelope 416a in the stack of envelopes in the envelope tray 410 downwardly through the envelope feed slot 432 and paper passageway 412 to advance the envelope 416 into the paper feed path 100' toward the inlet end 106 of the platen 18. In this regard, as discussed more fully hereinabove, the width of the feed slot 432 is appropriately adjusted so that only one envelope 416 is fed downwardly through the feed slot 432. Also, when the stepping motor 152 is actuated in the reverse direction, a first envelope drive roller interval timer is started, as indicated by the rectangular 520. This timer may be similar to the $S_{in}$ timer and the first drive roller interval timer described hereinabove with reference to FIG. 16b, and performs a similar function with respect to the time of operation of the envelope drive rollers 414.

The next operation is to test the inlet sensor $S_{in}$ (170') to determine if it is closed. If the paper inlet sensor $S_{in}$ (170') does not close within a predetermined time after actuation of the stepping motor 152 being operated in a reverse direction, a fault alarm is sounded and the fault light 188a' is lit on the paper feeding apparatus 400 to indicated that the envelope 416 has not been fed from the envelope tray 410, or that the envelope 416 has jammed in the feed slot 432 or in the main paper feed path 100'. This test is accomplished by testing the inlet sensor $S_{in}$ (170') to determine whether or not it is closed, as indicated by the arrow 522 and diamond 524. If the inlet sensor has not closed, a test is made as to whether the first envelope drive roller interval timer has timed out, as indicated by the arrow 526 and diamond 528. If the first envelope drive roller interval timer has timed out, an alarm is actuated, as indicated by the arrow 530 and rectangle 532, and the paper feeding apparatus 400 returns to routine A. If the first envelope drive roller interval timer has not timed out, the paper feeding apparatus 400 again tests the inlet sensor $S_{in}$ (170') to determine whether it is closed, as indicated by the arrow 534 and diamond 524. This loop is continued until either the inlet sensor $S_{in}$ is closed or the first envelope drive roller interval timer has timed out. It will be appreciated that the interval or timing period for the first envelope drive roller interval timer is chosen to allow a sufficient time for the envelope 416 to be fed from the envelope tray 410 past the inlet sensor $S_{in}$ (170') if the envelope 416 does not become jammed. In this regard, it is noted that the interval or timing period for the first envelope drive roller timer will be shorter than the interval or timing period for the drive roller interval timers for the upper and lower paper trays 44, 46.

If the inlet sensor $S_{in}$ (170') closes within the predetermined period of time alotted for the first envelope drive roller interval timer, the envelope drive rollers 414 continue to rotate, and a second envelope drive roller interval timer is started as indicated by the arrow 535 and the rectangle 536. The second envelope drive roller interval timer is similar to the other timers utilized in the apparatus 400, and serves to define a predetermined period of time after which the envelope drive rollers 414 should be turned off. The timing interval should provide a sufficient time or a number of steps to ensure that the envelope 416 is positively fed into engagement with the platen 18, i.e., between the first pressure roller 19 at the paper receiving inlet 106 and the platen 18. Thus, in terms of the flow diagram of FIG. 29, the paper feeding apparatus 400 tests whether the second drive roller timer has timed out, as indicated by the arrow 538 and the diamond 540. This test is continuously repeated, as indicated by the arrow 542 until the second drive roller interval timer has timed out. When the second drive roller interval timer has timed out, as indicated by the arrow 544, the envelope tray rollers 44 are turned off, as indicated by the rectangle 546.

After the second envelope drive roller interval timer has timed out and the envelope drive rollers have stopped, the platen drive motor of the printing device 12 is actuated to begin driving the platen 18 to thereby move the envelope through the printing device 12, as indicated by the arrow 548 and the rectangle 550. This technique is slightly different from that described hereinabove for operation of the first embodiment of the paper drive apparatus 10 in that in the first embodiment rotation of the platen 18 is started before the paper feed rollers 72 stop whereas in the second embodiment, the platen 18 is only started after the envelope drive rollers 414 have stopped, in order to ensure that the envelope 416 is properly received by the platen 18. That is, the envelope drive rollers 414 serve to drive the leading edge of the envelope 416, across its entire width, into the platen 18. This may be important for feeding of envelopes 416 because the envelopes 416 are of a short length, in the paper feed direction, and thus may not be guided as well. Also, when the platen 18 is actuated, an inlet sensor counter ($S_{in}$ counter) is started, as indicated by rectangle 550. The $S_{in}$ counter is decremented each time the platen 18 is advanced, and should be set at an initial state corresponding to the number of discreet steps of the platen 18 after which the inlet sensor 170' should open if the envelope 416 is being properly moved by the platen 18.

This technique is also slightly different from that described hereinabove with reference to the operation of the first embodiment of the paper feeding apparatus 10 in that the paper feeding apparatus 400 of the second embodiment functions to detect the trailing edge of the envelope 416 for properly aligning the envelope 416 in the printing device 12, as opposed to detecting the leading edge of a sheet of paper 16 with the outlet sensor $S_{out}$ (172'). In this regard, as noted above, the outlet sensor $S_{out}$ (172') would be utilized for detecting the leading edge of a sheet of paper 16 fed from the paper trays 44, 46 in the second embodiment.

Once the envelope 416 is fed into the platen 18 and the platen 18 is actuated, the platen 18 continues to be driven to advance the envelope 416 until the trailing edge passes the inlet sensor $S_{in}$ (170'). In this regard, it is noted that the platen 18 is driven by using conventional commands of the printing device 12 for advancing the platen 18. Thus, in terms of an impact printing device 12 which incrementally advances paper, the paper 16 or envelope 416 is advanced incrementally during this feeding operation by simply directing the printing device 12 to advance the platen 18 a specified number of increments. For instance, the platen 18 may be advanced to move the envelope in ½ inch steps, as with the first embodiment of the paper feeding apparatus 10. For example, if each platen increment corresponds to 1/48 inch of movement of the paper, the platen 18 would be advanced twenty-four increments at a time in this operation.

After a predetermined number of increments of rotation of the platen 18 (depending on the size of the envelope 416) the trailing edge of the envelope 416 should move past the paper inlet sensor 170' at which time the inlet sensor $S_{in}$ (170') will open. If the inlet sensor $S_{in}$ (170') does not open within a predetermined number of increments of platen rotation (corresponding to the initial state of the $S_{in}$ counter), an alarm and fault signals are generated to alert the operator of a possible paper jam. This is accomplished by testing the inlet sensor $S_{in}$ (170') as indicated by the arrow 552 and diamond 554 after the platen 18 is actuated and the $S_{in}$ counter is actuated. If the inlet sensor $S_{in}$ is still closed, a test is made as to whether the $S_{in}$ counter is zero, as indicated by the arrow 556 and the diamond 558. If the $S_{in}$ counter is zero, an alarm is actuated as indicated by the arrow 560 and the rectangle 562, and the paper feeding apparatus 400 returns to routine A. In the preferred embodiment, the actuation of this alarm comprises sounding an alarm and lighting the light **188*a'*. If the $S_{in}$ counter is not zero, the inlet sensor 170' is again tested to determine whether it is open, as indicated by the arrow 564 and the diamond 554. This loop is continued until either the $S_{in}$ counter is zero, in which event an alarm is actuated, or until $S_{in}$ (170'**) is opened.

Once the paper inlet sensor $S_{in}$ (170') opens as a result of the trailing edge of the envelope 416 moving therepast, the platen 18 is controlled to move in the reverse direction to move the trailing edge of the envelope 416 slowly back until the inlet sensor $S_{in}$ (170') closes again. At this moment, the movement of the platen 18 is stopped (FIG. 22) with the trailing edge of the envelope 416 aligned with the paper inlet sensor $S_{in}$ (170'). This provides a fixed or known reference point for the purposes of aligning the envelope 416 relative to the print head 14 to begin printing. Specifically, as with the first embodiment in which the reference point is provided by the outlet sensor 172, by knowing the distance of the paper inlet sensor 170' from the print head 14, and the distance that the paper moves with each increment of the platen 18 advance or reverse, conventional printing commands can cause the envelope 416 to be moved to the proper print position for the first line of print by advancing or reversing the platen 18 the required number of increments. For instance, if the paper inlet sensor $S_{in}$ (170') is located 3½ inches from the print head 14, and the first line of print on the envelope is to be 4¾ inches from the trailing edge of the envelope 416, the platen would be reversed to move the paper 3¼ inches in the reverse direction. As is apparent, the overall length of the envelope must be known, or at least the distance that the first line of print is to be from the trailing edge of the envelope 416, in order to accomplish this operation.

The operation for aligning the envelope 416 for the start of printing is accomplished by reversing the platen 18 once the inlet sensor $S_{in}$ (170') opens, as indicated by the arrow 566 and rectangle 568. The platen 18 is reversed slowly, for example in one step increments, and the inlet sensor $S_{in}$ is again sensed to determine whether it is still open, as indicated by the arrow 572 and diamond 574. If the inlet sensor remains open, the platen 18 is again reversed one step, as indicated by the arrow 576 and rectangle 568. This operation is continued until the inlet sensor $S_{in}$ closes. At that moment, the platen 18 is stopped and the envelope 416 is then repositioned relative to the print head 14 by movement of the platen 18, as indicated by the arrow 578 and rectangle 580. Finally, the print head 14 is moved to the adjusted left margin of the envelope 416 as indicated by the rectangle 580. This is accomplished in the manner described hereinabove with reference to the first embodiment.

After the envelope 416 has been moved into the proper print position for the beginning of printing, and the print head 14 is then moved to the adjusted left margin of the envelope 416, the print mode is then entered as indicated by the circular flag 582, and the printing device proceeds in accordance with the program to print the material on the envelope 416. When the printing has been completed on the envelope 416, the printing device 12 is stopped, such as for example, by appropriate stop controls in the printing device 12. The paper feeding apparatus 400 will then automatically eject the envelope 416 when the next sheet of paper 16 or envelope 416 is called for by the operator pressing one of the paper tray switches **186*b'*, 186*c'*, 186*d'* or the reset control switch 186*a'*, in which event the reset, eject, and feed routine will again be entered. At this time, the envelope 416 will be ejected from the printing device 12 and stored in the wire basket 478** in a manner as described hereinabove.

As with the first embodiment of the paper feeding apparatus 10, the embodiment shown in FIGS. 17–29 is also capable of being used in conjunction with a stored text or material which includes appropriate codes for automatically feeding the paper from the upper and lower paper trays 44, 46 or the envelope tray 410, and which are coded to indicate the end of textual or address material to be printed.

As noted above, the envelope tray switch **186*d'* provided on the control panel 184' is provided in place of the mode switch. In order to accomplish the function served by the pressing of the mode switch 186*d* in the first embodiment, the program or algorithm in the second embodiment could be modified in an appropriate manner to detect depression of a combination of several of the tray switches 186*b'*, 186*c'*, 186*d'* or continuous depression of one of the switches 186*a–d'* for a specified period of time. For example, the reset switch 186*a'* could be depressed until an alarm is actuated, such as for example, a buzzer or bell, and then, when the reset switch 186*a'* is released, to enter the print mode with the feeder 400 transparent, similar to entering of the print mode upon depression of the mode switch 186*d*** in the first embodiment.

The manual feed mode for manually feeding of single sheets of paper 16 or envelopes 416 without having to remove the paper feeding apparatus 400 from the printing device 12 may simply be entered by removing the envelope tray 410 and placing a sheet of paper 16 or envelope 416 through the feed slot 432 to be in front of the inlet sensor 170'. No tray switches 186' need be depressed; rather, the paper feeding apparatus 400 simply detects the presence of a sheet of paper in front of the inlet sensor 170' and the absence of any tray switch 186' being depressed, and then places the paper feeding apparatus 400 in a manual feed mode. More particularly, to manually feed sheets of paper 16 or envelopes 416, the envelope tray 410 would be removed to provide access to the feed slot 432 defined between the feed rollers 414 and the deflector plate 96'. This slot 432, similar to slot 190 provided in the first embodiment of the apparatus 10, thus provides communication with the paper feed path 100' to the platen 18 at a position in the paper feed path 100' below the lower paper tray 46. When the sheet of paper 16 or nonstandard sheet of paper is placed in front of the sensor 170', the paper feeding apparatus 400 will be in the manual feed mode. The paper is then positioned or aligned with the printing device 12 by manual operation of the platen 18. The paper is now positioned for printing on the page directly with the use of word processing printing commands.

Accordingly, the embodiment of the paper feeding apparatus 400 as shown in FIGS. 17–29, is operable to not only feed single sheets of paper or stationary 16 to the printing device 12, but also is operable to automatically feed envelopes 416 to the printing device 12 which are provided in a tray 410 supported on the deflector plate 96' on the surface 105' opposite from the surface 104' which serves to deflect sheets of paper 16 into the paper feed path 100'. In this regard, the position of the inlet sensor $S_{in}$ 170', the size of the deflector plate 96', and the exit guide plate member 420 are slightly modified, and envelope feed rollers 414 provided for defining a paper feed slot 432 in conjunction with the deflector plate 96'. An envelope feed tray 410 is supported on the deflector plate 96' and includes an opening 470 in the lower end thereof for feeding of envelopes 416 which are engaged by the envelope feed rollers 414 through the feed slot 432 and into the paper feed path 100' upon appropriate actuation or commands to feed envelopes 416. The size of the feed slot 432 may be adjusted to ensure that only one envelope 416 is fed at a time upon actuation of the envelope feed rollers 414.

Still further, in the embodiment of the paper feeding apparatus 400 shown in FIGS. 17–29, the arrangement of the ejection rollers 128', 132' has been slightly modified, and a receptacle means 478 has been provided which is supported forwardly thereof so that sheets of paper 16 and envelopes 416 are automatically directed into the receptacle means 478 as they exit from the printing device 12. For this purpose, a pivotable deflector bar 490 is provided in the exit guide plate member 420 which has an intermediate bar portion **492*a* in the path of movement 160 of the paper which exits from the printing device 12, and which intermediate portion 492*a* may be pivoted out of the path of the movement 160 of the paper 16 when engaged by the paper 16 moving along the exit path 160. The deflector bar 490 is pivotable downwardly by means of gravity when the paper 16 is released by the ejection rollers 128', 132' to direct the paper 16 or envelopes 416 into the paper receptacle means 478**.

A still further feature of the embodiment shown in FIGS. 17–29 comprises utilization of the stepping motor 152 for operating the envelope feed rollers 414 by reverse rotation of the stepping motor 152. The envelope feed rollers 414 are coupled to the ejection rollers 128' so as to rotate therewith when the stepping motor 152 is rotated in the reverse direction, but to be decoupled from rotation with the ejection rollers 128' when the ejection rollers 128' are rotated in a eject direction. This latter feature provides for compactness and simplification of the apparatus 400 for feeding of sheets of paper 16 and envelopes 416.

While the preferred embodiments of the present invention have been shown and described, it will be understood that such is merely illustrative and that changes may be made without departing from the scope of the invention as claimed.

```
*
*
*
*****************************************************
*****************************************************
**                                                 *
**                                                 *
**                    FEEDER                       *
**                                                 *
**                SYSTEM SOFTWARE                  *
**                                                 *
**                SEPTEMBER 1979                   *
**                                                 *
**                                                 *
**                                                 *
**                                                 *
**            COPYRIGHT ZIYAD 9-5-79               *
**                                                 *
*****************************************************
*****************************************************
```

APPENDIX A

```
                        *
        0104    PIA     EQU     $0104
0000                    ORG     $0000
                        *
0000    0002            RMB     2       RESERVE FOR SOFTWARE TESTING
0002    0001    MODE    RMB     1       FEEDER CONTROL MODE
                        *
                        * / BSY / EJ / DLO / DUP // MLO / MUP / MAN / FRONT/
                        *
0003    0001    PSTAT   RMB     1       PRINTER STATUS  FF=BUSY
                        *
                        */ BSY / 6 /   /   //   / 2 /   / 0 /
                        *
                        * BIT0 SET=PRINTING FROM INTERNAL MEMORY.
                        * BIT2 SET=OUTPUT CARRIAGE & PLATEN DATA ONLY.
                        * BIT6 SET=INPUT READY.
                        *
0004    0001    CSTAT   RMB     1       CONTROL LINE STATUS
0005    0001    CNTR1   RMB     1
0006    0001    CNTR2   RMB     1
0007    0001    CNTR3   RMB     1
0008    0002    XPIA    RMB     2       BASE PIA ADDRESS
000A    0002    CPOS    RMB     2       ABSOLUTE CARRIAGE POSITION
000C    0002    LPOS    RMB     2       ASSUMED CARRIAGE POSITION BY
000E    0002    FPOS    RMB     2       FEED POSITION (PLATEN)
0010    0001    RTF     RMB     1       1=RESTORE, 2=TOF FLAG
0011    0001    CMND    RMB     1       COMMAND BUFFER
0012    0001    FLT     RMB     1       FAULT FLAG
```

```
00053 0013 0002     RMP    RMB    2          READ MEMORY POINTER
00054 0015 0002     WMP    RMB    2          WRITE MEMORY POINTER
00055 0017 0002     TABS   RMB    2          TABLE POINTER SAVE (STEP)
00056 0019 0002     TEMP   RMB    2          TEMPARARY SAVE AREA
00057 001B 0001     BUF    RMB    1          TEXT BUFFER BEGINNING
00058 7000                 ORG    $7000
00060                  *
00061                  *
00062 7000 8E 007F  START  LDS    #$7F       STACK POINTER
00063 7003 30              TSX
00064 7004 4F              CLR A
00065 7005 A7 00    ST0    STA A  0,X
00066 7007 09              DEX
00067 7008 26 FB           BNE    ST0        CLEAR RAM
00068 700A CE 001B         LDX    #BUF
00069 700D DF 13           STX    RMP
00070 700F DF 15           STX    WMP
00071 7011 CE 0104         LDX    #PIA       PIA BASE
00072 7014 4A              DEC A             A=FF
00073 7015 97 10           STA A  RTF        SET NEG TO IGNORE DATA
00074 7017 97 04           STA A  CSTAT      INIT CONTROL LINE STATUS
00075 7019 C6 3D           LDA B  #$3D       PA0-7 AS OUTPUTS, NO PULSE TO
00076 701B E7 05           STA B  5,X
00077 701D A7 04           STA A  4,X
00078 701F 6F 05           CLR    5,X        NO PULSE TO GROUND
00079 7021 A7 04           STA A  4,X
00080 7023 E7 05           STA B  5,X        STATUS ENABLE, CA2
00081                  *
00082 7025 C6 04           LDA B  #$4        MOTOR OUTPUTS, NO PULSE TO GN
00083 7027 E7 01           STA B  1,X
00084 7029 A7 00           STA A  0,X
00085 702B 6F 01           CLR    1,X
00086 702D A7 00           STA A  0,X
00087 702F C6 3F           LDA B  #$3F
00088 7031 E7 01           STA B  1,X        SW INT. & FAULT OFF
00089                  *
00090 7033 C6 3F           LDA B  #$3F
00091 7035 E7 03           STA B  3,X        PRL READY INT & LAMP OFF
00092 7037 C6 1F           LDA B  #$1F
00093 7039 E7 07           STA B  7,X        "INPUT" INT.
00094 703B 86 10           LDA A  #$10
00095 703D 97 02           STA A  MODE       INIT. TO UPPER TRAY
00096 703F 8D 5C           BSR    RSTAT
00097 7041 26 FC           BNE    *-2
00098 7043 BD 7104         JSR    READY
00099 7046 A6 02           LDA A  2,X        CLR ANY INT FLAGS
00100 7048 A6 04           LDA A  4,X
00101 704A A6 06           LDA A  6,X
00102                  *
00103                  *
00104                  *
00105 704C 0E      WAIT    CLI
00106 704D 3E              WAI
00107 704E 20 FC           BRA    WAIT

00109                  *** INTERRUPT SERVICE ROUTINE ***
00110                  *
00111 7050 CE 0104 INT     LDX    #PIA
00112 7053 DF 08           STX    XPIA
00113 7055 A6 07           LDA A  7,X        INPUT READY
00114 7057 2B 10           BMI    XIN
00115 7059 48              ASL A
00116 705A 2B 5A           BMI    RESTOF
00117 705C A6 03           LDA A  3,X        PRINTER READY
00118 705E 2B 0F           BMI    PRLRDY
```

```
7060 A6 05          LDA A  5,X       "CHECK" FROM PRINTER
7062 2B 32          BMI    PRLCK
7064 A6 01          LDA A  1,X
7066 2B 04          BMI    XSW       MANUAL SWITCH INPUT
7068 3B             RTI
                *
7069 7E 73A0    XIN     JMP    INPUT
706C 7E 710D    XSW     JMP    SWITCH
                *
                *
706F A6 02      PRLRDY  LDA A  2,X       CLEAR INT
7071 D6 02              LDA B  MODE
7073 2B 20              BMI    P3        FEEDER BUSY
7075 96 03              LDA A  PSTAT
7077 44                 LSR A            TEST BIT0
7078 25 1B              BCS    P3
707A 48                 ASL A
707B 23 15              BMI    P2
707D 96 10              LDA A  RTF
707F 48                 ASL A
7080 25 0C              BCS    P1
7082 17                 TBA
7083 C4 3F              AND B  #$3F
7085 D7 02              STA B  MODE
7087 85 0C              BIT A  #$C       CHECK MANUAL LOAD
7089 26 0A              BNE    P3
708B 7E 73B0            JMP    INP3
708E 44         P1      LSR A
708F 97 10              STA A  RTF
7091 3B                 RTI
7092 7F 0003    P2      CLR    PSTAT
7095 3B         P3      RTI
                *
                *
7096 A6 04      PRLCK   LDA A  4,X       PRINTER "CHECK"
7098 86 DF              LDA A  #$DF
709A A7 04              STA A  4,X       PASS "CHECK" TO HOST
709C 3B                 RTI

                *
                *
                * STATUS BITS
                * / DR / FR / CR / CK //     / AUX / TOF / RESTORE
                *
709D C6 35      RSTAT   LDA B  #$35      READ PRINTER STATUS
709F E7 05              STA B  5,X       CA2 LOW
70A1 A6 06              LDA A  6,X       READ
70A3 C6 3D              LDA B  #$3D
70A5 E7 05              STA B  5,X       CA2 HI
70A7 16                 TAB
70A8 84 F0              AND A  #$F0
70AA 81 10              CMP A  #$10
70AC 39                 RTS
                *
70AD 86 05      DUMP    LDA A  #5
70AF 9A 03              ORA A  PSTAT
70B1 97 03              STA A  PSTAT
70B3 7E 7456            JMP    INP10
                *
70B6 A6 06      RESTOF  LDA A  6,X       CLEAR INT
70B8 4F                 CLR A
70B9 97 0E              STA A  FPOS
70BB 97 0F              STA A  FPOS+1    CLEAR LINE FEED COUNT
70BD 8D EE              BSR    DUMP
70BF 96 02              LDA A  MODE
70C1 85 02              BIT A  #2
```

```
00185 70C3 26 04          BNE    *+6
00186 70C5 C6 01          LDA B  #$1
00187 70C7 D7 10          STA B  RTF
00188 70C9 8D D2          BSR    RSTAT     READ STATUS
00189 70CB 54             LSR B
00190 70CC 54             LSR B
00191 70CD 25 65          BCS    TOF
00192                *
00193 70CF 86 FF     RESTOR LDA A  #$FF
00194 70D1 16             TAB
00195 70D2 A7 04          STA A  4,X       PA0-7 ALL HIGH
00196 70D4 A7 00          STA A  0,X
00197 70D6 96 02          LDA A  MODE
00198 70D8 16             TAB
00199 70D9 84 02          AND A  #2
00200 70DB 8A 10          ORA A  #$10
00201 70DD 97 02          STA A  MODE      UPDATE MODE
00202 70DF 54             LSR B
00203 70E0 24 03          BCC    *+5
00204 70E2 7E 72DB        JMP    S11       FRONT LOAD MODE
00205 70E5 C5 06          BIT B  #6        "B" SHIFTED, CK FOR LOCAL FEE
00206 70E7 27 06          BEQ    *+8
00207 70E9 7F 0010        CLR    RTF
00208 70EC 7E 732F        JMP    L2
00209 70EF 4F             CLR A
00210 70F0 97 0A          STA A  CPOS
00211 70F2 97 0B          STA A  CPOS+1
00212 70F4 17             TBA
00213 70F5 BD 735E        JSR    DOUT
00214 70F8 86 FE          LDA A  #$FE
00215 70FA BD 737E        JSR    STROBE    RESTORE PRINTER
00216 70FD 8D 9E     RE1  BSR    RSTAT
00217 70FF 26 FC          BNE    RE1
00218 7101 8D 01          BSR    READY
00219 7103 3B             RTI
00220                *
00221 7104 86 7F     READY LDA A  #$7F      PA7 LOW, RESET INPUT LATCHES
00222 7106 A7 04          STA A  4,X
00223 7108 96 04          LDA A  CSTAT
00224 710A A7 04          STA A  4,X
00225 710C 39             RTS
00226                *
00227 710D A6 00     SWITCH LDA A  0,X       CLR INT
00228 710F BD 74C0        JSR    BEMTY
00229 7112 86 FF          LDA A  #$FF
00230 7114 A7 04          STA A  4,X       MAKE FEEDER BUSY
00231 7116 C6 14          LDA B  #20
00232 7118 BD 722B        JSR    RDELAY    SW BOUNCE
00233 711B A6 00          LDA A  0,X       CLEAR INT AGAIN
00234 711D 96 02          LDA A  MODE
00235 711F 2B 44          BMI    M3
00236 7121 84 32          AND A  #$32
00237 7123 97 02          STA A  MODE
00238 7125 E6 02          LDA B  2,X       FEEDER SW & SENSOR
00239 7127 54             LSR B
00240 7128 24 3C          BCC    UPPER
00241 712A 54             LSR B
00242 712B 24 48          BCC    LOWER
00243 712D 54             LSR B
00244 712E 24 23          BCC    MODESW
00245 7130 54             LSR B
00246 7131 24 08          BCC    RESET
00247 7133 3B             RTI
00248                *
00249 7134 C6 02     TOF  LDA B  #2
```

```
00250 7136 D7 10          STA B  RTF
00251 7138 8D CA          BSR    READY
00252 713A 3B             RTI
00253                 *
00254 713B 96 02  RESET   LDA A  MODE
00255 713D 84 32          AND A  #$32
00256 713F 97 02          STA A  MODE
00257 7141 96 12          LDA A  FLT
00258 7143 26 08          BNE    RESF
00259 7145 C5 0C          BIT B  #$C
00260 7147 27 86          BEQ    RESTOR
00261 7149 86 40          LDA A  #$40
00262 714B 20 3D          BRA    EJ1
00263                 *
00264 714D 7F 0012 RESF   CLR    FLT
00265 7150 7E 7252        JMP    FA2
00266 7153 85 02  MODESW  BIT A  #2
00267 7155 27 06          BEQ    M1        SWITCH TO MANUAL MODE
00268 7157 84 FD          AND A  #$FD      SET-UP FOR AUTO MODE
00269 7159 C6 3F          LDA B  #$3F
00270 715B 20 04          BRA    M2
00271                 *
00272 715D 8A 02  M1      ORA A  #2
00273 715F C6 37          LDA B  #$37
00274 7161 97 02  M2      STA A  MODE
00275 7163 E7 03          STA B  3,X       UPDATE CRA
00276 7165 3B     M3      RTI
00277                 *
00278                 *
00279 7166 86 04  UPPER   LDA A  #4
00280 7168 C5 01          BIT B  #1        CHECK BOTH UPPER & LOWER
00281 716A 26 05          BNE    LOWER+2
00282 716C 86 01          LDA A  #1
00283 716E 9A 02          ORA A  MODE
00284 7170 97 02          STA A  MODE      SET FRONT LOAD
00285 7172 8D 2E          BSR    CENT
00286 7174 3B             RTI
00287                 *
00288 7175 86 08  LOWER   LDA A  #8
00289 7177 C5 08          BIT B  #$8
00290 7179 26 03          BNE    *+5
00291 717B 7E 723B        JMP    FAULT     TRAY EMPTY
00292                 *
00293 717E D6 02  EJECT   LDA B  MODE
00294 7180 C5 02          BIT B  #2
00295 7182 26 E1          BNE    M3        IGNORE IF MANUAL
00296 7184 C6 80          LDA B  #$80
00297 7186 DA 03          ORA B  PSTAT
00298 7188 D7 03          STA B  PSTAT     MAKE PRINTER BUSY
00299 718A 8A 80  EJ1     ORA A  #$80
00300 718C 9A 02          ORA A  MODE
00301 718E 97 02          STA A  MODE      UPDATE MODE
00302 7190 C6 FF          LDA B  #$FF
00303 7192 E7 04          STA B  4,X       ALL PA0-7 BITS HIGH
00304 7194 44             LSR A
00305 7195 25 02          BCS    *+4       ALREADY AT CENTER
00306 7197 8D 09          BSR    CENT
00307 7199 A6 02          LDA A  2,X
00308 719B 85 C0          BIT A  #$C0
00309 719D 26 20          BNE    S3
00310 719F 7E 7260        JMP    S4
00311                 *
00312                 *CENTER CARRIAGE AND SELECT PAPER TRAY.
00313                 *
00314 71A2 DE 0A  CENT    LDX    CPOS
```

```
71A4 DF 0C          STX     LPOS     SAVE POS. DEFINED BY HOST
71A6 86 0A          LDA A   #$A      ABSOLUTE CENTER
71A8 C6 03          LDA B   #3
71AA 90 0B          SUB A   CPOS+1
71AC D2 0A          SBC B   CPOS
71AE 2A 05          BPL     S1
71B0 BD 72FF        JSR     S12A
71B3 CB 08          ADD B   #8
71B5 CE 030A  S1    LDX     #$30A
71B8 DF 0A          STX     CPOS
71BA DE 08          LDX     XPIA
71BC 7E 7358        JMP     SLEW     MOVE CARRIER TO CENTER
                *
                * ROUTINE TO EJECT PAPER
                *
71BF C6 14    S3    LDA B   #20
71C1 8D 58          BSR     RDELAY
71C3 86 80          LDA A   #$80
71C5 C6 04          LDA B   #$4
71C7 90 0F          SUB A   FPOS+1
71C9 D2 0E          SBC B   FPOS
71CB 2A 03          BPL     *+5
71CD 5F             CLR B
71CE 86 20          LDA A   #$20
71D0 5C             INC B
71D1 D7 0E          STA B   FPOS     SAVE FOR DELAY COUNT
71D3 BD 737A        JSR     PLATEN
71D6 C6 D0          LDA B   #$D0
71D8 8D 51          BSR     RDELAY   WAIT FOR PLATEN
71DA 7A 000E        DEC     FPOS
71DD 26 F7          BNE     *-7
71DF 86 3F          LDA A   #$3F
71E1 A7 00          STA A   0,X      MOTOR AND SOLENOID "ON"
71E3 C6 0A          LDA B   #$A
71E5 8D 19          BSR     STEP
71E7 5A             DEC B
71E8 26 FB          BNE     *-3
71EA 5A             DEC B            B=$FF
71EB E7 00          STA B   0,X      MOT & SOL "OFF"
71ED A6 02          LDA A   2,X      READ SENSORS
71EF 85 C0          BIT A   #$C0     BOTH "IN" & "OUT" MUST BE CLE
71F1 26 48          BNE     FAULT
71F3 96 02          LDA A   MODE
71F5 85 40          BIT A   #$40     CHECK EJECT ONLY
71F7 27 67          BEQ     S4
71F9 7E 7305        JMP     LAST
                *
                *
71FC 06       TAB   FCB     $6,$5,$9,$A
                *
7200 37       STEP  PSH B
7201 C6 06          LDA B   #$6
7203 D7 06          STA B   CNTR2
7205 CE 71FC        LDX     #TAB
7208 B6 0104  ST1   LDA A   PIA      CURRENT PIA STATUS
720B 84 F0          AND A   #$F0
720D AB 00          ADD A   0,X
720F DF 17          STX     TABS
7211 B7 0104        STA A   PIA
7214 86 60          LDA A   #$60
7216 C6 02          LDA B   #2
7218 8D 11          BSR     RDELAY
721A DE 17          LDX     TABS
721C 08             INX
721D 8C 7200        CPX     #TAB+4
```

```
00381 7220 26 E6          BNE    ST1
00382 7222 7A 0006        DEC    CNTR2
00383 7225 26 DE          BNE    ST1-3
00384 7227 DE 08          LDX    XPIA
00385 7229 33             PUL B
00386 722A 39             RTS
00387                *
00388                *
00389 722B 36        RDELAY PSH A
00390 722C 37               PSH B
00391 722D 30               TSX            SP+1 TO X
00392 722E 6A 01     R11    DEC    1,X     DEC "A"
00393 7230 26 FC            BNE    R11
00394 7232 6A 00            DEC    0,X     DEC "B"
00395 7234 26 F8            BNE    R11
00396 7236 31               INS
00397 7237 31               INS
00398 7238 DE 08            LDX    XPIA
00399 723A 39               RTS
00400                *
00401                *
00402 723B 86 10     FAULT  LDA A  #$10
00403 723D 97 02            STA A  MODE
00404 723F 86 FF            LDA A  #$FF
00405 7241 97 12            STA A  FLT     SET FAULT FLAG
00406 7243 A7 00            STA A  0,X     ALL MOTOR POWER "OFF"
00407 7245 86 BF            LDA A  #$BF
00408 7247 A7 04            STA A  4,X     MAKE RIBBON OUT ACTIVE
00409 7249 86 37     FA1    LDA A  #$37
00410 724B A7 01            STA A  1,X     ALARM ON
00411 724D C6 40            LDA B  #$40
00412 724F 0E               CLI
00413 7250 8D D9            BSR    RDELAY
00414 7252 86 3F     FA2    LDA A  #$3F
00415 7254 A7 01            STA A  1,X     ALARM OFF
00416 7256 C6 40            LDA B  #$40
00417 7258 8D D1            BSR    RDELAY
00418 725A 0F               SEI
00419 725B 96 12            LDA A  FLT
00420 725D 26 EA            BNE    FA1
00421 725F 3B               RTI
00422                *
00423                *
00424 7260 96 02     S4     LDA A  MODE
00425 7262 85 0C            BIT A  #$C
00426 7264 27 02            BEQ    *+4
00427 7266 48               ASL A
00428 7267 48               ASL A
00429 7268 84 30            AND A  #$30
00430 726A A5 02            BIT A  2,X
00431 726C 27 CD            BEQ    FAULT
00432 726E 43               COM A
00433 726F A4 00            AND A  0,X
00434 7271 A7 00            STA A  0,X     ENABLE MOTOR
00435 7273 C6 05            LDA B  #5
00436 7275 D7 07            STA B  CNTR3
00437 7277 C6 20            LDA B  #$20
00438 7279 BD 7200   S5     JSR    STEP
00439 727C 5A               DEC B
00440 727D 27 0C            BEQ    FAULT
00441 727F A6 02            LDA A  2,X     READ PRINTER STATUS
00442 7281 85 40            BIT A  #$40    CHECK "IN"
00443 7283 27 F4            BEQ    S5
00444 7285 85 80            BIT A  #$80    CHECK "OUT"
00445 7287 26 1C            BNE    S7
```

```
72B9 37                PSH B
72BA C6 80             LDA B  #$80
72BC EA 00             ORA B  0,X
72BE E7 00             STA B  0,X       SOL. OFF
72C0 3F                CLR B
72C1 86 30             LDA A  #$30
72C3 BD 737A           JSR    PLATEN    INCREMENT PLATEN
72C6 7A 0007           DEC    CNTR3
72C9 2A 07             BPL    S6
72CB C6 35             LDA B  #$35
72CD BD 8C             BSR    RDELAY    WAIT FOR PLATEN
72CF 33                PUL B
72D0 20 DA             BRA    S5+3
                *
72D2 33         S6     PUL B
72D3 20 D4             BRA    S5
                *
72D5 86 FF      S7     LDA A  #$FF
72D7 A7 00             STA A  0,X       ALL MOTORS OFF
72D9 A6 02      S8     LDA A  2,X       FEEDER STATUS
72DB 85 80             BIT A  #$80      CHECK "OUT"
72DD 27 0F             BEQ    S10
72DF 86 02             LDA A  #2
72E1 C6 08             LDA B  #8
72E3 BD 737A           JSR    PLATEN    1 REV STEP
72E6 4F                CLR A
72E7 C6 0D             LDA B  #$D
72E9 BD 722B           JSR    RDELAY
72EC 20 EB             BRA    S8
                *
72EE 86 40      S10    LDA A  #$40
72F0 C6 08             LDA B  #8
72F2 BD 737A           JSR    PLATEN    FINAL TOF POSITION
72F5 C6 02             LDA B  #2
72F7 BD 722B           JSR    RDELAY    SHORT WAIT
72FA 96 02             LDA A  MODE
72FC 85 0C             BIT A  #$C       CHECK MANUAL FEED
72FE 27 06             BEQ    *+8
7300 96 0D             LDA A  LPOS+1    CHECK FOR ZERO
7302 26 31             BNE    LAST
7304 20 05             BRA    S11
7306 96 10             LDA A  RTF       1=RESTORE RECEIVED
7308 44                LSR A
7309 24 2A             BCC    LAST      RTN TO LAST CARRIAGE POSITION
                *
                * RETURN CARRIAGE TO ABSOLUTE POSITION $13E
                *
730B 86 CC      S11    LDA A  #$CC
730D C6 01             LDA B  #1
730F 90 0D             SUB A  LPOS+1
7311 D2 0C             SBC B  LPOS      POSITION ERROR
7313 8D 14             BSR    S12       NEG VALUE = POS > $13E
7315 8D 71             BSR    SLEW
7317 86 3E             LDA A  #$3E
7319 C6 01             LDA B  #1
731B 9B 0D             ADD A  LPOS+1
731D D9 0C             ADC B  LPOS      CARRIAGE MAY BE INDENTED
731F 97 0B             STA A  CPOS+1
7321 97 0D             STA A  LPOS+1
7323 D7 0A             STA B  CPOS
7325 D7 0C             STA B  LPOS
7327 20 1E             BRA    L1
                *
7329 2B 04      S12    BMI    S12A
732B CB 08             ADD B  #8        DIRECTION BIT
```

```
20511 72FD 20 05          BRA    S12B
20512 72FF 53      S12A   COM B
20513 7300 40             NEG A
20514 7301 25 01          BCS    S12B
20515 7303 5C             INC B
20516 7304 39      S12B   RTS
20517                 *
20518                 *
20519                 * RETURN CARRIAGE TO LAST ACTIVE PRINT POSTITION
20520                 *
20521 7305 96 0B   LAST   LDA A  CPOS+1
20522 7307 D6 0A          LDA B  CPOS
20523 7309 90 0D          SUB A  LPOS+1
20524 730B D2 0C          SBC B  LPOS
20525 730D 8D EA          BSR    S12       NEG VALUE = POS > THAN CENTER
20526 730F DE 0C   L0     LDX    LPOS
20527 7311 DF 0A          STX    CPOS
20528 7313 DE 08          LDX    XPIA
20529 7315 8D 41          BSR    SLEW
20530 7317 4F      L1     CLR A
20531 7318 97 03          STA A  PSTAT
20532 731A 97 10          STA A  RTF       CLEAR FLAG
20533 731C 96 02          LDA A  MODE
20534 731E 16             TAB
20535 731F 84 3F          AND A  #$3F
20536 7321 97 02          STA A  MODE
20537 7323 C5 0C          BIT B  #$C       CHECK MANUAL FEED
20538 7325 27 04          BEQ    *+6
20539 7327 BD 7104        JSR    READY
20540 732A 3B             RTI
20541 732B C5 40          BIT B  #$40      CHECK FOR EJECT ONLY
20542 732D 26 05          BNE    *+7
20543 732F BD 7456 L2     JSR    INP10
20544 7332 20 7C          BRA    INP3
20545 7334 BD 7104        JSR    READY
20546 7337 A6 06          LDA A  6,X
20547 7339 7A 0010        DEC    RTF
20548 733C 7E 73C8        JMP    INP5
20549                 *
20550                 *
20551                 *
20552                 ****              SUBROUTINES              ****
20553                 *
20554                 *
20555                 *
20556                 *READ INPUT LATCHES, RETURN WITH "A"=LO DATA BYTE,
20557                 *"B"=HI DATA & STROBE INFO.
20558                 *
20559 733F A6 04   READ   LDA A  4,X
20560 7341 36             PSH A
20561 7342 84 FD          AND A  #$FD
20562 7344 A7 04          STA A  4,X       PA1 ON
20563 7346 E6 06          LDA B  6,X       READ LO BYTE LATCH
20564 7348 8A 02          ORA A  #2
20565 734A 84 FE          AND A  #$FE
20566 734C A7 04          STA A  4,X       PA0 ON
20567 734E 32             PUL A
20568 734F 37             PSH B
20569 7350 E6 06          LDA B  6,X       READ HI BYTE LATCH
20570 7352 A7 04          STA A  4,X       RESTORE PA07
20571 7354 32             PUL A
20572 7355 43             COM A
20573 7356 53             COM B
20574 7357 39             RTS
```

```
*
SLEW    BSR     DOUT
        LDA A   #$DF
        BRA     STROBE
*
*
*
*DATA OUT  (DOUT)
*CONFIGURE PB0-7 AS OUTPUTS AND LOAD LATCH.
*LEAVE .PB0-7 AS OUTPUTS. STROBE ROUTINE
*PULSES SELECTED LINE & RETURNS PB0-7 TO INPUT
*
*
DOUT    PSH A
        CLR A
        STA A   7,X         ZERO CRA
        DEC A               "A" = $FF
        BSR     CONF        PB0-7 AS OUTPUTS
        TBA
        COM A               HI BYTE DATA
        LDA B   #$F7
        BSR     PA07
        PUL A
        COM A               LO BYTE DATA
        LDA B   #$FB
PA07    STA A   6,X
        LDA A   4,X         PA0-7 STATUS
        AND B   4,X
        STA B   4,X
        STA A   4,X         RESTORE STATUS
        RTS
*
*
PLATEN  BSR     DOUT
        LDA A   #$BF
*
*
STROBE  LDA B   #$EF        "A"=STROBE BIT, "B" PUTS PA4
        BSR     PA07
        LDA B   #$80
        ORA B   PSTAT
        STA B   PSTAT
STR     CLR A
        STA A   7,X
CONF    SEI
        STA A   6,X         CONFIGURE PB0-7
        LDA A   #$1F
        STA A   7,X         CRA
        RTS
*
*
*
STORE   LDX     WMP         STORE DATA
        STA B   0,X
        INX
        STA A   0,X
        INX
        STX     WMP
        LDX     XPIA
        RTS
*
*
INPUT   LDA A   6,X         CLEAR INT
        LDA A   PSTAT       PRINTER STATUS
```

```
00639 73A4 2A 04          BPL    INP2
00640 73A6 44             LSR A
00641 73A7 97 03   INP1   STA A  PSTAT    $40 = INPUT READY
00642 73A9 3B             RTI
00643 73AA 27 04   INP2   BEQ    INP3
00644 73AC 84 40          AND A  #$40
00645 73AE 20 F7          BRA    INP1
00646 73B0 8D 8D   INP3   BSR    READ
00647 73B2 36             PSH A
00648 73B3 96 02          LDA A  MODE     CHECK MANUAL MODE
00649 73B5 85 02          BIT A  #2
00650 73B7 32             PUL A
00651 73B8 26 0E          BNE    INP4
00652 73BA C5 80          BIT B  #$80     TEST FOR CHARACTER
00653 73BC 27 15          BEQ    INP7
00654 73BE 7D 0010        TST    RTF
00655 73C1 26 0C          BNE    INP6     SAVE FIRST NON CHAR COMMANDS
00656 73C3 7D 0005        TST    CNTR1
00657 73C6 26 07          BNE    INP6
00658 73C8 BD 746A INP4   JSR    INP11
00659 73CB BD 7104 INP5   JSR    READY
00660 73CE 3B             RTI
00661 73CF 8D C2   INP6   BSR    STORE    STORE DATA
00662 73D1 20 F8          BRA    INP5
00663              *
00664              *
00665 73D3 81 5E   INP7   CMP A  #$5E     PROCESS CHARACTER
00666 73D5 27 29          BEQ    INP7B
00667 73D7 7D 0005        TST    CNTR1
00668 73DA 26 46          BNE    INP8
00669 73DC 7D 0010        TST    RTF
00670 73DF 27 41          BEQ    INP8
00671 73E1 4F      INP7A  CLR A
00672 73E2 7E 717E        JMP    EJECT
00673              *
00674              *
00675 7420                ORG    $7400
00676              *
00677              *
00678 7420 8D 91   INP7B  BSR    STORE    SLASH FOUND
00679 7422 96 05          LDA A  CNTR1
00680 7424 81 02          CMP A  #2
00681 7426 27 2A          BEQ    INP8A
00682 7428 4C             INC A
00683 7429 97 05          STA A  CNTR1
00684 742B 81 05          CMP A  #5
00685 742D 26 BC          BNE    INP5
00686 742F BD 70AD        JSR    DUMP     PROCESS COMMAND SEQUENCE
00687 7412 D6 11          LDA B  CMND
00688 7414 85 40          BIT A  #$40     CK FOR EJECT
00689 7416 26 04          BNE    *+6
00690 7418 D7 02          STA B  MODE
00691 741A 20 AF          BRA    INP5
00692 741C DA 02          ORA B  MODE
00693 741E D7 02          STA B  MODE
00694 7420 20 BF          BRA    INP7A    INIT EJECT
00695              *
00696 7422 7D 0005 INP8   TST    CNTR1    PROCESS NON SLASH CHARACTER
00697 7425 27 A1          BEQ    INP4
00698 7427 BD 7393        JSR    STORE
00699 742A 36             PSH A
00700 742B 96 05          LDA A  CNTR1
00701 742D 81 02          CMP A  #2
00702 742F 32             PUL A
00703 7430 26 17          BNE    INP9
```

```
00734 7452 84 BF    INP8A  AND A  #$BF     ACCEPT EITHER CASE
00735 7454 C6 40           LDA B  #$40
00736 7456 81 8A           CMP A  #$8A     E = $CA OR $8A
00737 7458 27 70           BEQ    INP13
00738 745A D6 10           LDA B  RTF
00739 745C 27 0B           BEQ    INP9
00740 745E C6 10           LDA B  #$10
00741 7460 81 AA           CMP A  #$AA     U = $EA OR $AA
00742 7462 27 66           BEQ    INP13
00743 7464 58              ASL B          "B" = $20
00744 7465 81 98           CMP A  #$98     L = $D8 OR $98
00745 7467 27 61           BEQ    INP13
00746                 *
00747                 *
00748 7469 7D 0010 INP9    TST    RTF
00749 746C 26 93           BNE    INP7A
00750 746E 7C 0003         INC    PSTAT    SET BIT1 FOR MEM PRINT
00751 7471 8D 33           BSR    INP10
00752 7473 7E 73CB         JMP    INP5
00753                 *
00754 7476 DE 13   INP10   LDX    RMP      PROCESS STORAGE BUFFER
00755 7478 9C 15           CPX    WMP
00756 747A 27 64           BEQ    BEMTY
00757 747C E6 00           LDA B  0,X
00758 747E 08              INX
00759 747F A6 00           LDA A  0,X
00760 7481 08              INX
00761 7482 DF 13           STX    RMP
00762 7484 DE 08           LDX    XPTA
00763 7486 8D 32           BSR    INP11
00764 7488 20 EC           BRA    INP10
00765                 *
00766 748A 37      INP11   PSH B
00767 748B C5 20           BIT B  #$20     TEST FOR CARRIAGE COMMAND
00768 748D 26 0D           BNE    INP11A   NOT CARRIAGE COMMAND
00769 748F 36              PSH A
00770 7490 8D 40           BSR    COMP
00771 7492 9B 0B           ADD A  CPOS+1
00772 7494 D9 0A           ADC B  CPOS
00773 7496 97 0B           STA A  CPOS+1
00774 7498 D7 0A           STA B  CPOS     UPDATE CPOS
00775 749A 20 0F           BRA    INP11B
00776                 *
00777 749C C5 40   INP11A  BIT B  #$40     TEST FOR FEED COMMAND
00778 749E 26 0E           BNE    INP12
00779 74A0 36              PSH A
00780 74A1 8D 2F           BSR    COMP
00781 74A3 9B 0F           ADD A  FPOS+1
00782 74A5 D9 0E           ADC B  FPOS
00783 74A7 97 0F           STA A  FPOS+1
00784 74A9 D7 0E           STA B  FPOS
00785 74AB 32      INP11B  PUL A
00786 74AC 33              PUL B          RESTORE "B"
00787 74AD 37              PSH B
00788                 *
00789 74AE BD 735E INP12   JSR    DOUT
00790 74B1 32              PUL A
00791 74B2 85 80           BIT A  #$80     TEST FOR CHARRACTER
00792 74B4 26 09           BNE    *+11
00793 74B6 D6 03           LDA B  PSTAT
00794 74B8 C5 04           BIT B  #4       TEST FOR NON PRINT
00795 74BA 27 03           BEQ    *+5
00796 74BC 7E 7388         JMP    STR
00797 74BF 8A 1F           ORA A  #$1F     SELECT STROBE BIT
00798 74A1 BD 737E         JSR    STROBE
```

```
00769 74A4 BD 709D        JSR   RSTAT
00770 74A7 26 FB          BNE   *-3
00771 74A9 39             RTS
00772                 *
00773 74AA D7 11   INP13  STA B CMND      SAVE COMMAND
00774 74AC 7C 0005        INC   CNTR1
00775 74AF 7E 73CB        JMP   INP5
00776                 *
00777 74B2 C5 08   COMP   BIT B #8        DIRECTION BIT
00778 74B4 27 07          BEQ   *+9
00779 74B6 C4 07          AND B #7
00780 74B8 BD 72FF        JSR   ST2A
00781 74BB 20 02          BRA   *+4
00782 74BD C4 07          AND B #7
00783 74BF 39             RTS
00784                 *
00785                 *
00786 74C0 CE 001B BEMTY  LDX   #BUF      RESTORE POINTERS
00787 74C3 DF 13          STX   RMP
00788 74C5 DF 15          STX   WMP
00789 74C7 DE 08          LDX   XPIA
00790 74C9 4F             CLR A
00791 74CA 97 05          STA A CNTR1
00792 74CC 86 F0          LDA A #$F0
00793 74CE 94 03          AND A PSTAT
00794 74D0 97 03          STA A PSTAT
00795 74D2 39             RTS
00796                 *
00797                 *
00798                 *
00799 77F8                ORG   $77F8
00800                 *
00801 77F8 7050           FDB   INT       INTERRUPT SEQUENCE
00802 77FA 0000           FDB
00803 77FC 0000           FDB
00804 77FE 7000           FDB   START     RESTART ADDRESS
00805                 *
00806                 *
00807      0000           END

TOTAL ERRORS 00000
```

What is claimed is:

1. A paper feeding apparatus for a printing device, which printing device includes printing means for printing on a sheet of paper, and paper drive means for providing relative movement between a sheet of paper and the printing means to effect printing on the sheet of paper, said paper feeding apparatus comprising:

first paper storage means for storing a first plurality of individual sheets of paper;

first paper feed means for feeding a sheet of paper from said first paper storage means in a paper feed direction along a paper feed path to said paper drive means;

second paper storage means for storing a second plurality of individual sheets of paper;

a deflector-support member for guiding sheets of paper fed from said first paper storage means and for supporting said second paper storage means, said deflector-support member having a first surface positioned along said paper feed path on the side opposite from said first paper storage means and extending parallel to said paper feed path to define a portion of said paper feed path, said first surface serving to deflect a sheet of paper fed by said first paper feed means from said first paper storage means to move said sheet of paper along said paper feed path toward said paper drive means, and said deflector-support member further including a second surface for supporting said second paper storage means;

means defining a paper passageway between said second surface of said deflector-support member and said paper feed path at a location along said paper feed path intermediate the location of said first paper storage means and said paper drive means; and second paper feed means for feeding a sheet of paper from said second paper storage means through said paper passageway into said paper feed path toward said paper drive means.

2. The paper feeding apparatus of claim 1 further including sensing means for sensing when one of said sheets of paper of said first and second pluralities is in position for being received by said paper drive means, and actuation means responsive to said sensing means for actuating said paper drive means to engage said one sheet of paper and to move said one sheet of paper relative to said printing means to accurately position said one sheet of paper in a desired printing position for the start of printing thereon by said printing means.

3. The paper feeding apparatus of claim 2 wherein said sensing means comprises first detecting means for detecting the leading edge of said one sheet of paper being fed along said paper feed path, and wherein said actuation means comprises drive start means for actuating said paper drive means at a predetermined time after said first detecting means detects the leading edge of said one sheet of paper.

4. The paper feeding apparatus of claim 3 wherein said actuation means further includes stop means for stopping said paper drive means when said one sheet of paper has been moved by said paper drive means into a predetermined position with respect to said printing means.

5. The paper feeding apparatus of claim 4 wherein said stop means comprises first means operable when said one sheet of paper is fed from said first plurality of sheets of paper for stopping said paper drive means when said sheet of paper of said first plurality is in a first predetermined position with respect to said printing means, and second means operable when said one sheet of paper is fed from said second plurality of sheets of paper for stopping said paper drive means when said sheet of paper of said second plurality is in a second predetermined position with respect to said printing means.

6. The paper feeding apparatus of claim 5 wherein said first means is operable to stop said paper drive means when the leading edge of said sheet of paper of said first plurality has moved a first predetermined distance past said printing means, and wherein said second means is operable to stop said paper drive means when the trailing edge of said sheet of paper of said second plurality is at a second predetermined distance from said printing means.

7. The paper feeding apparatus of claim 6 in which said printing device includes exit guide means for directing said one sheet of paper toward a paper exit path of movement after said one sheet of paper has been moved past said printing means; wherein said actuation means further includes second detecting means for detecting the leading edge of said one sheet of paper after passing said printing means, said second detecting means being arranged downstream of said printing means along said paper exit path of movement; and wherein said first means is responsive to said second detecting means detecting the leading edge of said sheet of paper of said first plurality.

8. The paper feeding apparatus of claim 7 wherein said second means is responsive to said first detecting means for detecting the trailing edge of said sheet of paper of said second plurality.

9. The paper feeding apparatus of claim 8 wherein said drive start means operates said paper drive means to move the leading edge of said sheets of paper of said first and second pluralities in a paper feed direction past said printing means; wherein said first means includes first reverse feed means responsive to said second detecting means detecting the leading edge of said sheet of paper of said first plurality for reversing the direction of feed of said sheet of paper of said first plurality to move said sheet of paper of said first plurality in the opposite direction from said paper feed direction and for stopping said first reverse feed means when said second detecting means detects the leading edge of said sheet of paper of said first plurality being in alignment therewith to thereby align said sheet of paper of said first plurality in said first predetermined position; and wherein said second means includes second reverse feed means responsive to said first detecting means detecting the trailing edge of said sheet of paper of said second plurality for reversing the direction of feed of said sheet of paper of said second plurality to move said sheet of paper of said second plurality in the opposite direction from said paper feed direction and for stopping said second reverse feed means when said first detecting means detects the trailing edge of said sheet of paper of said second plurality being in alignment therewith to thereby align said sheet of paper of said second plurality in said second predetermined position.

10. The paper feeding apparatus of any one of the claims 1-9 wherein said second plurality of individual sheets of paper comprise a plurality of envelopes.

11. The paper feeding apparatus of claim 1 wherein said deflector-support member comprises a plate member having said first surface defined on one side thereof and said second surface defined on the opposite side thereof.

12. The paper feeding apparatus of claim 11 wherein said plate member is inclined with rspect to a vertical direction, and wherein said means defining a paper passageway comprises a lower edge of said inclined plate member and a support surface which extends transversely of the plane of said second surface of said inclined plate member and which is spaced from said lower edge of said plate member so as to define said paper passageway between said lower edge of said plate member and said support surface.

13. The paper feeding apparatus of claim 12 wherein said second paper storage means comprises a tray member supported by said inclined second surface of said plate member and said support surface, said tray member including a paper slot therein communicating with said paper passageway defined between said lower edge of said plate member and said support surface.

14. The paper feeding apparatus of claim 13 wherein said tray member includes a first tray component adapted to be supported by said second surface of said plate member, said first tray component including a lower edge which extends downwardly below said lower edge of said plate member when said tray member is supported by said second surface of said plate member, and a second tray component slidably movable with respect to said first tray component, said second tray component including a transversely extending portion adapted for engagement with said support surface, and wherein said paper slot is defined between said lower edge of said first tray component and said transversely extending portion of said second tray component.

15. The paper feeding apparatus of claim 14 wherein said second paper feed means are supported adjacent said paper slot to engage a sheet of paper in said tray member, said second paper feed means being operable to feed a sheet of paper of said second plurality through said paper slot and said paper passageway into said paper feed path.

16. The paper feeding apparatus of claim 15 wherein said tray member includes adjusting means for adjusting the position of said first and second tray components so as to adjust the position of said lower edge of said first tray component with respect to said second paper feed means to thereby vary the size of said paper slot.

17. The paper feeding apparatus of claim 16 wherein said adjusting means of said paper tray includes first flange means on said first tray component, second flange means on said second tray component, and means for adjusting the spacing between said first and second flange means to vary the position of said second tray component with respect to said first tray component.

18. The paper feeding apparatus of claim 17 wherein said tray member further includes tray guide means on said first and second tray components for guiding said second tray component for sliding movement with respect to said first tray component.

19. The paper feeding apparatus of claim 14 wherein said second plurality of individual sheets of paper are arranged on edge on a surface of said first tray component supported by said inclined second surface of said plate member, and further including means for urging said second plurality of individual sheets of paper downwardly along said surface of said first tray component toward said lower edge thereof when said tray member is supported by said plate member to urge the lowermost sheet of paper in said tray member into engagement with said second paper feed means.

20. The paper feeding apparatus of claim 19 wherein said means for urging comprises a support bar arranged for sliding movement along said surface of said first tray component and in engagement with the uppermost sheet of paper in said tray member.

21. The paper feeding apparatus of claim 13 further including paper tray sensing means for generating a signal in the absence of a sheet of paper of said second plurality being in position for feeding to said paper drive means.

22. The paper feeding apparatus of claim 1 further including receptacle means for receiving sheets of paper from said printing device after printing has been effected thereon, and ejection means for ejecting a sheet of paper from said printing device and guiding said sheet of paper into said receptacle means when printing on said sheet of paper by said printing means has been completed.

23. The paper feeding apparatus of claim 22 wherein said ejection means comprises ejection rollers operable to engage a sheet of paper in said printing device and for moving said sheet of paper along a paper exit path of movement, and means for directing a sheet of paper moving along said exit path of movement into said receptacle means.

24. The paper feeding apparatus of claim 23 wherein said means for directing comprises pivotable deflector means including first and second spaced portions, said first portion being mounted adjacent said exit path of movement to pivot about a pivot axis arranged on one side of said exit path of movement, said pivotable deflector means being pivotable between a first position in which at least an intermediate portion intermediate said first and second portions is arranged to lie in said exit path of movement, and a second position in which said intermediate portion is arranged to the side of said exit path of movement at which said pivot axis is arranged, said pivotable deflector means being pivotable from said first position toward said second position when a sheet of paper is being moved along said exit path of movement by said ejection rollers and being pivotable toward said first position when said sheet of paper is released by said ejection rollers; and wherein said receptable means is arranged adjacent to said exit path of movement opposite from said pivotable deflector means such that said exit path of movement extends between said pivot axis of said pivotable deflector means and said receptacle means so that as said pivotable deflector means moves toward said first position when a sheet of paper is released by said ejection rollers said sheet of paper will be directed from said exit path of movement into said receptacle means.

25. The paper feeding apparatus of claim 1 further including third paper storage means for storing a third plurality of individual sheets of paper, said third paper storage means being positioned adjacent said paper feed path at a location intermediate said first paper storage means and said paper passageway, and third paper feed means for feeding a sheet of paper from said third plurality of sheets of paper into said paper feed path, said first surface of said deflector-support member serving to deflect said sheet of paper fed by said third paper feed means to move said sheet of paper along said paper feed path toward said paper drive means.

26. A paper ejection mechanism for a printing device, which printing device includes printing means for printing on a sheet of paper and paper drive means for providing relative movement between a sheet of paper and said printing means to effect printing on the sheet of paper, said paper ejection mechanism comprising:

ejection means for engaging a sheet of paper as it exits from said printer device and for moving said sheet of paper away from said printing device along an exit path, said ejection means being arranged along said exit path downstream of said printer device;

pivotable deflector means including first and second spaced portions, said first portion being mounted adjacent said exit path to pivot about a pivot axis arranged on one side of said exit path, said pivotable deflector means being pivotable between a first position in which at least an intermediate portion intermediate said first and second portions is arranged to lie in said exit path, and a second position in which said intermediate portion is arranged to the side of said exit path at which said pivot axis is arranged;

receptable means for receiving ejected sheets of paper, said receptacle means being arranged adjacent to said exit path opposite from said deflector means such that said exit path extends between said pivot axis of said deflector means and said receptacle means; and said deflector means being pivotable from said first position toward said second position when a sheet of paper is being moved along said exit path by said ejection means and being pivotable toward said first position when said sheet of paper is released by said ejection means to thereby direct said sheet of paper from said exit path into said receptable means.

27. The paper ejection mechanism of claim 26 wherein said pivotable deflector means is located downstream, in the direction of movement along said exit path, from said ejection means.

28. The paper ejection mechanism of claim 27 wherein said ejection means comprises a pair of ejection rollers for engaging opposite surfaces of said sheet of paper so that said sheet of paper is moved thereby upon rotation of said ejection rollers, and means for rotating said ejection rollers to move said sheet of paper away from said printing device along said exit path.

29. The paper ejection mechanism of claim 28 further including a support member for supporting said pivotable deflector means, said support member being arranged along one side of said exit path opposite said receptacle means and supporting said first portion of said pivotable deflector means for pivotable movement between said first and second positions.

30. The paper ejection mechanism of claim 29 wherein said pivotable deflector means comprises a pivotable deflector bar having a first end supported by said support member and a second end spaced from said first end.

31. The paper ejection mechanism of claim 30 wherein said pivotable deflector bar comprises a V-shaped bar having first and second leg portions, said first and second leg portions being spaced from one another at said first end of said pivotable deflector bar and being joined to one another at said second end, and said first and second portions at said first end each being pivotably supported by said support member.

32. The paper ejection mechanism of claim 29 wherein said receptacle means comprises a receptacle basket supported adjacent said exit path opposite from said support member for receiving ejected sheets of paper deflected by said pivotable deflector means.

33. The paper ejection mechanism of claim 26 wherein said pivotable deflector means is pivotable from said second position to said first position by gravity when a sheet of paper is released by said ejection means.

34. A printing apparatus comprising:

printing means for printing on a sheet of paper;

paper drive means for providing relative movement between a sheet of paper and said printing means to effect printing on the sheet of paper;

first paper storage means for storing a first plurality of individual sheets of paper;

first paper feed means for feeding a sheet of paper from said first paper storage means in a paper feed direction along a paper feed path to said paper drive means;

second paper storage means for storing a second plurality of individual sheets of paper;

a deflector-support member for guiding sheets of paper fed from said first paper storage means and for supporting said second paper storage means, said deflector-support member having a first surface positioned along said paper feed path on the side opposite from said first paper storage means and extending parallel to said paper feed path to define a portion of said paper feed path, said first surface serving to deflect a sheet of paper fed by said first paper feed means from said first paper storage means to move said sheet of paper along said paper feed path toward said paper drive means, and said deflector-support member further including a second surface for supporting said second paper storage means;

means defining a paper passageway between said second surface of said deflector-support member and said paper feed path at a location along said paper feed path intermediate the location of said first paper storage means and said paper drive means; and second paper feed means for feeding a sheet of paper from said second paper storage means through said paper passageway into said paper feed path toward said paper drive means.

35. The printing apparatus of claim 34 further including sensing means for sensing when one of said sheets of paper of said first and second pluralities is in position for being received by said paper drive means, and actuation means responsive to said sensing means for actuating said paper drive means to engage said one sheet of paper and to move said one sheet of paper relative to said printing means to accurately position said one sheet of paper in a desired printing position for the start of printing thereon by said printing means.

36. The printing apparatus of claim 35 wherein said sensing means comprises first detecting means for detecting the leading edge of said one sheet of paper being fed along said paper feed path, and wherein said actuation means comprises drive start means for actuating said paper drive means at a predetermined time after said first detecting means detects the leading edge of said one sheet of paper.

37. The printing apparatus of claim 36 wherein said actuation means further includes stop means for stopping said paper drive means when said one sheet of paper has been moved by said paper drive means into a predetermined position with respect to said printing means.

38. The printing apparatus of claim 37 wherein said stop means comprises first means operable when said one sheet of paper is fed from said first plurality of sheets of paper for stopping said paper drive means when said sheet of paper of said first plurality is in a first predetermined position with respect to said printing means, and second means operable when said one sheet of paper is fed from said second plurality of sheets of paper for stopping said paper drive means when said sheet of paper of said second plurality is in a second predetermined position with respect to said printing means.

39. The printing apparatus of claim 34 wherein said deflector-support member comprises a plate member having said first surface defined on one side thereof and said second surface defined on the opposite side thereof.

40. The printing apparatus of claim 39 wherein said plate member is inclined with respect to a vertical direction, and wherein said means defining a paper passageway comprises a lower edge of said inclined plate member and a support surface which extends transversely of the plane of said second surface of said inclined plate member and which is spaced from said lower edge of said plate member so as to define said paper passageway between said lower edge of said plate member and said support surface.

41. The printing apparatus of claim 40 wherein said second paper storage means comprises a tray member supported by said inclined second surface of said plate member and said support surface, said tray member including a paper slot therein communicating with said paper passageway defined between said lower edge of said plate member and said support surface.

42. The printing apparatus of claim 34 further including receptacle means for receiving sheets of paper from said printing device after printing has been effected thereon, and ejection means for ejecting a sheet of paper from said printing device and guiding said sheet of paper into said receptacle means when printing on said sheet of paper by said printing means has been completed.

43. The printing apparatus of claim 42 wherein said ejection means comprises ejection rollers operable to engage a sheet of paper in said printing device and for moving said sheet of paper along a paper exit path of movement, and means for directing a sheet of paper moving along said exit path of movement into said receptacle means.

44. The printing apparatus of claim 43 wherein said means for directing comprises pivotable deflector means including first and second spaced portions, said first portion being mounted adjacent said exit path of movement to pivot about a pivot axis arranged on one side of said exit path of movement, said pivotable deflector means being pivotable between a first position in which at least an intermediate portion intermediate said first and second portions is arranged to lie in said exit path of movement, and a second position in which said intermediate portion is arranged to the side of said exit path of movement at which said pivot axis is arranged, said pivotable deflector means being pivotable from said first position toward said second position when a sheet of paper is being moved along said exit path of movement by said ejection rollers and being pivotable toward said first position when said sheet of paper is released by said ejection rollers; and wherein said receptacle means is arranged adjacent to said exit path of movement opposite from said pivotable deflector means such that said exit path of movement extends between said pivot axis of said pivotable deflector means and said receptacle means so that as said pivotable deflector means moves toward said first position when a sheet of paper is released by said ejection rollers said sheet of paper will be directed from said exit path of movement into said receptacle means.

45. The printing apparatus of claim 34 further including third paper storage means for storing a third plurality of individual sheets of paper, said third paper storage means being positioned adjacent said paper feed path at a location intermediate said first paper storage means and said paper passageway, and third paper feed means for feeding a sheet of paper from said third plurality of sheets of paper into said paper feed path, said first surface of said deflector-support member serving to deflect said sheet of paper fed by said third paper feed means to move said sheet of paper along said paper feed path toward said paper drive means.

46. A paper feeding apparatus for a printing device, which printing device includes printing means for printing on a sheet of paper, and paper drive means for providing relative movement between a sheet of paper and the printing means to effect printing on the sheet of paper, said paper feeding apparatus comprising:

first paper storage means for storing a first plurality of individual sheets of paper;

first paper feed means for feeding a sheet of paper from said first paper storage means in a paper feed direction along a paper feed path to said paper drive means;

a deflector plate member having (i) a first surface on one side thereof for deflecting a sheet of paper fed by said first paper feed means from said first paper storage means to move said sheet of paper along said paper feed path toward said paper drive means, (ii) a second surface defined on the opposite side of said deflector plate member, and (iii) a lower edge; said deflector plate member being supported so that said first surface is positioned along said paper feed path on the side opposite from said first paper storage means and extends parallel to said paper feed path to define a portion of said paper feed path;

a support surface extending transversely of the plane of said second surface of said deflector plate member, said support surface being spaced from said lower edge of said deflector plate member so as to define a paper passageway between said lower edge of said deflector plate member and said support surface which communicates with said paper feed path at a location intermediate the location of said first paper storage means and said paper drive means;

a tray member for storing a second plurality of individual sheets of paper, said tray member being supported by said second surface of said deflector plate member and said support surface, and said tray member including a paper slot therein communicating with said paper passageway defined between said lower edge of said deflector plate member and said support surface; and second paper feed means for feeding a sheet of paper from said tray member through said paper slot and said paper passageway into said paper feed path toward said paper drive means.

47. A printing apparatus comprising:

printing means for printing on a sheet of paper;

paper drive means for providing relative movement between a sheet of paper and said printing means to effect printing on the sheet of paper;

first paper storage means for storing a first plurality of individual sheets of paper;

first paper feed means for feeding a sheet of paper from said first paper storage means in a paper feed direction along a paper feed path to said paper drive means;

a deflector plate member having (i) a first surface on one side thereof for deflecting a sheet of paper fed by said first paper feed means from said first paper storage means to move said sheet of paper along said paper feed path toward said paper drive means, (ii) a second surface defined on the opposite side of said deflector plate member, and (iii) a lower edge; said deflector plate member being supported so that said first surface is positioned along said paper feed path on the side opposite from said first paper storage means and extends parallel to said paper feed path to define a portion of said paper feed path;

a support surface extending transversely of the plane of said second surface of said deflector plate member, said support surface being spaced from said lower edge of said deflector plate member so as to define a paper passageway between said lower edge of said deflector plate member and said support surface which communicates with said paper feed path at a location intermediate the location of said first paper storage means and said paper drive means;

a tray member for storing a second plurality of individual sheets of paper, said tray member being supported by said second surface of said deflector plate member and said support surface, and said tray member including a paper slot therein communicating with said paper passageway defined between said lower edge of said deflector plate member and said support surface; and second paper feed means for feeding a sheet of paper from said tray member through said paper slot and said paper passageway into said paper feed path toward said paper drive means.

* * * * *

UNITED STATES PATENT AND TRADEMARK OFFICE

CERTIFICATE OF CORRECTION

PATENT NO. : 4,407,597

DATED : October 4, 1983

INVENTOR(S) : Ludwig J. Kapp

It is certified that error appears in the above-identified patent and that said Letters Patent are hereby corrected as shown below:

Column 1, line 26, "advandes" should read --advances--.
Column 2, line 26, "provied" should read --provided--.

Column 10, line 37 delete "shown".
Column 10, line 49 "65" should read --66--.
Column 11, line 54, "85" should read --86--.
Column 13, line 17, "105" should read --106--.
Column 15, line 22 "so" should read --as--.
Column 24, line 57 "322" should read --332--.
Column 26, line 1 "proper" should read --paper--.
Column 34, line 54, after "guide" insert --plate--.
Column 38, line 2 after "receptacles" insert --means--.
Column 44, line 44 "rectangular" should read --rectangle--.

Signed and Sealed this

*Sixteenth* Day of *October 1984*

[SEAL]

*Attest:*

GERALD J. MOSSINGHOFF

*Attesting Officer*

*Commissioner of Patents and Trademarks*